United States Patent [19]

Goshima et al.

[11] 4,204,728

[45] May 27, 1980

[54] METHOD AND APPARATUS FOR COLOR CONVERSION

[75] Inventors: Yoshitomo Goshima, Yokohama; Kazuo Kawakubo, Hino; Katsushi Furuichi; Hisashi Sakamaki, both of Yokohama; Osamu Sawamura, Atsugi; Yutaka Komiya, Tokyo; Masahiro Tomosada, Kawasaki, all of Japan

[73] Assignee: Canon Kabushiki Kaisha, Tokyo, Japan

[21] Appl. No.: 908,891

[22] Filed: May 23, 1978

[30] Foreign Application Priority Data

May 24, 1977 [JP] Japan ..... 52-60163
Sep. 9, 1977 [JP] Japan ..... 52-108578

[51] Int. Cl.[2] ..... G03G 15/01

[52] U.S. Cl. ..... 355/4; 118/645; 355/14 R; 430/43

[58] Field of Search ..... 355/4, 14, 32; 96/1.2; 118/645, 7

[56] References Cited

U.S. PATENT DOCUMENTS

| | | | |
|---|---|---|---|
| 3,801,197 | 4/1974 | Akiyama et al. | 355/4 |
| 4,008,962 | 2/1977 | Nepper | 355/4 X |
| 4,045,218 | 8/1977 | McVeigh | 355/4 X |

*Primary Examiner*—R. L. Moses

*Attorney, Agent, or Firm*—Fitzpatrick, Cella, Harper & Scinto

[57] ABSTRACT

A method and an apparatus for color conversion capable of converting a particular color of an image original into another color as desired, in which indication is made as to what color of the image original colors other than that designated for the color conversion can be converted into, and, on the basis of this indication, designation for the color conversion in the image original colors other than that previously designated can be done, and, further, on the basis of this color conversion designation, a set of the color-separation filter and the developing color can be automatically selected.

48 Claims, 74 Drawing Figures

D/F (DEVELOPER)

| (FILTER) | Y | M | C | BK |
|---|---|---|---|---|
| B | 0 | 1 | 2 | 3 |
| G | 4 | 5 | 6 | 7 |
| R | 8 | 9 | A | B |
| ND | C | D | E | F |

FIG. 2

CONVERSION COLOR INDICATION BUTTOM →

| ORIGINAL COLOR INDICATION BUTTOM | M | MMY | R | MYY | Y | YYC | G | YCC | C | CCM | V | CMM | Bk | NON |
|---|---|---|---|---|---|---|---|---|---|---|---|---|---|---|
| M | ○ | ○ | ○ | ○ | ● | ○ | ● | ○ | ● | ○ | ○ | ○ | ○ | ● |
| R | ○ | ○ | ○ | ○ | ○ | ○ | ● | ○ | ○ | ○ | ○ | ○ | ○ | ○ |
| Y | ○ | ○ | ○ | ○ | ● | ○ | ● | ○ | ● | ○ | ○ | ○ | ○ | ● |
| G | ● | ○ | ● | ○ | ● | ● | ● | ● | ● | ○ | ● | ○ | ● | ● |
| C | ● | ○ | ○ | ○ | ● | ○ | ○ | ○ | ● | ○ | ○ | ○ | ○ | ● |
| V | ● | ○ | ● | ○ | ● | ● | ● | ● | ● | ○ | ● | ○ | ● | ● |
| Bk | ○ | ○ | ○ | ○ | ○ | ● | ● | ● | ○ | ○ | ○ | ○ | ● | ○ |

FIG. 3

CONVERSION COLOR INDICATION BUTTOM

| ORIGINAL COLOR INDICATION BUTTOM | M | MMY | R | MYY | Y | YYC | G | YCC | C | CCM | V | CMM | Bk | NON |
|---|---|---|---|---|---|---|---|---|---|---|---|---|---|---|
| M | ○ | ○ | ○ | ○ | ○ | ○ | ● | ○ | ● | ○ | ○ | ○ | ○ | ○ |
| R | ○ | ○ | ○ | ○ | ○ | ○ | ● $R_7$ | ○ | ○ | ○ | ○ | ○ | ○ | ○ |
| Y | ○ | ○ | ○ | ○ | ● | ○ | ○ | ○ | ○ | ○ | ○ | ○ | ○ | ● |
| G | ○ | ○ | ○ | ○ | ● $G_5$ | ○ | ○ | ○ | ○ | ○ | ○ | ○ | ○ | ○ |
| C | ○ | ○ | ○ | ○ | ● | ○ | ○ | ○ | ○ | ○ | ○ | ○ | ○ | ● |
| V | ○ | ○ | ○ | ○ | ○ | ● | ● | ○ | ● | ○ | ○ | ○ | ○ | ○ |
| Bk | ○ | ○ | ○ | ○ | ○ | ● | ● | ○ | ○ | ○ | ○ | ○ | ○ | ○ |

| FIG. 8A | FIG. 8B |
|---|---|

D/F (DEVELOPER)

| (FILTER) | Y | M | C | BK |
|---|---|---|---|---|
| B | 0 | 1 | 2 | 3 |
| G | 4 | 5 | 6 | 7 |
| R | 8 | 9 | A | B |
| ND | C | D | E | F |

FIG. 5-a"
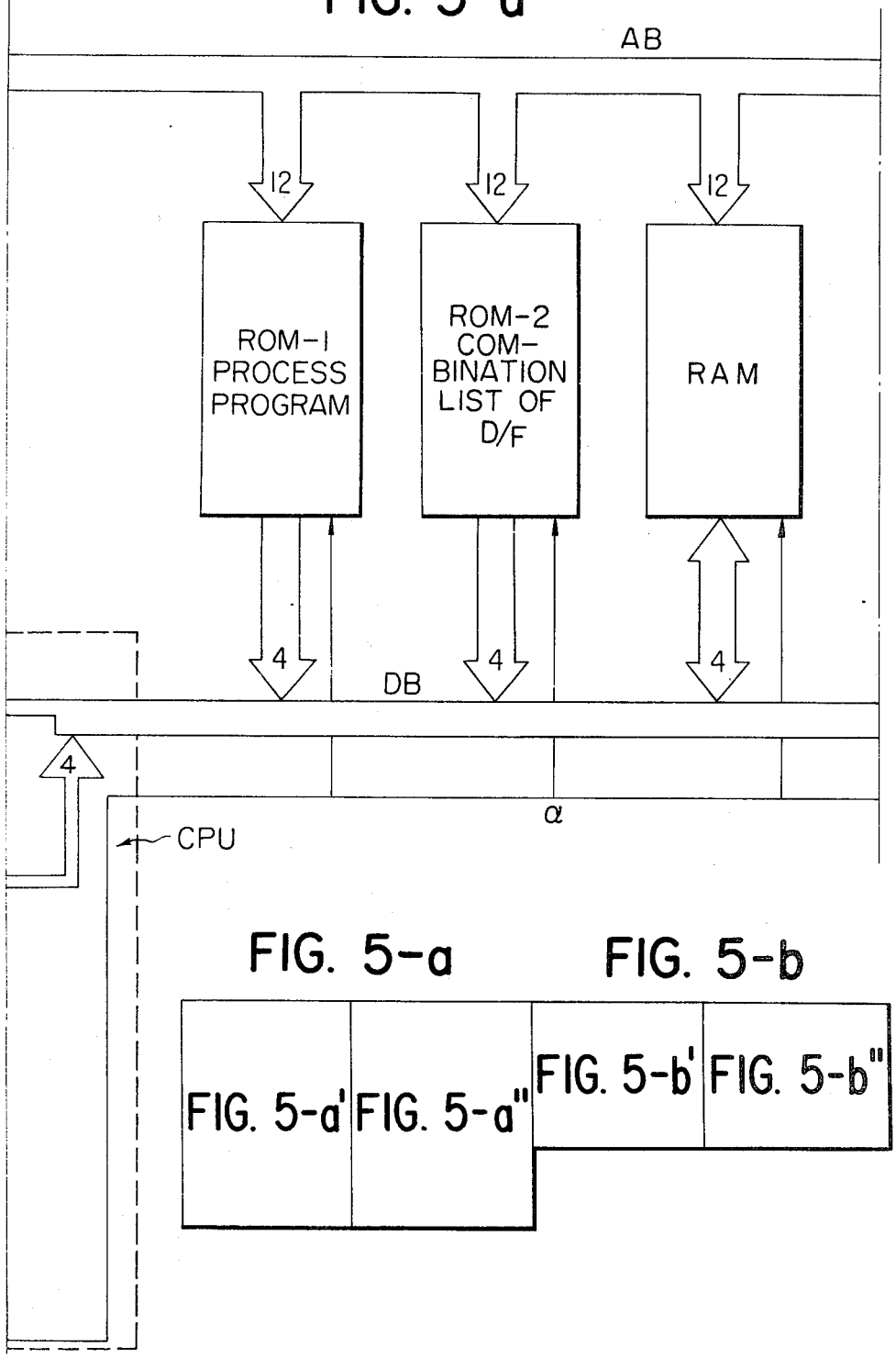
FIG. 5-a FIG. 5-b
| | | | |
|---|---|---|---|
| FIG. 5-a' | FIG. 5-a" | FIG. 5-b' | FIG. 5-b" |

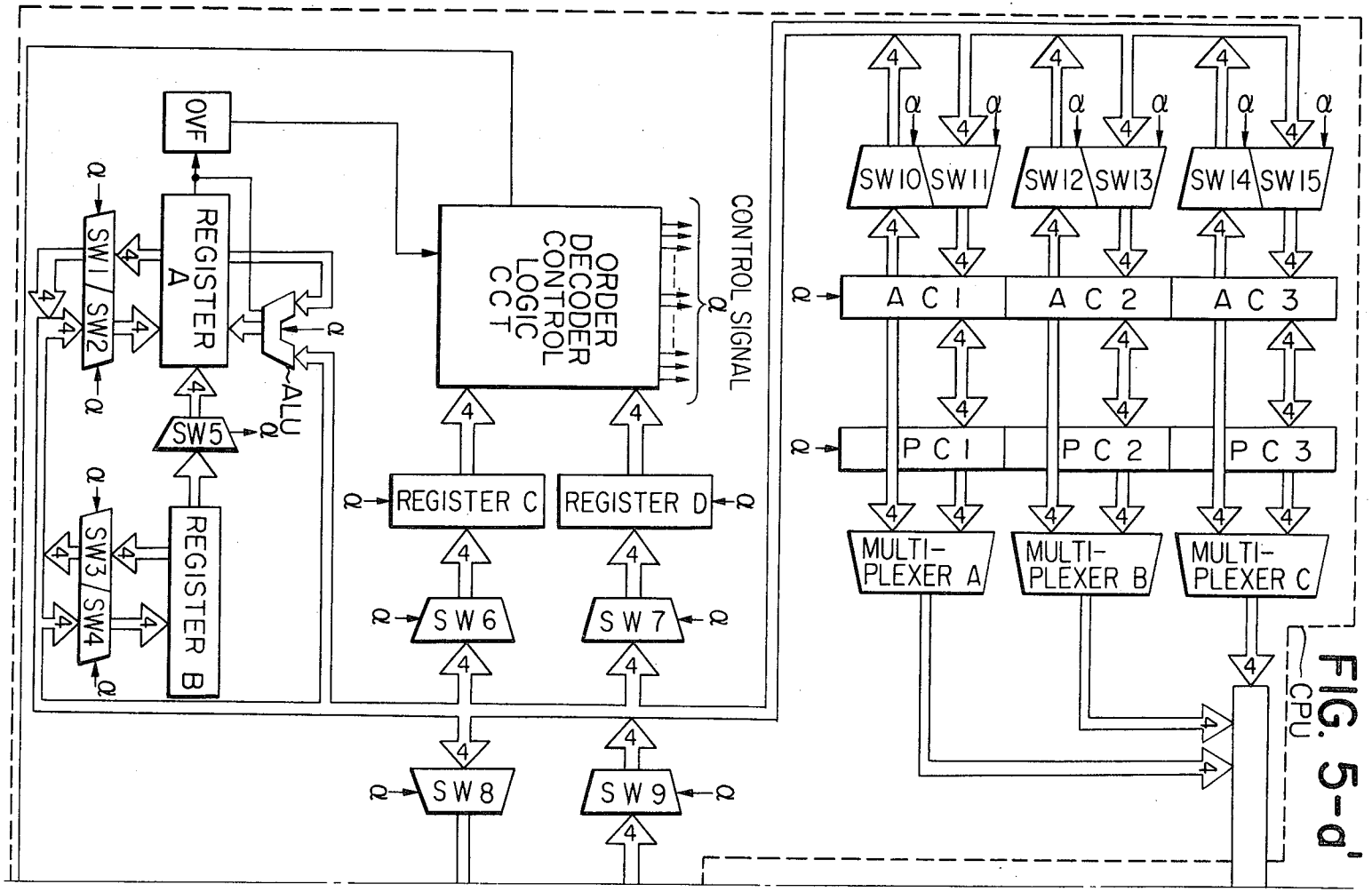
FIG. 5-a'

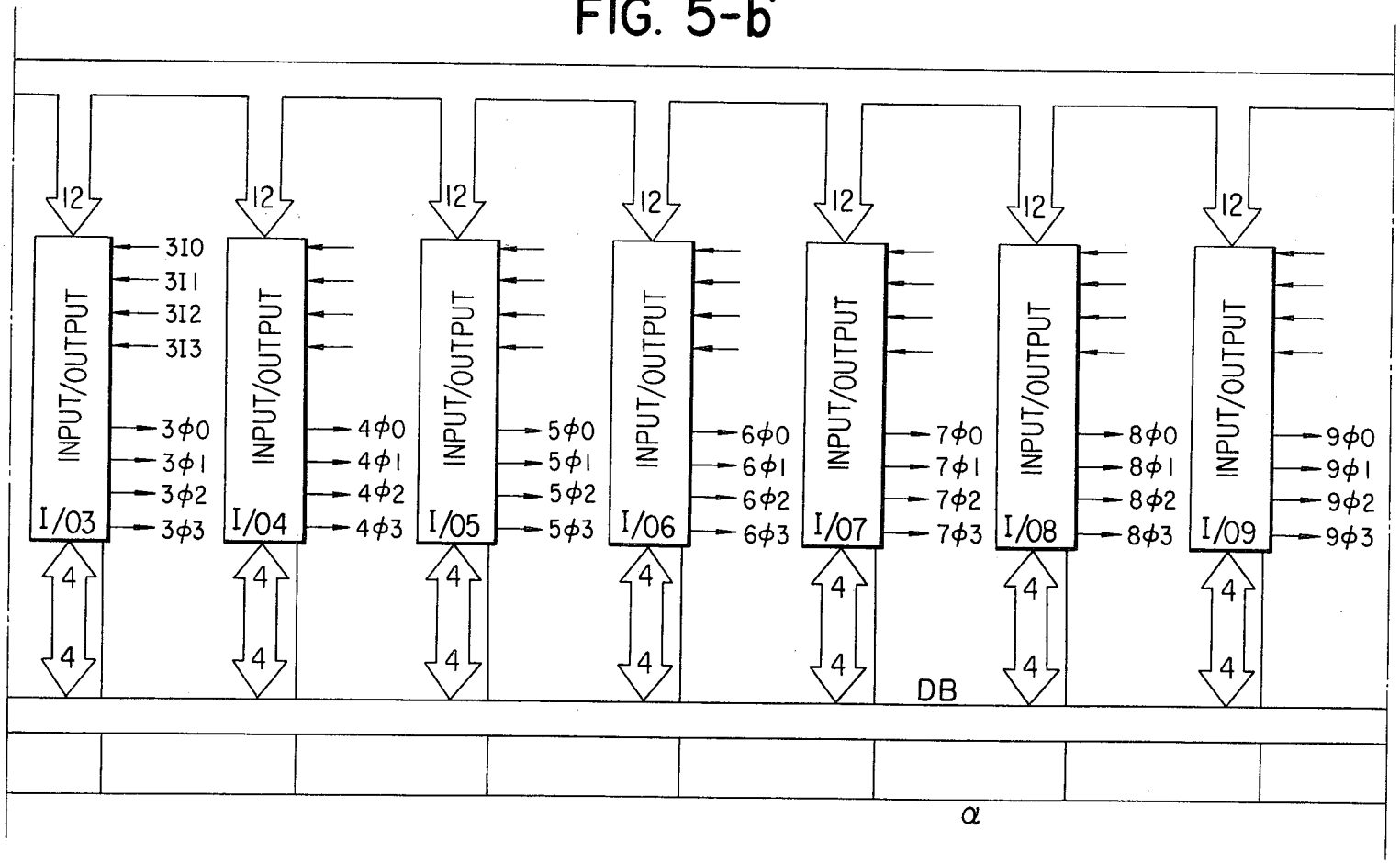
FIG. 5-b'

FIG. 5-b"
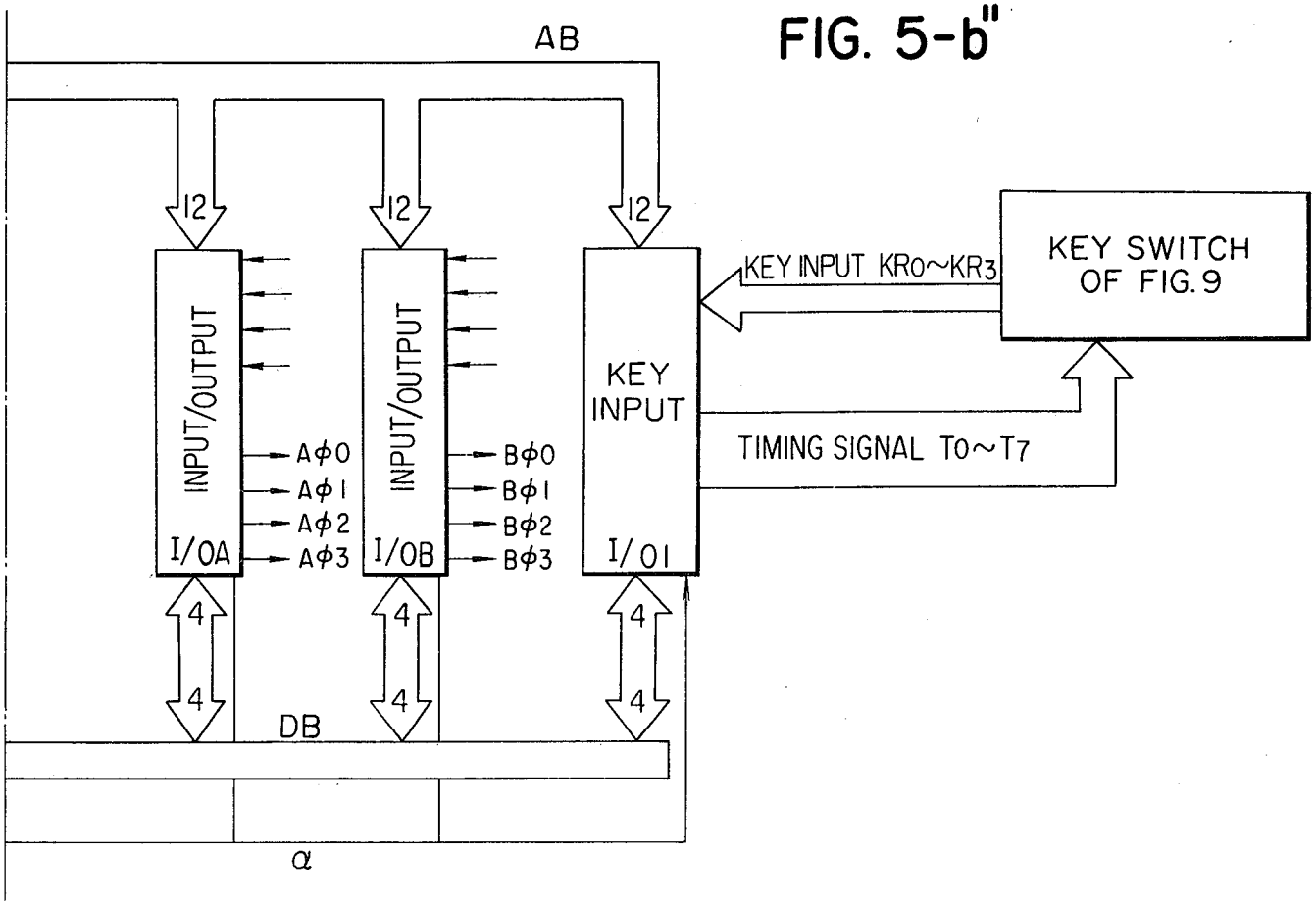

| FIG. 9A |
| --- |
| FIG. 9B |

FIG. 11B

| 9 | A | B | C | D | E | F |
|---|---|---|---|---|---|---|
| ← | WA(2) | → | WA(3) | ← | | WA(3) → |
| 1st D/F | 2nd D/F | 3rd D/F | | | | |
| ← | WA(6) | → | WR(7) | ← | | WR(7) → |
| | 43 | | | 57 | | 1st ORIGINAL INDICATION COLOR CODE |
| 1st D/F | 2nd D/F | 3rd D/F | 1st D/F | 2nd D/F | 3rd D/F | |
| | 44 | | | 58 | | 2nd ORIGINAL INDICATION COLOR CODE |
| | 45 | | | 59 | | 3rd ORIGINAL INDICATION COLOR CODE |
| | 46 | | | 60 | | 4th ORIGINAL INDICATION COLOR CODE |
| | 47 | | | 61 | | 5th ORIGINAL INDICATION COLOR CODE |
| | 48 | | | 62 | | 6th ORIGINAL INDICATION COLOR CODE |
| | 49 | | | 63 | | 7th ORIGINAL INDICATION COLOR CODE |
| | 50 | | | 64 | | 1st CONVERSION INDICATION COLOR CODE |
| | 51 | | | 65 | | 2nd CONVERSION INDICATION COLOR CODE |
| | 52 | | | 66 | | 3rd CONVERSION INDICATION COLOR CODE |
| | 53 | | | 67 | | 4th CONVERSION INDICATION COLOR CODE |
| | 54 | | | 68 | | 5th CONVERSION INDICATION COLOR CODE |
| | 55 | | | 69 | | 6th CONVERSION INDICATION COLOR CODE |
| | 56 | | | 70 | | 7th CONVERSION INDICATION COLOR CODE |

4th AREA 5th AREA

FIG. 11

| FIG. 11A | FIG. 11B |
|---|---|

FIG. 11A

| | 0 | 1 | 2 | 3 | 4 | 5 | 6 | 7 | 8 |
|---|---|---|---|---|---|---|---|---|---|
| 0 | WR(0) | ← | WA(0) | → | WR(1) | ← | WA(1) | → | WR(2) |
| 1 | WR(4) | ← | WA(4) | → | WR(5) | ← | WA(5) | → | WR(6) |
| 2 | ← ONE TIME → | | | | 15 | | | 29 | |
| | 1st D/F | 2nd D/F | 3rd D/F | 1st D/F | 2nd D/F | 3rd D/F | 1st D/F | 2nd D/F | 3rd D/F |
| 3 | ← TWO TIMES → | | | | 16 | | | 30 | |
| | 1st D/F | 2nd D/F | 3rd D/F | | | | | | |
| 4 | ← 3 TIMES → | | | | 17 | | | 31 | |
| 5 | ← 4 TIMES → | | | | 18 | | | 32 | |
| 6 | ← 5 → | | | | 19 | | | 33 | |
| 7 | | 6 | | | 20 | | | 34 | |
| 8 | | 7 | | | 21 | | | 35 | |
| 9 | | 8 | | | 22 | | | 36 | |
| A | | 9 | | | 23 | | | 37 | |
| B | | 10 | | | 24 | | | 38 | |
| C | | 11 | | | 25 | | | 39 | |
| D | | 12 | | | 26 | | | 40 | |
| E | | 13 | | | 27 | | | 41 | |
| F | | 14 | | | 28 | | | 42 | |
| | 1st AREA | | | 2nd AREA | | | 3rd AREA | | |

STEP 19
STEP 20
STEP 21
STEP 21a
STEP 21b
STEP 21c
STEP 21d
READ WA(3)
WA(3)=020 ?
YES
NO
GC
LIST ADDRESS WA(0)
CNT ADDRESS WA(1)
RESET WR(4)
(STEP 7)
(STEP 8)
READ WA(2)
READ WR(3) & WA(1)
SEE COINCIDENCE OF
WA(2) & WR(3) WA(1)
COINCIDENCE ?
NO
YES
WA(0)+7→WA(0)

| | |
|---|---|
| FIG. 13A | |
| FIG. 13B | |

NA'
MA2
MB
MC
RAM ADDRESS SET FLAG SET
WA(0) SET
WA(1) SET
READ 5
READ 5 3rd COLOR
ϕRG
NO COIN-CIDENCE
YES
NO

| FIG. 15A |
| --- |
| FIG. 15B |

| | |
|---|---|
| FIG. 17A | |
| FIG. 17B | |

| FIG. 18A |
|---|
| FIG. 18B |

| FIG. 19A | |
|---|---|
| FIG. 19B | |

| FIG. 20A |
| --- |
| FIG. 20B |

| FIG. 21A |
| --- |
| FIG. 21B |

| FIG. 22A |
| --- |
| FIG. 22B |

| FIG. 28A |
| --- |
| FIG. 28B |

| FIG. 30A | |
|---|---|
| FIG. 30B | |

METHOD AND APPARATUS FOR COLOR CONVERSION

BACKGROUND OF THE INVENTION a. Field of the Invention

This invention relates to a method and an apparatus for color conversion when a color of an image original is to be converted into another color. More particularly, the present invention is concerned with a color reproduction apparatus incorporating therein the above mentioned color-conversion apparatus.

b. Description of the Prior Art

Usually, in the color reproduction apparatus adopting the electrophotographic method, color reproduction has been obtained by a combination of a several kinds of color-separation filters for separating colors in the image original and a developing agent, or developer, containing therein several kinds of coloring pigments. For instance, blue, green, and red filters are used as the color-separation filters, and pigments in yellow (hereinafter abbreviated as "Y"), magenta (hereinafter abbreviated as "M"), and cyan (hereinafter abbreviated as "C") colors are used as the developer. For obtaining a reproduced copy of an image original as it is, it has been a usual practice to follow the following process steps in the color reproduction apparatus as shown in FIG. 1.

Step 1: Using a blue filter BF in the filter 4, a color original is subjected to color-separation and then exposed on a photosensitive layer 8, thereby forming a latent image containing Y and a color containing therein Y (i.e., red and green). This color latent image is developed in a Y developing device 17, and the developed image is transferred onto paper 16.

Step 2: Using a green filter GF, the color original is subjected to color-separation and exposure to obtain a latent image in M and a color containing M (i.e., red and blue). This color latent image is developed in an M developing device 18, and the developed image is transferred onto paper 16.

Step 3: Using a red filter RF, the color original is subjected to color-separation and exposure to obtain a latent image in C and a color containing C (green and blue). This color latent image is developed in a C developing device 19, and the developed image is transferred onto paper 16.

In the above-described process steps, images in colors Y, M, and C are sequantially transferred onto the reproduction paper, and the final image copy is obtained by heat-fixing the transferred image by a heat-fixing device 11.

Thus, the color copy has been obtained with faithful reproducibility of the color original through three process steps by determining a combination of the color-separation filter and the developing agent.

While it is readily conceivable that reproduction of different color from that of the color original by changing combination of the developer, or changing the number of process steps from three to any arbitrary number, it is really a complicated work to determine proper combination between the color-separation filter and the developer on the basis of the relationship between the color original and the color to be reproduced.

Also, in order to reproduce the image original in a mono-color or bi-color by the use of the abovementioned steps for faithfully reproducing the image original, a long span of time is required for completion of the process. In this case, even if the combination of the developing device and the filter is made manually selectable, it is still not known whether the reproduced copy to be obtained is faithful to the original image color, or not, or which color in the image original changes, and how. In this consequence, more time is taken for the reproduction process which should be carried out while comparing with a color chart.

SUMMARY OF THE INVENTION

It is therefore an object of the present invention to provide a method and an apparatus for determining the combination of the color-separation filter and the developer for converting a particular color in the image original into a desired color (for example, a red color portion in the image original is changed to blue) in a copy to be reproduced.

It is also an object of the present invention to provide an apparatus for changing color in the image original into another desired color, in which an indication can be made as to what color, the original image colors other than that designated for the color conversion, wil be converted in the reproduced copy.

It is another object of the present invention to provide an apparatus which indicates the designated color, when a designation is made for changing not only one particular color in the image original, but also a plurality of colors into desired ones (for example, red to blue, and yellow to green), and if this designation is possible by the combination of the color-separation filter and the developer, and also indicates to what color the original image colors other than that designated can be converted, and further indicates if such designation is not possible.

It is still another object of the present invention to provide an apparatus which discriminates a combination of the color-separation filter and the developer that does not copy a certain color alone in the image original (for example, only M color in the image original is rendered white for the background, and the remaining colors are converted), and indicates to what color the other colors in the image original will be converted when such designation is made.

It is also another object of the present invention to provide a method which discriminates the combination of the color-separation filter and the developer, indicates this combination, and automatically controls the process steps of the color reproduction apparatus by a signal for such combination, when various color conversions are designated as mentioned above.

It is another object of the present invention to provide an apparatus which selects the abovementioned combination including the least process steps, when there exists a plurality of methods for realizing the conversion of the designated colors.

It is still other object of the present invention to provide a color reproduction apparatus which is so designed that a desired color conversion can be freely performed for each original image color, and reproduction of a particular color can be done by a simple key input operation.

It is an additional object of the present invention to provide a reproduction apparatus which is so designed that a subsequent copy operation instruction (color selection) can be done while a previous copying operation is being done.

BRIEF DESCRIPTION OF THE DRAWINGS

FIGS. 2 and 3 respectively show a color-conversion indicator of the present invention;

FIGS. 5A and 5B in combination show one embodiment of a color-conversion circuit according to the present invention;

FIG. 11 is a content chart of RAM for the color-conversion circuit shown in FIGS. 5A and 5B;

DESCRIPTION OF THE PREFERRED EMBODIMENTS

Figures 1, 4:
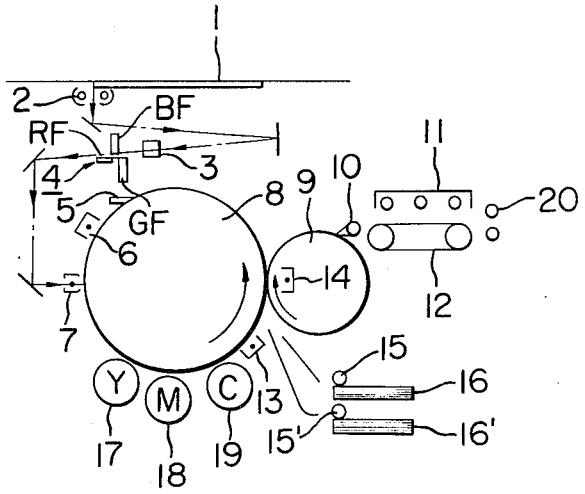
FIG. 1 is a schematic cross-sectional view of a color reproduction apparatus, to which the present invention is applicable.
FIG. 4 is a chart indicating combinations of the color-separation filters and the developing agents according to the present invention.

It has been well known that the color reproduction can be realized by mixing the basic color developers Y, M, and C, whereby red (mixture of Y and M), green (mixture of Y and C), blue (mixture of M and C), and black (mixture of Y, M and C) are obtained, respectively. It has also been known that brightness of color varies depending on quantity of the color concerned, and, when more than two colors are mixed together, the color phase varies depending on the mixing ratio of the respective colors.

In the case of reproduction by the color-reproduction apparatus, the electric potential of the latent image corresponds to brightness of color in the image original, and, when this latent image is developed, the reproduced copy has its brightness corresponding to that of the image original. In the case of the color mixture, the potential corresponds to the mixing ratio of the respective colors, and, when the latent image is developed, the reproduced copy will have a color of the same mixing ratio. Accordingly, when the color conversion is taken into consideration, the color phase alone can be taken into account.

For the sake of simplicity in the description, the following standard color mixture is established to thereby avoid any inconvenience arising from possible mixing ratio of the colors in the color mixture.

(1) Standard red . . . mixture of Y and M in the same quantity (hereinafter simply denoted as R or YM)
(2) Standard green . . . mixture of Y and C in the same quantity (hereinafter simply denoted as G or CM)
(3) Standard blue . . . mixture of C and M in the same quantity (hereinafter simply denoted as V or CM)
(4) Standard black . . . mixture of Y, M, and C (hereinafter simply denoted as Bk or YMC)

The above color mixtures are ideal ones. In reality, however, this cannot always be said to be the color mixture in equal quantity due to spectroscopic reflection characteristic of the developing agent. Even if so, such deviation is a slight shifting of the characteristic to any one side of the color component, so that this color mixture can be safely said to be standard from the practical point of view.

Further, the following color mixture can be contemplated in addition to the above standard colors.

(5) Standard red added with Y (orange color in usual) . . . RY=YYM
(6) Standard red added with M (crimson color in usual) . . . RM=YMM
(7) Standard greed added with Y (yellowish green in usual) . . . GY=YYC
(8) Standard green added with C (deep green in usual) . . . GC=YCC
(9) Standard blue added with C (ultramarine in usual) . . . VC=MCC
(10) Standard blue added with M (reddish purple in usual) . . . VM=MMC The following Table 1 indicates a case, wherein a latent image is formed on the photosensitive layer, when an image original consisting of M, R, Y, C, G, V, and Bk is color-separated by the color-separation filters, and exposed on the photsensitive layer.

TABLE 1

| color of image original | Filter: Blue filter | Filter: Green filter | Filter: Red filter | | |
|---|---|---|---|---|---|
| M | X | O | X | O | latent image can be formed. |
| R(YM) | O | O | X | | |
| Y | O | X | X | X | latent image cannot be formed. |

TABLE 1-continued

| color of image original | Filter Blue filter | Green filter | Red filter |
|---|---|---|---|
| G(YC) | O | X | O |
| C | X | X | O |
| V(CM) | X | O | O |
| Bk(YCM) | O | O | O |

It is understood from the above Table 1 that, when a portion where the latent image is formed is developed with appropriate developers, the color conversion is possible, while a portion where no latent image is formed remains in a "non-colored" state, i.e., no copy can be made.

The following Table 2 shows various examples, in which a single color is converted into another.

TABLE 2

| | Color of image original | Process Step | Color Separation filter | Development | Copy |
|---|---|---|---|---|---|
| Ex. 1 | R | 1 | Blue | Y | YC=G |
| | | 2 | Green | C | |
| Ex. 2 | R | 1 | Blue | C | CY=G |
| | | 2 | Green | Y | |
| Ex. 3 | R | 1 | Blue | Y | YC=G |
| | | 2 | Blue | C | |
| Ex. 4 | R | 1 | Green | Y | YC=G |
| | | 2 | Green | C | |
| Ex. 5 | R | 1 | Blue | M | MC=V |
| | | 2 | Green | C | |
| Ex. 6 | R | 1 | Blue | C | C |
| Ex. 7 | R | 1 | Green | M | MMY= |
| | | 2 | Green | M | MR |
| | | 3 | Blue | Y | |
| Ex. 8 | Bk | 1 | Red | Y | YM=R |
| | | 2 | Green | M | |

In the above Table 2, Examples 1 through 4 indicate the color conversion from R to G. As is apparent from this Table, the color conversion remains same, even when the combination of the color-separation filter and the development color is changed. Example 5 shows the color conversion from R to V; Example 6 from R to C; Example 7 from R to MR; and Example 8 from Bk to R.

The following Table 3 shows a result of study on R–G color conversion to find out how the other colors in the image original change, when a particular color in the image original is converted to another color. Note that X denotes "non-color".

Table 3

First Example of R to G Color Conversion

| | Color of Image Original | M | R | Y | G | C | V | Bk |
|---|---|---|---|---|---|---|---|---|
| Ex. 1 | 1st step Blue Filter-Y development | X | G | YC | YC | X | X | YC |
| | 2nd step Blue Filter-C development | | | =G | =G | | | =G |
| Ex. 2 | 1st step Green Filter-Y development | YC | G | X | X | X | YC | YC |
| | 2nd step Green Filter-C development | =G | | | | | =G | =G |
| Ex. 3 | 1st step Blue Filter-Y development | C | G | Y | Y | X | C | YC |
| | 2nd step Green Filter-C development | | | | | | | =G |
| Ex. 4 | 1st step Blue Filter-C development | Y | G | C | C | X | Y | YC |
| | 2nd step Green Filter-Y development | | | | | | | =G |

The color conversion from R to G attains its purpose with the abovementioned first and second process steps only. When the color-separation and exposure with the red filter, followed by development are carried out as the third step, there is no influence at all to the R–G color conversion. Therefore, if this third step is added, there can be further obtained various combinations of the color conversions as shown in the following Table 4.

TABLE 4

Second Example of R to G Color Conversion

| | 1st step (upper) 2nd step (lower) | 3rd step (development) | M | R | Y | G | C | V | Bk |
|---|---|---|---|---|---|---|---|---|---|
| 1 | Blue Filter-Y | -Y " | | | | YYC | Y | Y | YYC |
| | Blue Filter-C | Red Filter-M " | X | G | G | YCM=Bk | M | M | YCM=Bk |
| | | -C " | | | | YCC | C | C | YCC |
| 2 | Green Filter-Y | -Y " | | | | Y | Y | YYC | YYC |
| | | Red Filter-M " | G | G | X | M | M | YCM=Bk | YMC=Bk |
| | Green Filter-C | -C " | | | | C | C | YCC | YCC |
| 3 | Blue Filter-Y | -Y " | | | | YY=Y | Y | CY=G | YYC |
| | | Red Filter-M " | C | G | Y | YM=R | M | CM=V | YCM=Bk |
| | Green Filter-C | -C " | | | | YC=G | C | CC=C | YCC |
| 4 | Blue Filter-C | -Y " | | | | YC=G | Y | YY=Y | YYC |
| | | Red Filter-M " | Y | G | C | MC=V | M | YM=R | YCM=Bk |
| | Green Filter-Y | -C " | | | | CC=C | C | YC=G | YCC |

From the above-described examples, the following conclusion can be made.

(1) Combination of the color-separation filter and the development color to convent a color A in the image original into a color B is not limited to one kind; hence the operator is free to select any appropriate one from such various combinations, when the A to B color conversion alone is designated.

(2) When the A to B color conversion in the image original is made the first designation, there exists a limitation for the remaining colors in the image original to be changed to other colors, although the second designation can be made within this limit.

(3) Determination of the combination between the color-separation filter and the development color automatically determines to what color the remaining colors in the image original will be converted.

(4) By the selection of the color-separation filter, a certain color in the image original can be decolored.

From the above-described standpoint, the present invention constructs the indication means for the color conversion as shown in FIG. 2.

(A) Three kinds of buttons, i.e., image original color designation buttons (selection buttons for colors M, R, Y, G, C, V, and Bk), conversion color designation buttons (selection buttons for colors M, MMY, R, MYY, Y, G, YCC, C, V, CMM, and Bk), and a "NON" button which signifies decoloration, and no coloring, are incorporated in a matrix form, and, at each intersection of these buttons, there are disposed indicating device such as light emitting diode (LED).

(B) When any one of the corresponding designation buttons for the original image color and any one of the corresonding designation buttons for the color conversion are depressed so as to convert one particular color in the image original into another color, the indicating device at the intersection of these designation buttons is turned on, and all convertible colors in the image original other than that designated are indicated. In this case, when the decoloration is also designated, the portion of the "NON" is also turned on. FIGS. 2 and 3 show examples of display on the indicator device. For example, when the R to G color conversion is first designated, $R_7$ in FIG. 2 is displayed, and, at the same time, there are indicated all those colors, to which the other colors than red in the image original can be converted by the combinations of the various color-separation filters and the development colors, which enables the R to G color conversion, e.g., [M→G, C, Y, X,] [Y→G, X, Y, C,] [G→G, X, Y, C, YYC, Bk, YCC, M, R, V,] [C→X, Y, M, C,] [V→X, G, C, Y, M, YCC, Bk, YYC, V, R,] [Bk→G, YYC, Bk, YCC].

(C) When the first color conversion designation (a state of (B)) is made, and then the second color conversion is designated within a range of the color conversion displayed on the indicator device, a single indication is turned on at each of the first and second designations, and the portions of the original image colors other than that designated indicate all the convertible colors by the combination of the color-separation filters and the development colors which satisfy the first and second color conversions. For example, when R to G color conversion is designated as the first color conversion and G to Y color conversion is designated as the second color conversion, there appears the indications as shown in FIG. 2 by the R to G color conversion designation, and then, when G to Y designation is made, only the indication of $G_5$ as in FIG. 4 remains, whereby the indications of the remaining $G_1$ to $G_{14}$ (FIG. 3) are extinguished, and the following indications appear at the portions of the colors other than that designated: [M→C, G,] [Y→Y, X,] [C→X, Y,] [V→C, YYC, G,] [Bk→G, YYC].

Figures 4, 8, 8B:
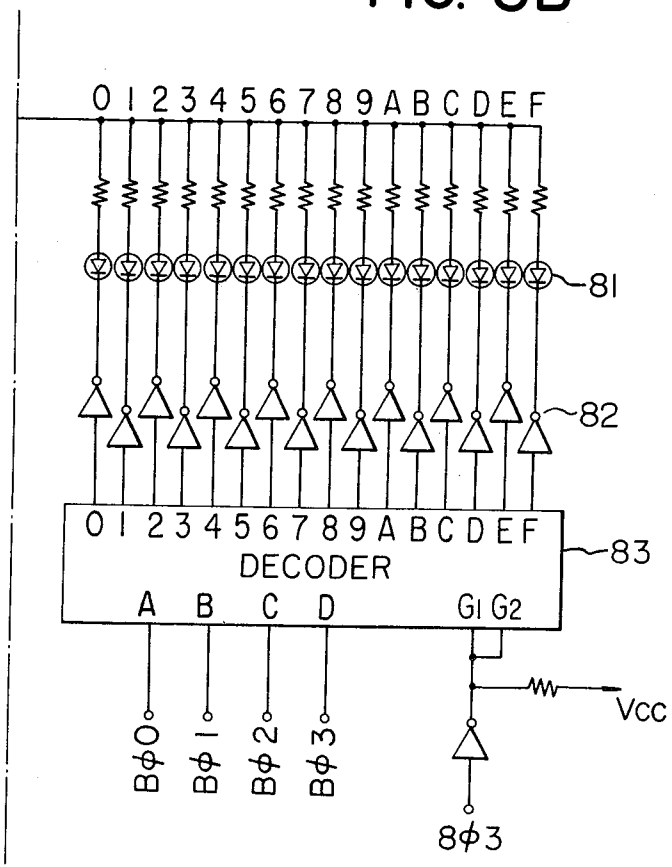
FIG. 8 is one example of the indication circuit for the combination indicating chart in FIG. 4.

(D) When the color conversion designation is carried out sequentially in the same manner as mentioned so far, and one indication is ultimately made for each "line" (each of the original colors), the color conversion designation terminates. At this juncture, by indicating the combination of the color-separation filter and the development color, or by a signal of such combination, the process step of the reproduction apparatus is automatically controlled. FIGS. 4 and 8 illustrate the indicators for the combination of the color-separation filter and the developing device. These indicators sequentially show, from its left, the first step, the second step, and the third step, and each of them is constructed in a matrix form with 16 pieces of light emitting diodes.

(E) When an instruction for the designation termination is given for each color-conversion designation, an appropriate set is selected from various combinations of the color-separation filters and the development colors which satisfy the color conversion designation, and is indicated on the indicator device, and, by the signal of the combination, the process step of the reproduction apparatus is automatically controlled. This function is very convenient when the image original consists of one or two kinds, or when only one color may be converted.

With the color reproduction apparatus of the above-described construction, the user of the machine can quickly recognize, after the indication and control for the color conversion, to what color the other colors in the image original can be converted, and, at the same time, can easily perform the second, third, and subsequent color conversion and designation. Also, when a desired color alone is desired to be converted, an instruction for the designation termination is imparted after the color-conversion designation, whereby loss in the selection can be eliminated, hence the apparatus is highly convenient in use and provides excellent utility.

It should be noted, in this connection, that the "NON" button is not always required to be provided in the color-conversion designation buttons (in such cases, this can be expressed by non-indication of the "line" on the indicator device). A particular significance to provide this button is as follows. When "NON" is designated, the color of the image original is copied in a state of its being non-colored. In other words, since the portion usually remains white, it can be painted separately. For example, when the R to G color conversion is first designated, C can only be converted into Y, M, and C alone, although there may be a case, in which it is desired to be converted into R or G. In such case, a designation of C to "NON" is made so that the portion of C may be copied in its state of "non-colored", after which this portion will be painted later in a desired color. This will provide a wider range of utility in fields such as graphic design, and is considered most useful.

Further, as shown in Tables 3 and 4, the examples of the present invention indicate both cases where the three process steps and two process steps are required for the designated color conversion. In addition, there is also such an instance where the color conversion can be realized in a single process step in a certain type of color conversion designation. In such a case, control is rendered so that the reproduction process may be done by selecting a combination requiring the least process steps.

The foregoing explanations have been made with respect to the color conversion utilizing the electrophotographic method. In the color printing field, too, this color conversion apparatus is very useful, since the color can be formed by the color reduction method.

In the following, more concrete explanations will be given as to the control circuit for realizing the above-described display or indication.

Figure 6A:
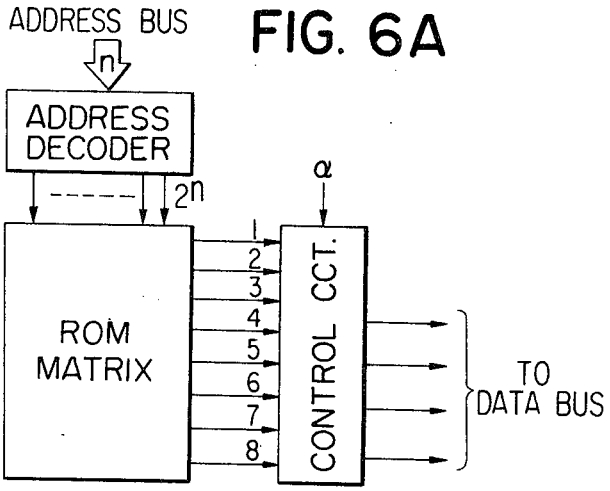
FIGS. 6A to 6D respectively show input-output circuits used in the circuit shown in FIGS. 5A and 5B.
Figure 6B:
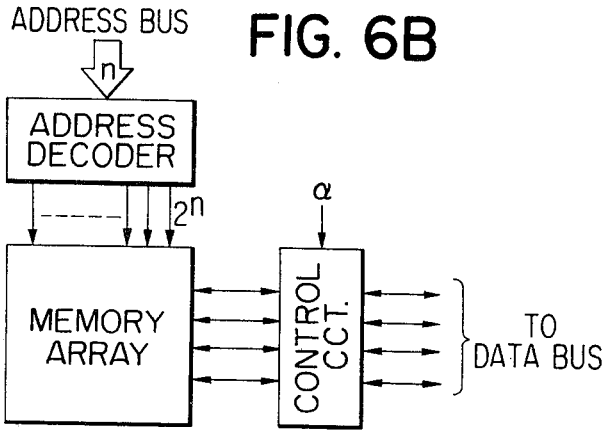
Figure 6C:
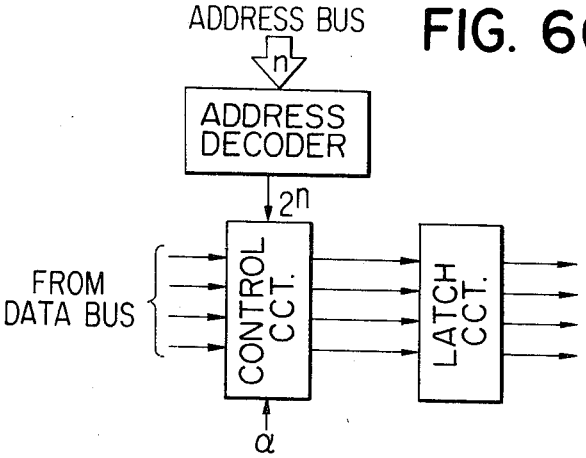
Figure 6D:
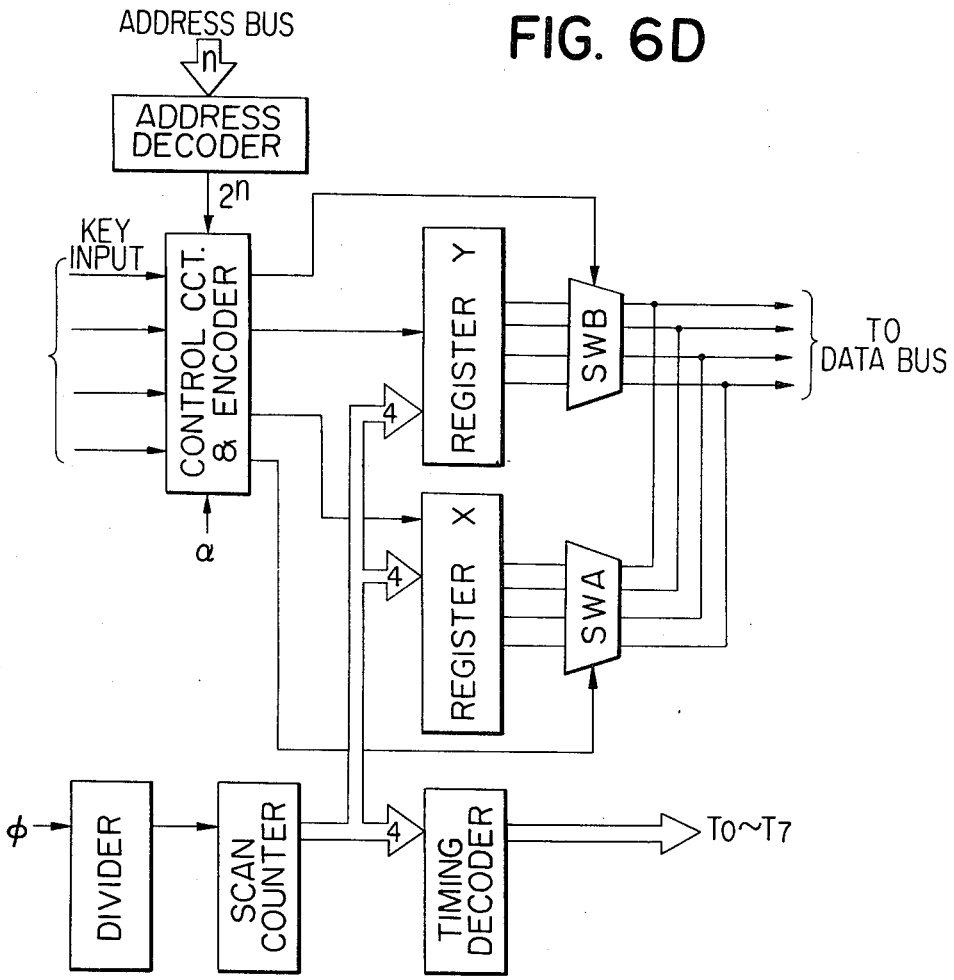
Figure 10:
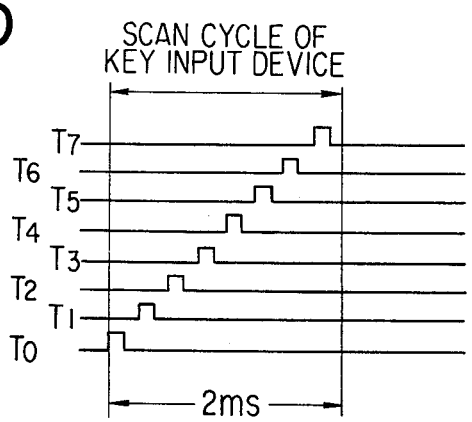
FIG. 10 is a time chart for the key input circuit in FIG. 9.
Figures 9, 9B:
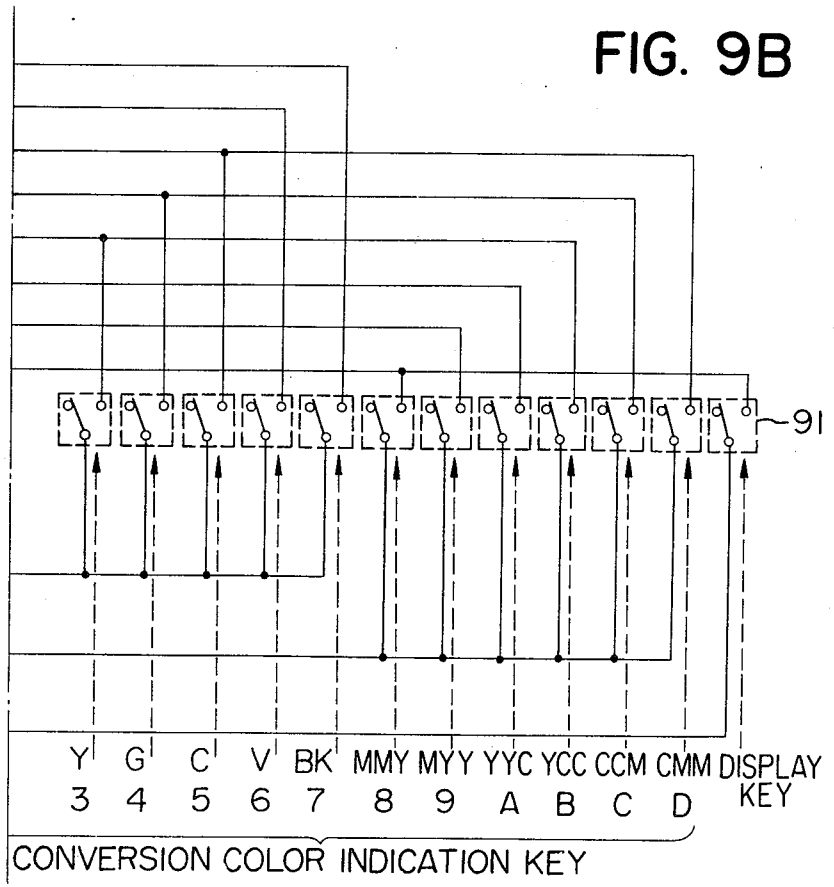
FIG. 9 is one example of a key input circuit.
Figure 9A:
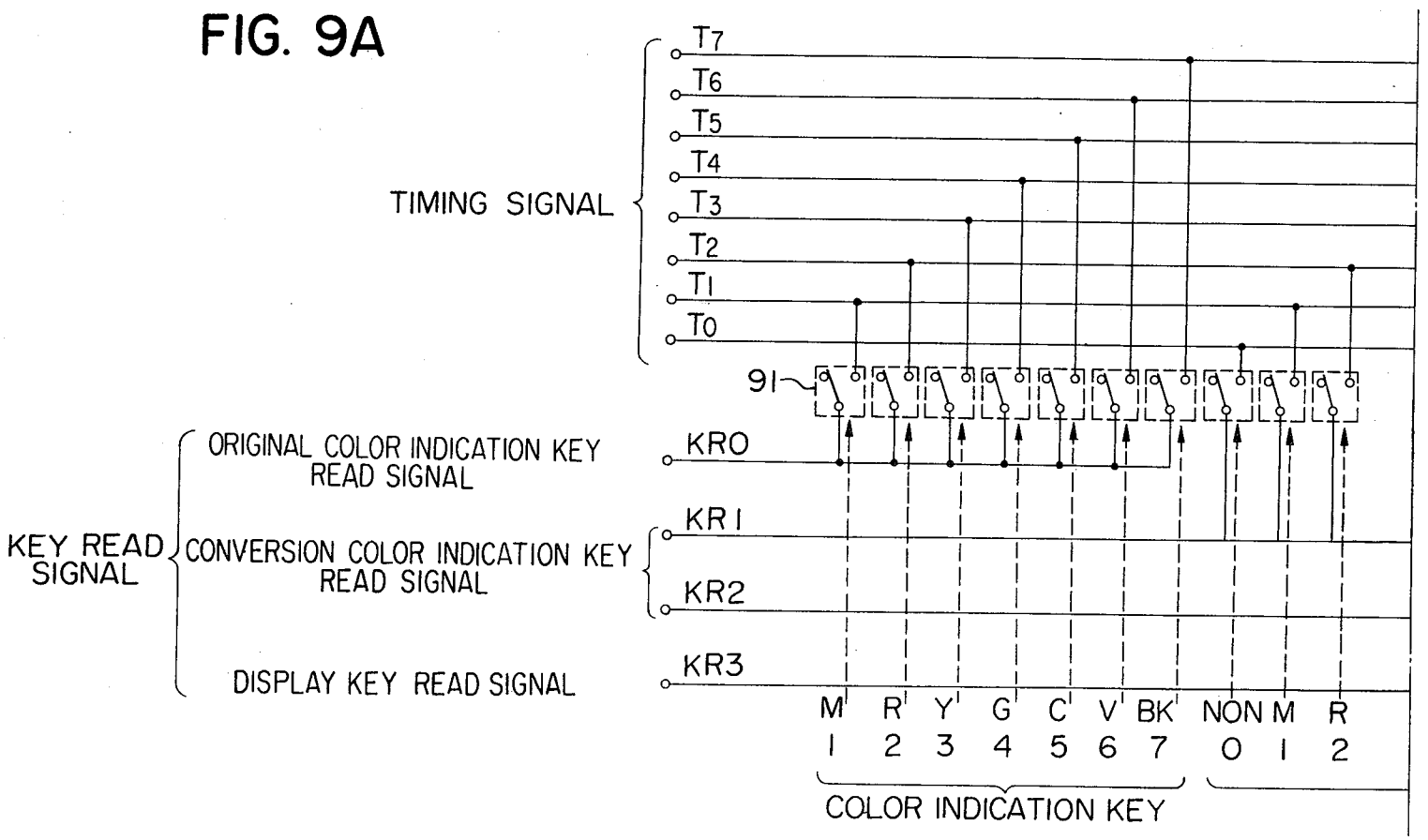

FIGS. 5A and 5B show one embodiment of the indication circuit utilizing a micro-computer for 4-bit parallel processing. In the drawing, the portion enclosed by a dotted line is a known CPU (μ-COM 4 made by Nippon Electric Co.). ROM-1 designates an exclusive read-out memory which stores therein programs for executing the processes from the key input to the selection indication. ROM-2 -refers to another exclusive read-out memory which stores therein combinations of the original colors and conversion colors as well as combinations of the developing devices and the filters corresponding to the color combinations, and details of which are shown in FIG. 6A. RAM designates a write-in and read-out memory which temporarily stores therein the key input data and the ROM-2 data during execution of the abovementioned programs, the details of which are shown in FIG. 6B. The output circuits 1 to 6 are for operating the color indicator shown in FIGS. 2 and 3, the indication circuit for which is shown in detail in FIG. 7. An address table in RAM is shown in FIG. 11. Input-output devices I/09 to I/0B are for operating the indicators for the combinations of the developing devices and the filters, the circuit for which is shown in detail in FIG. 8. Input-output devices I/03 to I/0B are shown in detail in FIG. 6C. The input-output device I/01 for the key input receives thereinto key inputs in FIGS. 2 and 3, the details of which are shown in FIG. 6D. In FIG. 6D, both key input signal line and input timing signal line are connected to a key switch 91 as shown in FIG. 9, and the timing signals $T_0$ to $T_7$ are given time sequential pulses as shown in FIG. 10. A reference letter $\phi$ in FIG. 6D designates a clock pulse to cause CPU to run. This clock pulse is also introduced as an input into ROM, RAM, the input-output device I/O, etc.. Registers X and Y are for temporarily storing therein the key input data. In FIGS. 5A–5B, 6A to 6D, 7, and 8, reference letters SW designates a gate which is controlled for its opening and closing by a control signal $\alpha$, etc. from CPU. For ROM-2, any known programmable memory (P-ROM) may be used. Numerals 71 and 81 refers to light emitting diodes, 72 and 82 refers to inverters, 73 denotes a Darlington amplifier, 83 a decoder, and Vcc a power source of +5V.

Explaining briefly the operations of the above-described circuit, an address of ROM-1, in which the process steps have been programmed from CPU, is first designated; the contents of the designated address are read into CPU through the data signal line DB; CPU decodes the read-in contents; and, in accordance with the decoded contents, there are carried out various processing operations in the time sequential manner starting from closure of the power source such that ROM-2 data are processed within CPU in a certain occasion, or ROM-2 data in CPU are stored in a certain designated address of RAM in another occasion, or data of a certain designated address of RAM is introduced as an input into CPU in another occasion, or data within CPU are forwarded to the output signal line DB of the input-output section as an output in still another occasion, or the key input content on the input signal line DB of the input-output section is introduced as an input into CPU, thereby carrying out the color-conversion processing. Details of the operations in this CPU and the instruction vocabulary in ROM-1, and so on are specifically mentioned in technical paper, "μ-COM 4 SYSTEM ABSTRACT", a copy of which is attached to this specification.

Figures 12, 12A, 12B, 12C, 12D, 12E, 12F:
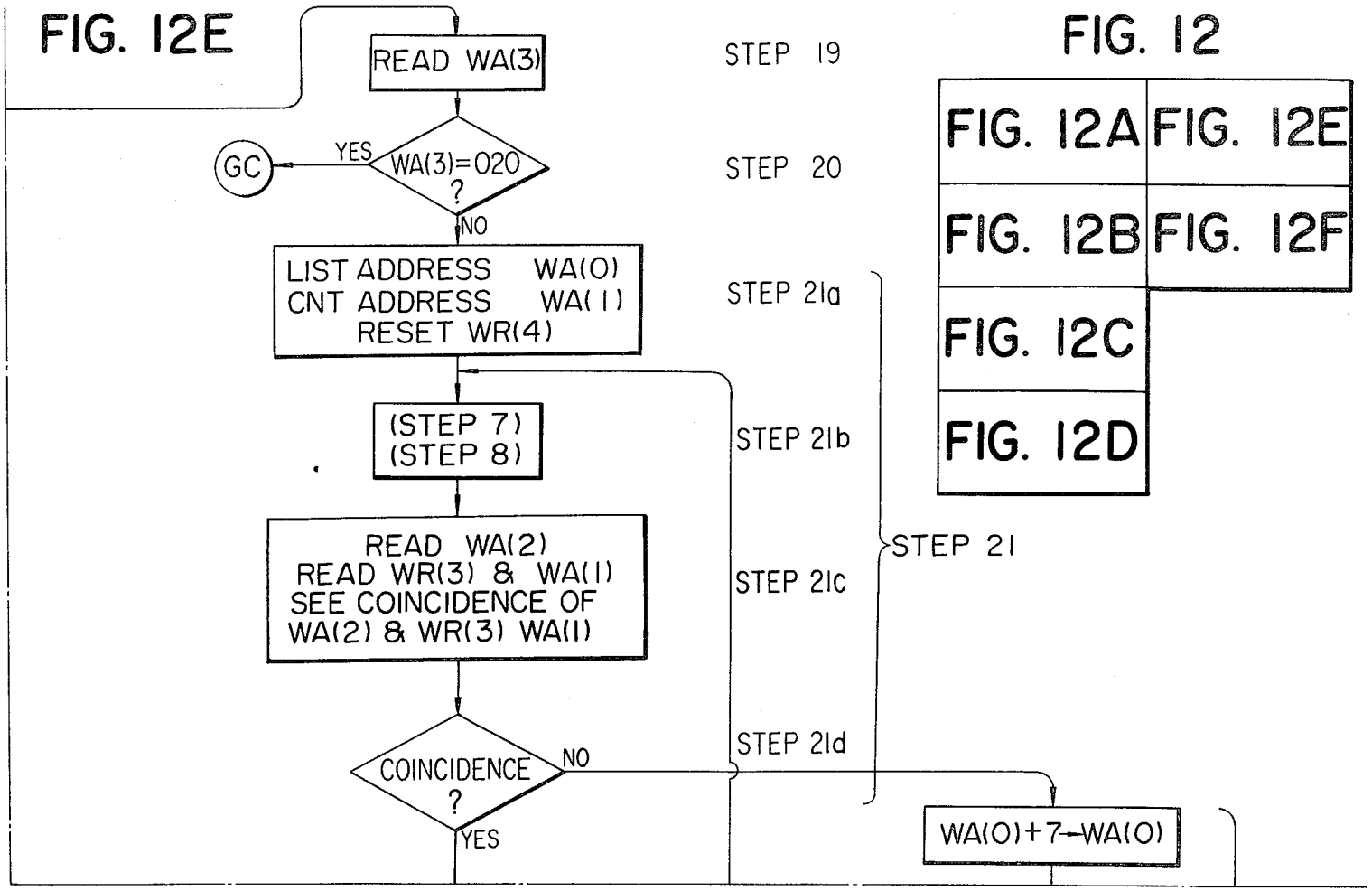
FIG. 12 is a general flow-chart for the color-conversion control in the color-conversion circuits shown in FIGS. 5A and 5B.
Figure 12A:
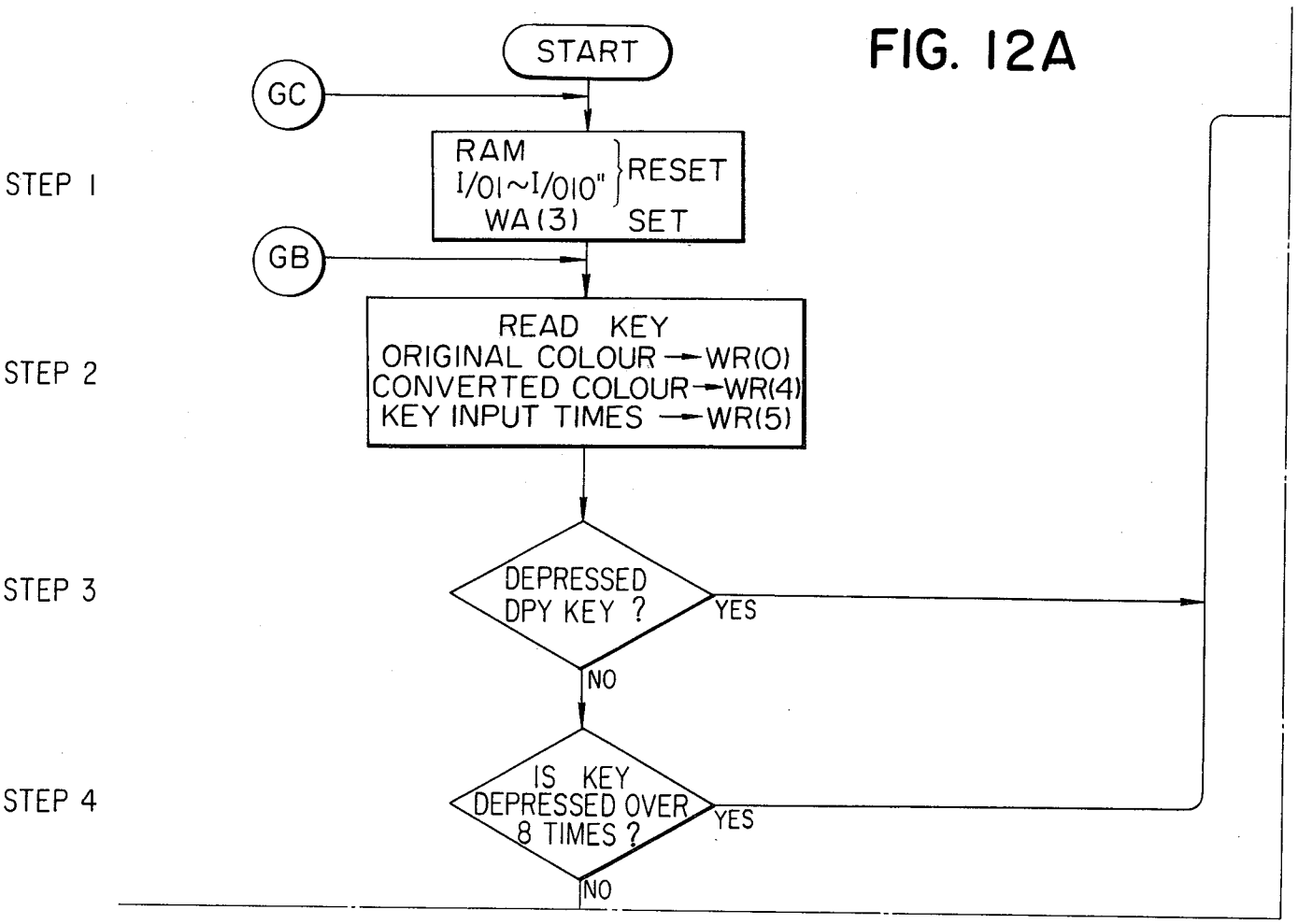
Figure 12B:
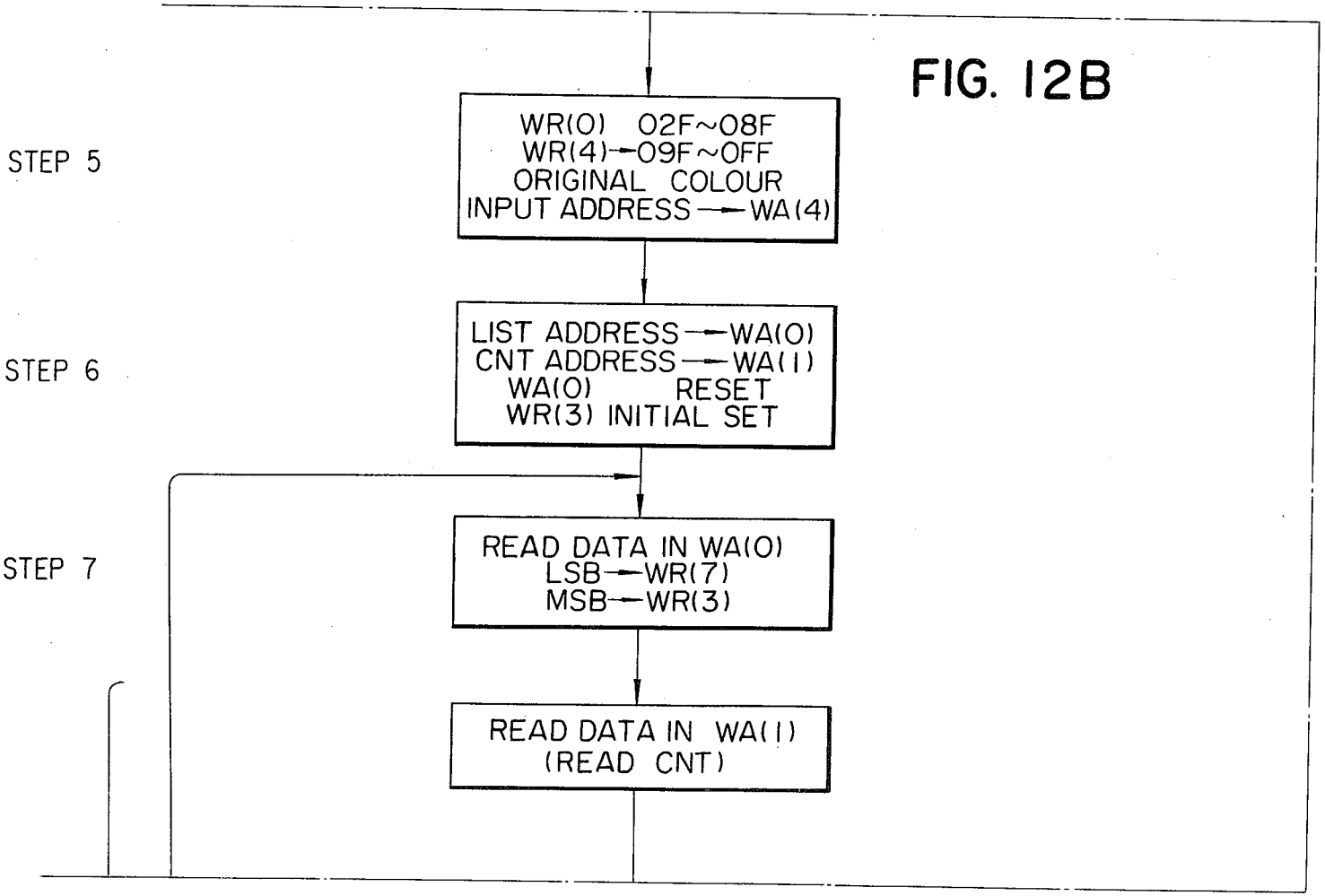
Figure 12C:
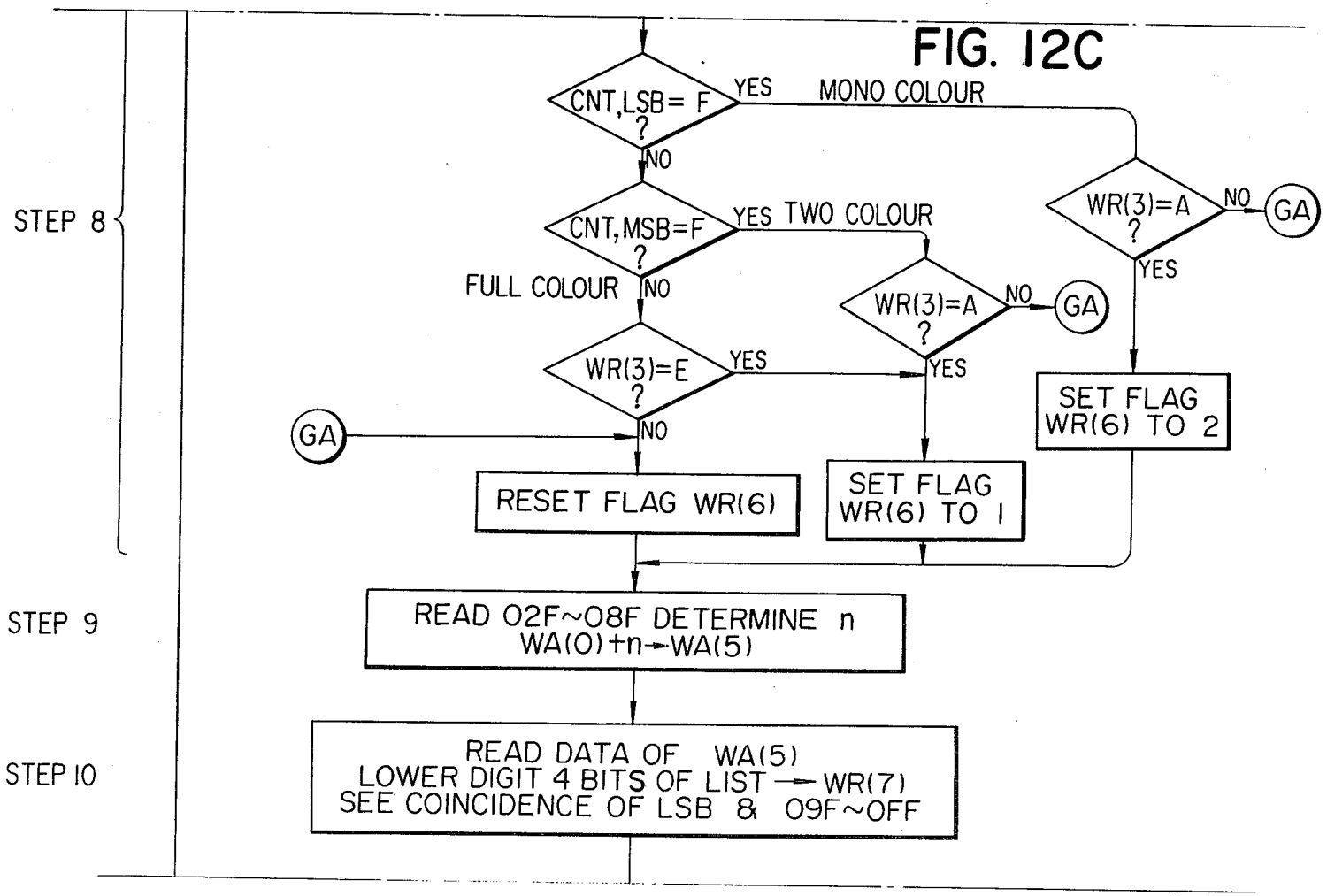
Figure 12D:
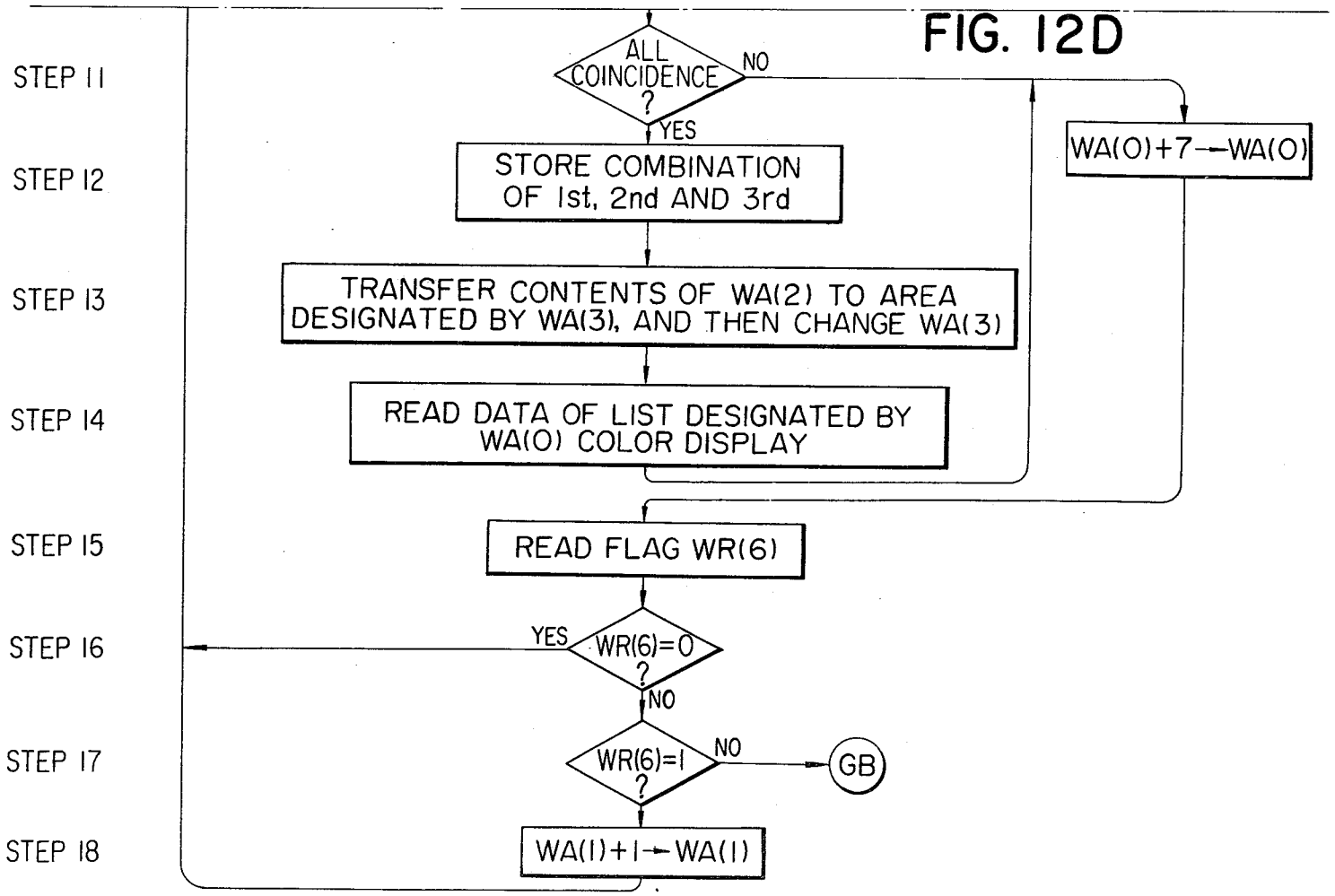
Figure 12F:
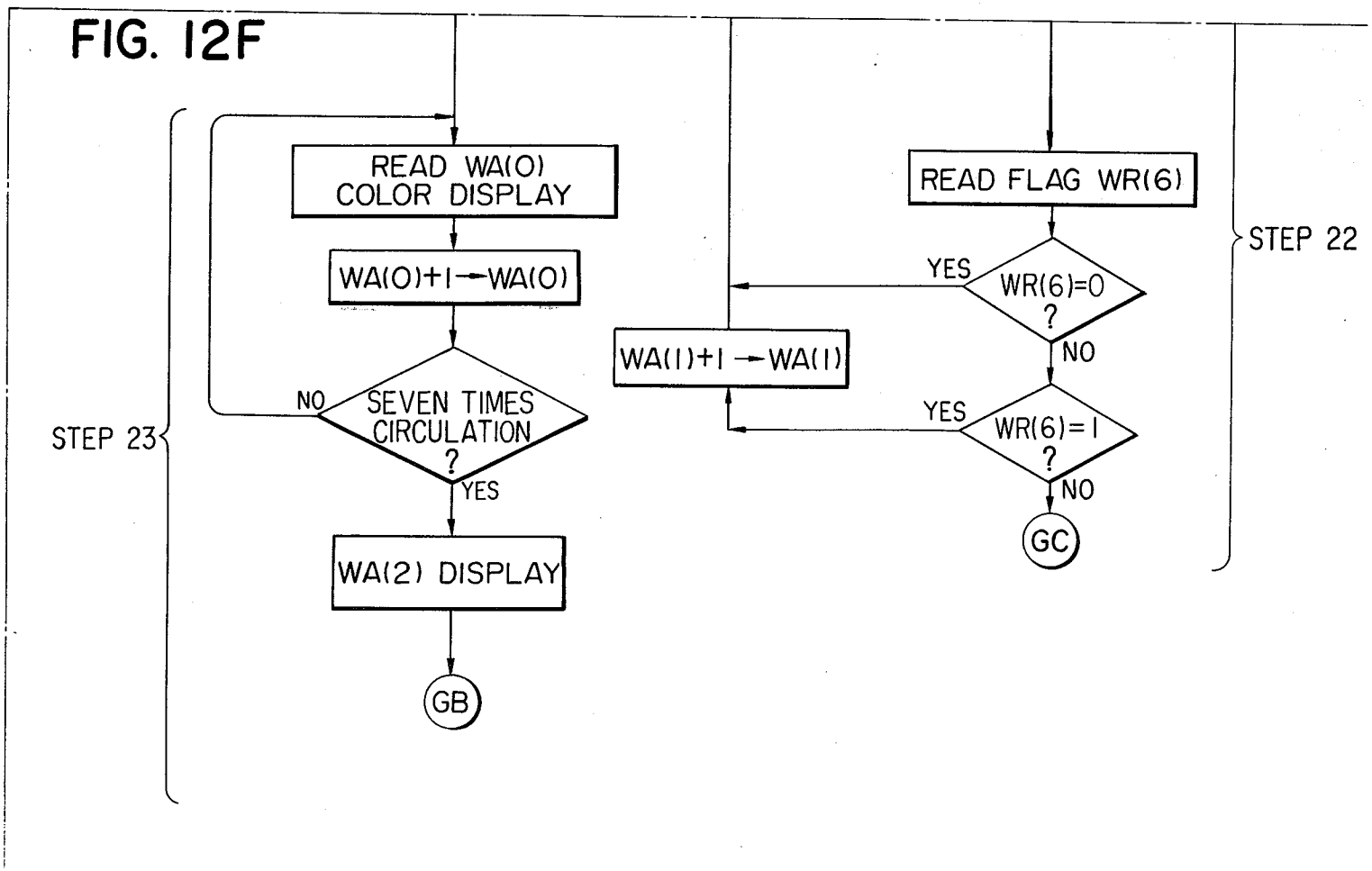

In ROM-1, there are stored in the form of codes the programs of the flow chart in FIG. 12 for the key read-in and indication, the codes for which comply with the program flow charts in FIGS. 13 through 22. ROM-2 stores therein the entire combinations of the filters and the developing agents shown in FIG. 4 in the form of 4-bit binary codes, and moreover three kinds of combinations (for three process steps) selected from sixteen kinds of O–F. It stores further the codified results of the color conversion to be obtained when these combinations are executed. Tabulating this, it may be as shown in Table 5 below. A starting address is represented as X'600' (X' denotes sexadecimalism). The color of the image original and the color for the color conversion are codified as shown in Table 6 below.

Table 5

| | LIST | | | | | CNT | | | |
|---|---|---|---|---|---|---|---|---|---|
| | | | code for storage | | | | | code for storage | |
| | address | original color | upper (hexa-decimal) 3rd D/F | lower (hexa-decimal) color conversion | | address | | upper (hexa-decimal) 1st D/F | lower (hexa-decimal) 2nd D/F |
| | X'600' | (M) | 0 | 3 | | | X'FC9' | 0 | 0 |
| | X'601' | (R) | 0 | 3 | | | X'FCA' | 0 | 1 |
| | X'602' | (Y) | 0 | 3 | | | X'FCB' | 0 | 2 |
| | X'603' | (G) | 0 | 3 | scan 1 | | X'FCC' | 0 | 4 |
| | X'604' | (C) | 0 | 0 | | | X'FCD' | 0 | 5 |
| X'FC9' | X'605' | (V) | 0 | 3 | | | X'FCE' | 0 | 6 |
| address | X'606' | (BK) | 0 | 3 | | | . | . | . |
| used for | | | | | | | . | . | . |
| CNT | X'607' | (M) | 1 | 3 | | | . | . | . |
| | X'608' | (R) | 1 | 9 | | | . | . | . |
| | X'609' | (Y) | 1 | 9 | | | . | . | . |
| | X'60A' | (G) | 1 | 9 | scan 2 | Full Color | . | . | |
| | X'60B' | (C) | 1 | 0 | | | . | . | . |
| | X'60C' | (V) | 1 | 3 | | | . | . | . |
| | X'60D' | (BK) | 1 | 9 | | | . | . | . |
| | X'60E' | (M) | 2 | 3 | | | . | . | . |
| | . | | . | . | | | . | . | . |
| | . | 7 step | . | . | scan 3 | | . | . | . |
| | . | | . | . | | | . | . | . |
| | . | | . | . | | | . | . | . |
| | . | | . | . | | | . | . | . |
| | . | | . | . | scan 4 | | . | . | . |
| | . | | . | . | | | . | . | . |
| | . | | . | . | | | . | . | . |
| | X'652' | (V) | E | 4 | | | . | . | . |
| | | | | | scan $X_1$ | | | | |
| | X'653' | (BK) | E | A | | | . | . | . |
| X'FCA' | X'654' | (M) | 1 | 8 | | | X'FF5' | A | A |
| address | . | | . | . | | | | | |

Table 5-continued

| | LIST | | | | | CNT | | | |
|---|---|---|---|---|---|---|---|---|---|
| | | | code for storage | | | | | code for storage | |
| | address | original color | upper (hexa-decimal) 3rd D/F | lower (hexa-decimal) color conversion | | address | | upper (hexa-decimal) 1st D/F | lower (hexa-decimal) 2nd D/F |
| used | . | | . | . | scan n-1 | | X'FF6' | F | 0 |
| | . | | . | . | | | X'FF7' | F | 1 |
| | . | | . | . | | | | | |
| | X'F98' | (BK) | 9 | 1 | | | X'FF8' | F | 2 |
| | X'F99' | (M) | A | 0 | scan n | | X'FF9' | F | 4 |
| | X'F9A' | (R) | A | 0 | | Two Colors | X'FFA' | F | 5 |
| | X'F9B' | (Y) | A | 0 | | | X'FFB' | F | 6 |
| X'FFF' | X'F9C' | (G) | A | 5 | | | X'FFC' | F | 8 |
| address | X'F9D' | (C) | A | 5 | | | X'FFD' | F | 9 |
| used for | X'F9E' | (V) | A | 5 | | | X'FFE' | F | A |
| CNT | X'F9F' | (BK) | A | 5 | | | X'FFF' Mono Color | F | F |

Table 6

| ORIGINAL COLOR | X" INDICATION | BINARY INDICATION | COLOR CONVERSION | X" INDICATION | BINARY INDICATION |
|---|---|---|---|---|---|
| M | 1 | 0001 | M | 1 | 0001 |
| R | 2 | 0010 | R | 2 | 0010 |
| Y | 3 | 0011 | Y | 3 | 0011 |
| G | 4 | 0100 | G | 4 | 0100 |
| C | 5 | 0101 | C | 5 | 0101 |
| V | 6 | 0110 | V | 6 | 0110 |
| Bk | 7 | 0111 | Bk | 7 | 0111 |
| | | | MMY | 8 | 1000 |
| | | | MYY | 9 | 1001 |
| | | | YYC | A | 1010 |
| | | | YCC | B | 1011 |
| | | | CCM | C | 1100 |
| | | | CMM | D | 1101 |
| | | | NON | O | 0000 |

In the following, explanations will be made for the codes listed in Table 5, and which is stored in X'600 to X'FFF' of ROM-2.

The upper 4-bit of the data in the "LIST" address denotes the third D/F out of the three process steps for the color conversion. D/F means a combination of the developing device and the filter, which will hereinafter be expressed as "D/F"). The first and second D/F's are stored in CNT. In other words, D/F = '0' in the address X'600' means that the image is color-separated through the blue filter and developed in yellow.

The lower 4-bit of the data in the "LIST" address denotes the color as converted with respect to the original image color. The original image color is determined by the "LIST" address. For example, the conversion color with respect to the original image color M is stored in the lower 4-bit of the addresses at every 7 count-up from the address X'600', i.e., X'600', X'607', X'60D', and so on. In the same manner, the conversion color with respect to the original image color R is stored in the address at every 7 count-up from the address X'601'. The same principle applies to other original image colors. That is to say, the data stored in the "LIST" address indicate to what color the original image colors will be converted when the color conversion is carried out by the first and second D/F's designated by CNT and the third D/F designated by the upper 4-bit in the "LIST" data. The upper 4-bit of the data in the address of CNT indicates the first D/F, and the lower 4-bit the second D/F. For instance, the upper '0' in the address X'FC9' signifies that the original image is color-separated through the blue filter and developed in yellow. The same thing can be said of the lower '0'.

Also, the upper 4-bit is represented by 'F' in the addresses X'FF6' to X'FFE' of CNT. It should be noted that, according to the present embodiments, no black developer is used at the time the color conversion. That is, when D/F in FIG. 4 is represented by '3', '7', 'B', and 'F', they are not used for the color conversion. In this case, 'F' in the data of the CNT denotes "no processing step", i.e., the data within the addresses X'FF6' to X'FFE' represent the two-step reproduction process. In the same manner, since the data in the address X'FFF' of CNT are represented by 'F' in both upper and lower bits, this denotes the single reproduction process. Also, the address of CNT converts from X'FC9' to X'FCA' by adding +1 to the address at the scan $X_1$. That is, the address of "LIST" are sequentially changed to become the scan $X_1$ at a certain address, at which it changes from X'FC9' to X'FCA', and the data '0', '0' are converted to '0', '1'. Thus, CNT adds +1 to the addresses up to X'FFF' in correspondence to the "LIST" addresses. In other words, the address of CNT corresponding to a certain address in the "LIST" is single.

The addition of +1 to the address of CNT takes place in the following occasion. When the reproduction apparatus performs the three-step process, i.e., in case of X'FC9' to X'FR5' in the address of CNT, the addition is performed after the upper 4-bit of the "LIST" address becomes 'E' by the sexadecimal number. Also, when the reproduction apparatus performs the two-step process, i.e., in the case of X'FF6' to X'FFE' in the address of CNT, the addition is performed after the upper 4-bit of the "LIST" address becomes 'A'. Further, when the reproduction apparatus performs the single process step, i.e., in the case of X'FFF' in the address of CNT, the addition is performed after the upper 4-bit in the "LIST" addresses becomes 'A'. When CNT is scanned upto the address X'FFF' and the upper 4-bit in the "LIST" address becomes 'A', all the scanning operations of the color conversion designation for one time is completed. This discrimination is done at the "STEP 8" in the general flow chart in FIG. 12, the details of which will be described later.

The addresses in the "LIST" comprises seven steps for each scan such as denoted by scan 1, scan 2, . . . , scan n. Each step contains in the lower 4-bit the respective converted color such as the first step contains the original image color M, the second step the original image color R, the third step the original image color Y, the fourth step the original image color G, the fifth step the original image color C, the sixth step the original image color V, and the seventh step the original image color Bk. That is, the content of the upper 4-bit in 1 scan is the same with, only the conversion color being different. Accordingly, when any one of the original image colors is designated, the conversion color to the abovementioned original image color can be made known by checking the "LIST" address at every seven step.

In the following, the procedures for combination, selection, and indication of the first, second, and third D/F's as well as indication of the conversion color to the original image color will be explained in reference to the general flow chart in FIG. 12 based on the program flow charts in FIGS. 13 to 22 and the circuit diagrams in FIGS. 5, 6, 7, and 9.

STEP 1

After turning-on of the circuit power source switch, input-output devices I/01 to I/0B and RAM are reset, since inputs and outputs of I/01 to I/0B and the data into RAM are not known. At the same time, initial data are set in WA13 of RAM. The function of WA(3) will be described later.

STEP 2

Any one of the key switches 91 shown in FIG. 9 is depressed to designate a desired original image color, whereby a signal enters into any one of the lines $KR_0$ to $KR_3$ of the key input circuiit 10 by the timing signals $T_0$ to $T_7$. This input signal enters into the encoder of the key input device shown in FIG. 6D, and is codified to be stored in the registers X and Y. The contents of the registers X and Y are transferred time-sequentially to the register A of CPU by the program execution of ROM-1. Then, the content of this register A is converted to the code of the original image color (TABLE 6) and stored in the area of WR(0) (the address X'000') in the address distribution chart of RAM as shown in FIG. 11. In the same manner, a desired conversion color designation key is read so as to store the same in WR(4) of RAM(address X'010'). Further, this step does not terminate unless the designations of both original image color and the conversion color have yet to be completed, but waits for the key which has not yet been input. When both designations are made, the number of times of the key reading is stored in WR(5) (the address X'014') of RAM with the number of times of the key input as being one. Incidentally, there is provided an indication instructing key DPY to indicate the combinations of the first, second and third D/F's to enable the key designation, and to indicate to what color the original image colors other than that designated will be converted. By the depression of this key, there are performed sequence operations to indicate combinations of the first, second, and third D/F's which enable the designated conversion color from the designated original, and to indicate colors to which the original image colors other than that designated will be converted. This will be described in further detail later.

STEP 3

Determination is made as to whether the key which has been read in at the abovementioned Step 2 is the DPY key, or not. If it is the DPY key, the operation is proceeded to the Step 19 to carry out the indication sequence to be described later, and the result thereof is indicated.

STEP 4

When the key inputs exceed eight times, the operation is proceeded to the Step 19 where the indication sequence is performed with respect to the designation up to the previous key input, i.e., the seventh time. This Step 4 is provided, because the original image color in the present embodiment is for the 7-color designation, and one original image color cannot be designated into conversion colors of more than two kinds. In the present embodiment, it is also possible to construct the apparatus is that, after proceeding to the Step 19, the operations are returned to the Step 1, and the designation may be resumed from the first.

STEP 5

The original image color designated at the Step 2 (stored in WR(O)) is sequentially transferred and stored in the 08F address from the address 02F of RAM shown in FIG. 11 at every time the key input is performed. Also, by causing the conversion color to correspond to each designated original color, it is stored in the address X'OFF' from the address X'09F' of RAM. At the same time, the address in RAM, where the data of the subsequent original image color is stored, is stored in WA(4) (the addresses X'011' to the addresses X'013') of RAM.

STEP 6

In order to scan the abovementioned "LIST" and "CNT" in ROM-2, the initial values of the address "LIST" and the address "CNT" are established. The initial value of the "LIST" address is stored in WA(0) and the initial value of the "CNT" address is stored in WA(1). In the present embodiment, the initial value of the address "LIST" is '600', while the initial value of the address "CNT" is 'FC9'. At the same time, WA(0) where the original image color has been stored at the Step 2 is reset. Thereafter, the initial value of WA(3) at the first step is further set.

STEP 7

The upper 4-bit and the lower 4-bit of the "LIST" data stored in the address of ROM-2 which was initially established at the Step 6 and designated by WA(0) changed at the Step 11 are read out. The upper 4-bit (MSB) as read out is temporarily stored in the area of WR3 (the address X'01C') of RAM, and the lower 4-bit (LSB) as read out in the area of WR7 (the address X'02C').

STEP 8

As stated in the foregoing, CNT and LIST have a certain correspondence between them. That is, since the address of CNT should have been determined by the address of LIST, a flag WR(6) (the address X'018') is set at this stage so as to perform judgement to determine the CNT address at the Step 15.

(1) The data of CNT in the address thereof to be designated by WA(1) is read first.

(2) Next, determination is made as to whether LSB of CNT is F, or not. The case, wherein the LSB of CNT is represented by F, is limited to a case where the CNT address is X'FFF', i.e., a case of mono-color. In this case, since the upper 4-bit at the end of the LIST is expressed in A, a determination is made as to whether the upper 4-bit of the LIST (already stored in WR(3)) is represented by A, or not. In the case of WR(3)=A, the flag WR(6) is set in "2". When WR(3)≠A, the flag WR(6) is reset into "0".

(3) In the case of LSB≠F in CNT, a determination is made as to whether MSB=F in CNT, or not. The case, wherein MSB≠F and MSB=F in CNT, is limited to a case where the CNT address is X'FF6' to X'FFE', i.e., two colors. In the case of the two-color mode, the upper 4-bit at the end of the LIST is represented by A. Then, determination is made as to whether the upper 4-bit of the LIST (WR(3)) is represented by A, or not. When WR(3)=A, the flag WR(6) is set in "1". When WR(3)≠A, the flag WR(6) is reset in "0".

(4) In the case of MSB≠F in CNT, the address CNT is represented by X'FC9' to X'FF5', i.e., blue color. In the case of blue color, the upper 4-bit at the end of the LIST is represented by E. Next, a determination is made as to whether the upper 4-bit (WR(3)) of the LIST is E, or not. If WR(3) =E, the flag WR(6) is set in "1". If WR(3)≠E, the flag WR(6) is reset in "0". WR(6)=0 indicates that the scanning has not yet been completed on one CNT. WR(6)=1 indicates that the scanning has been completed for one CNT. WR(6)=2 indicates that the scanning has been completed for all CNT.

STEP 9

The address of LIST is determined by the number of colors in the designated original image colors. More concretely, a value resulting from the addition of a few numbers n (0, 1, 2, 3, 4, 5, 6) to the LIST address of WA(0) is stored in WA(5) of the subroutine ORG shown in FIG. 19. When n=0, this indicates that the designated color of the original is M; when n=1, it is R; when n=2, it is Y; when n=3, it is G; when n=4, it is C, when n=5, it is V; and when n=6, it is Bk, respectively.

STEPS !0 & 11

Figures 19, 19B:
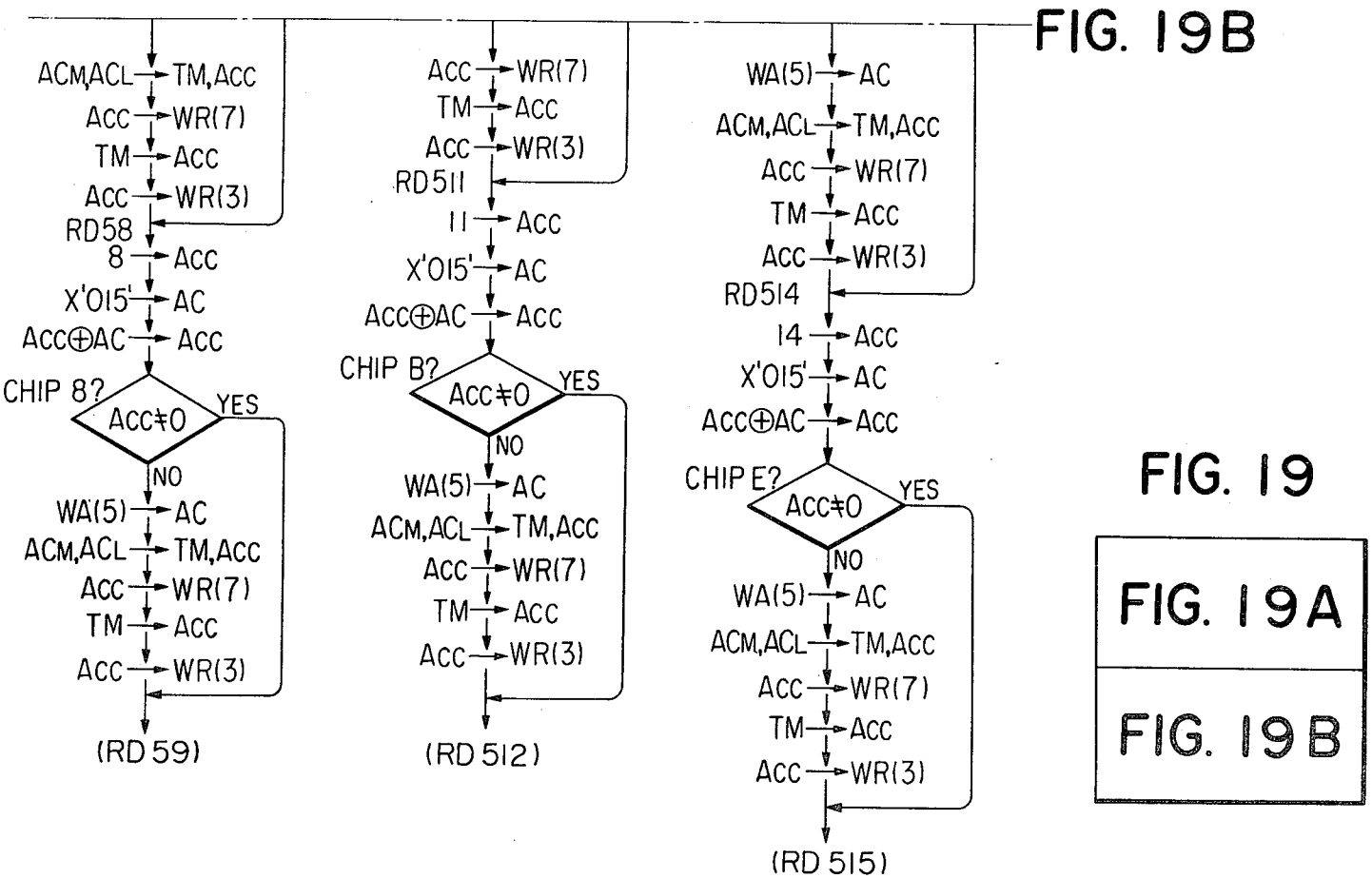
Figure 19A:
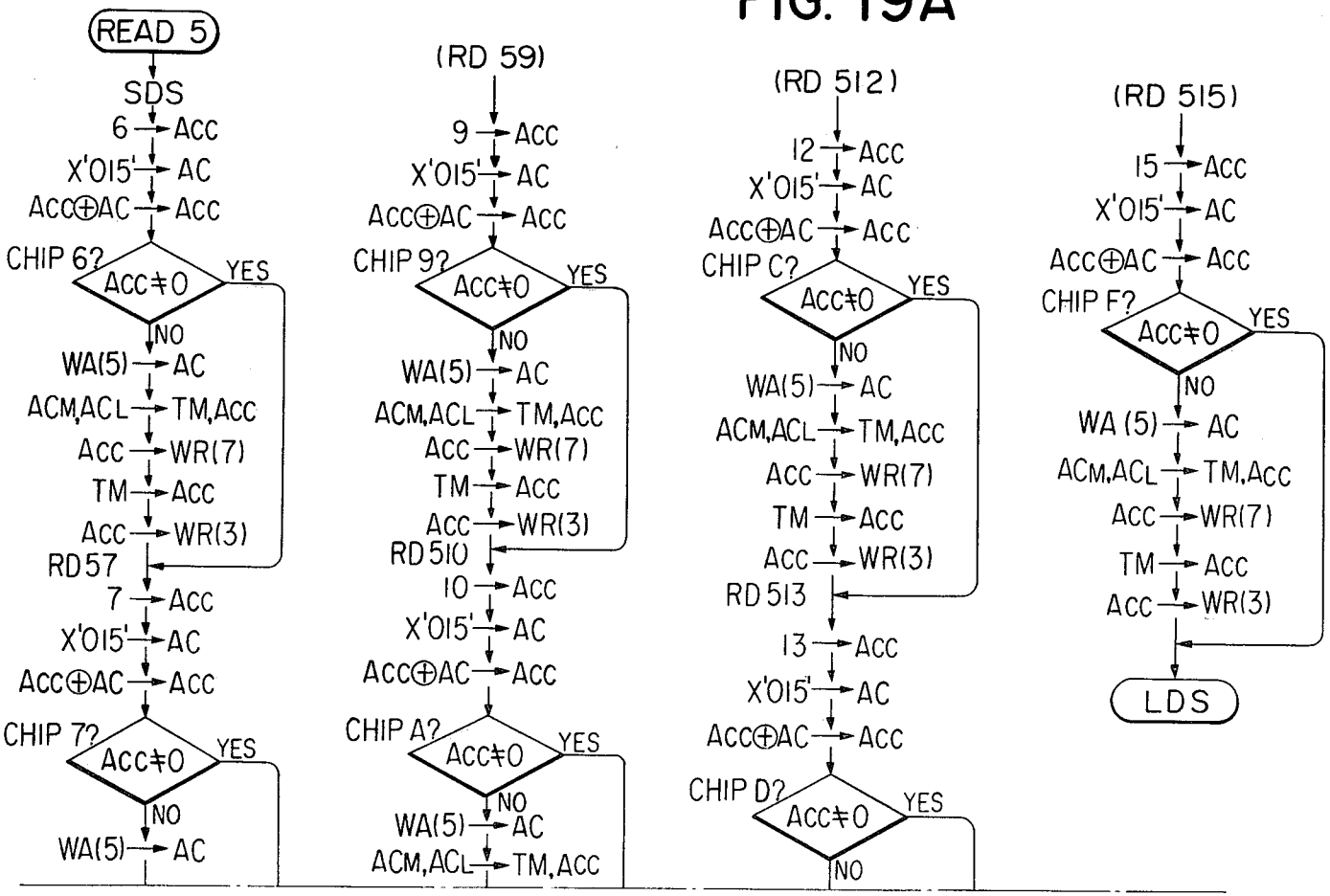
Figures 20, 20B:
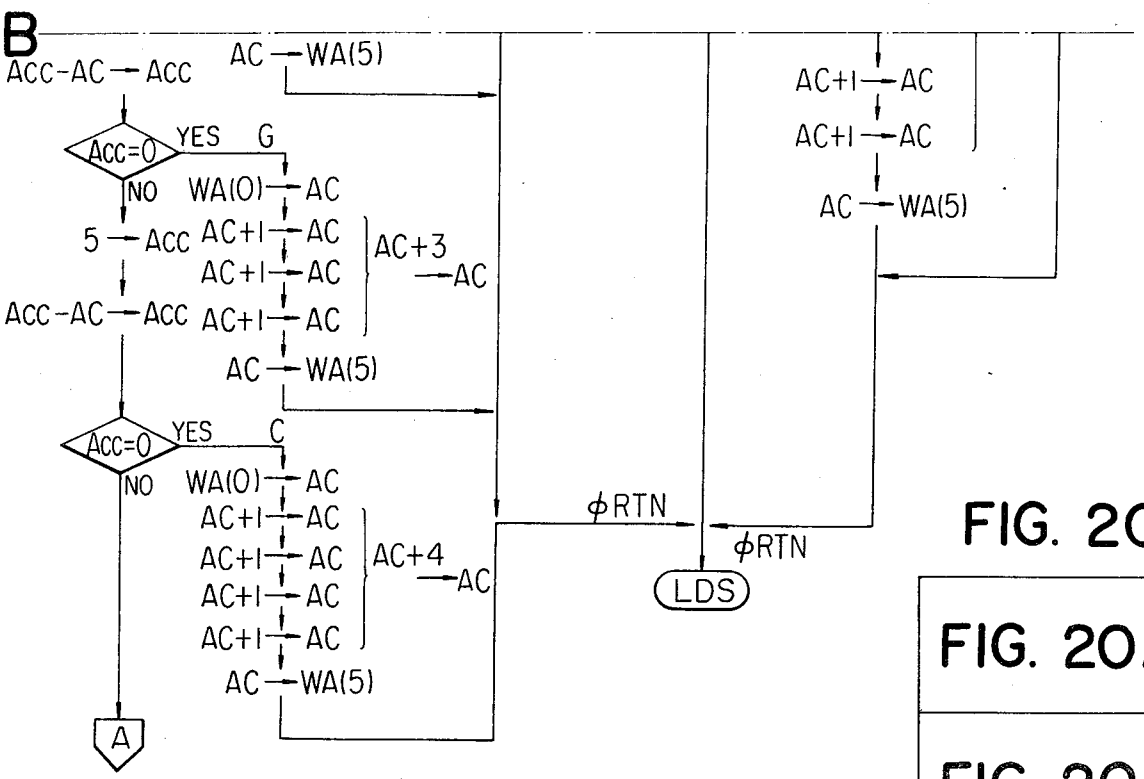
FIG. 20 is a flow chart for IMAGE ORIGINAL COLOR DECISION sub-routine.
Figure 20A:
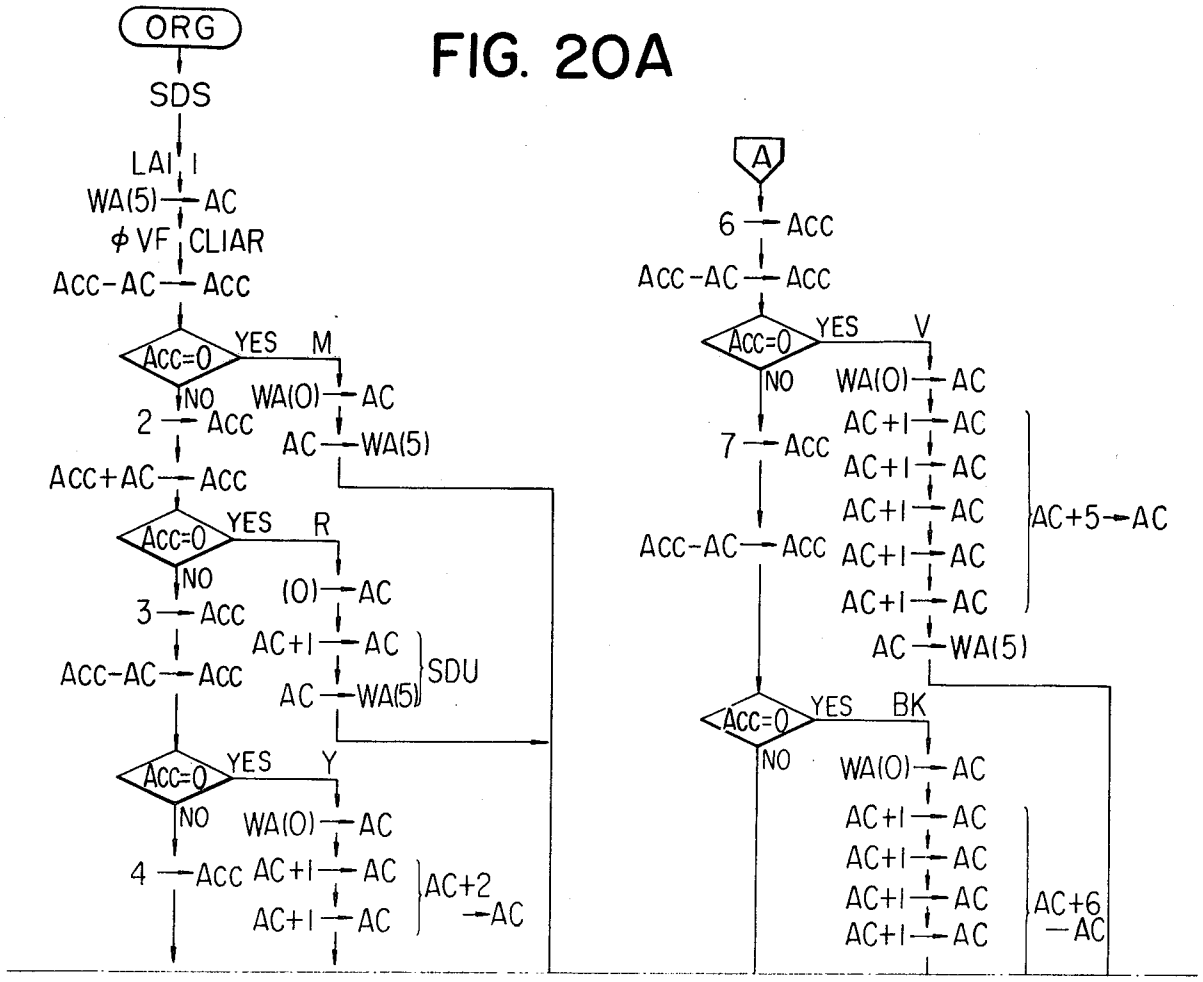
Figures 21, 21B:
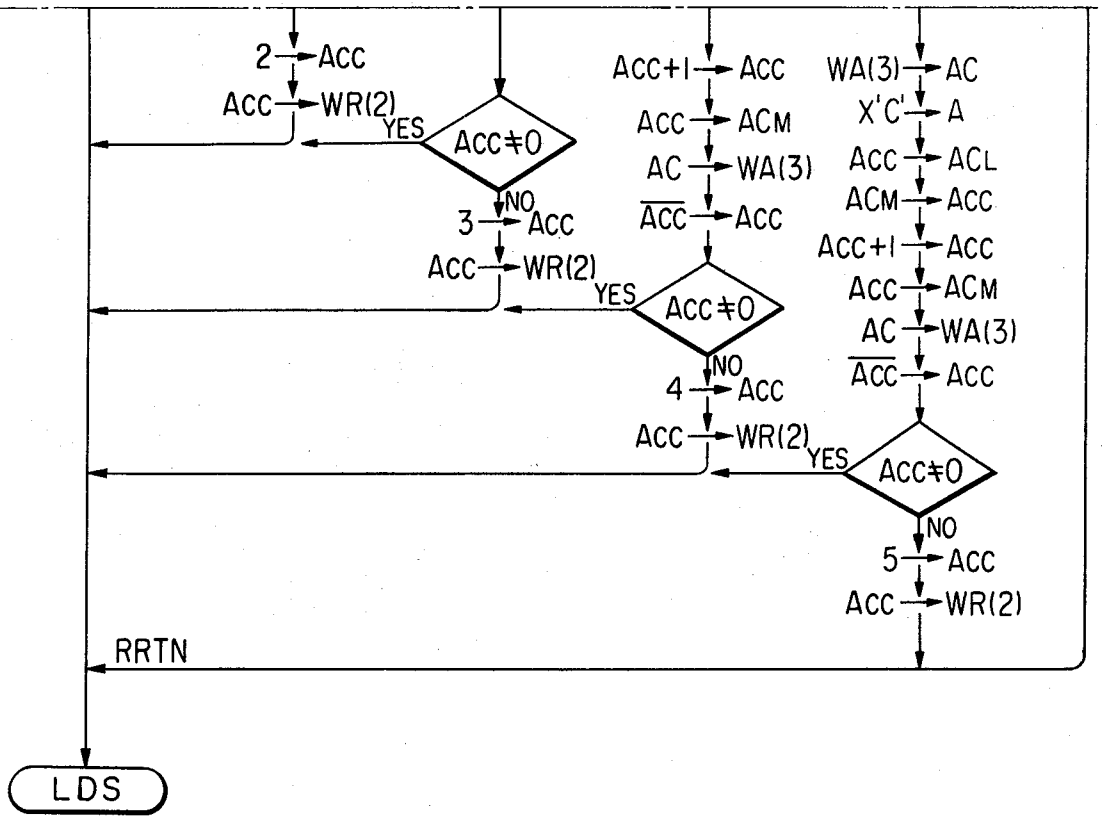
FIG. 21 is a flow chart for RAM ADDRESS DECISION sub-routine.
Figure 21A:
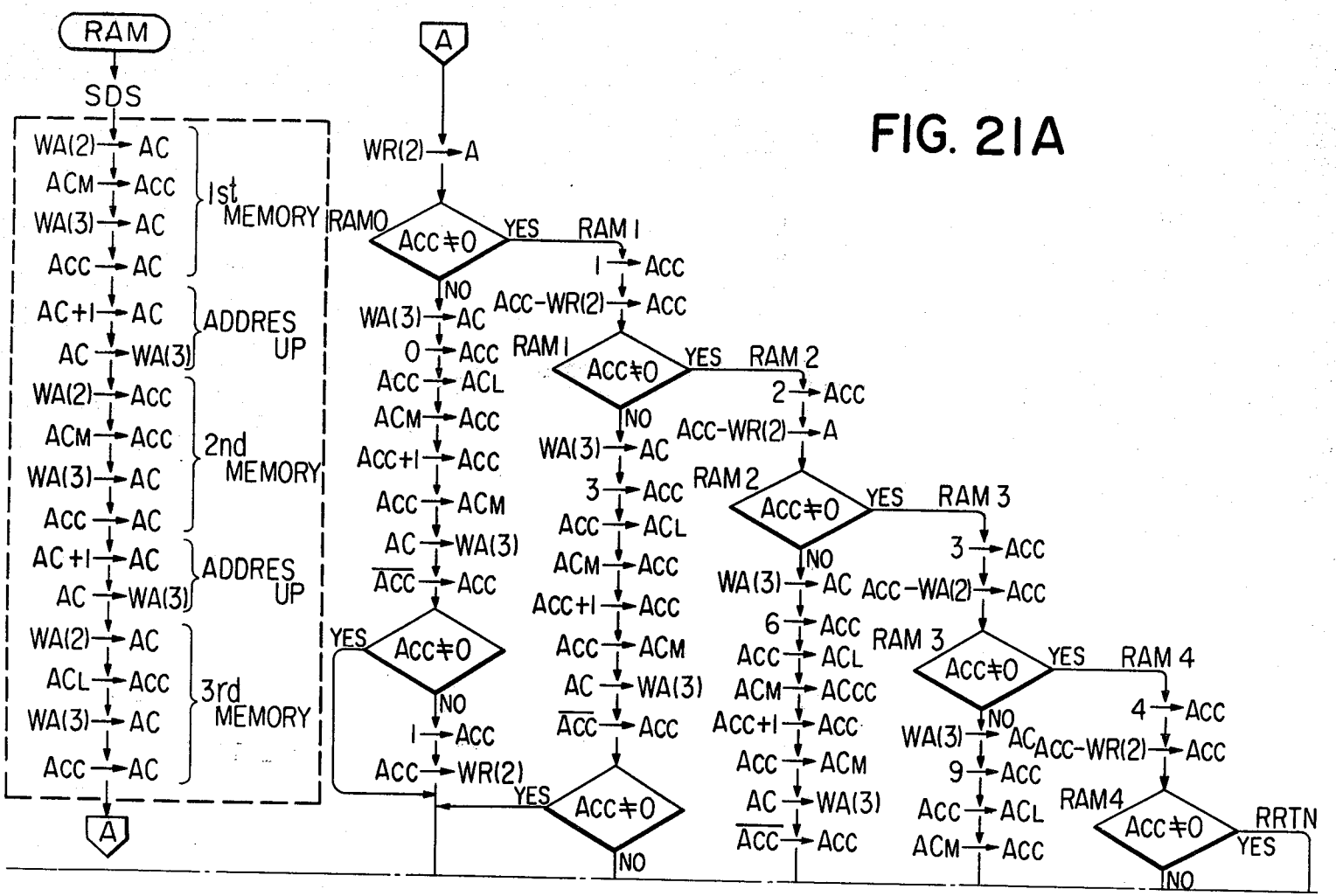
Figure 22:
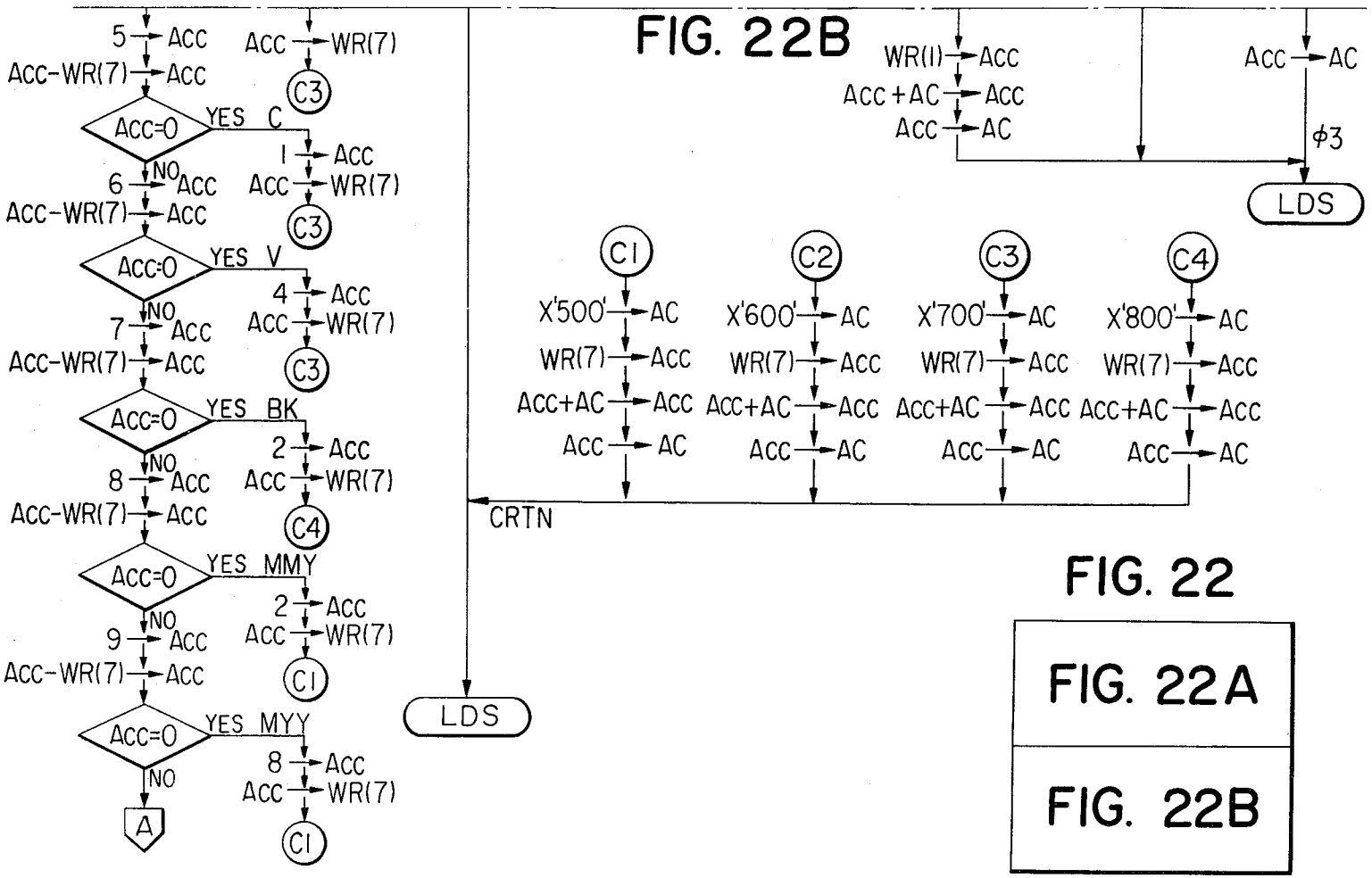
FIG. 22 is a flow chart for DISPLAY sub-routine.
Figure 22A:
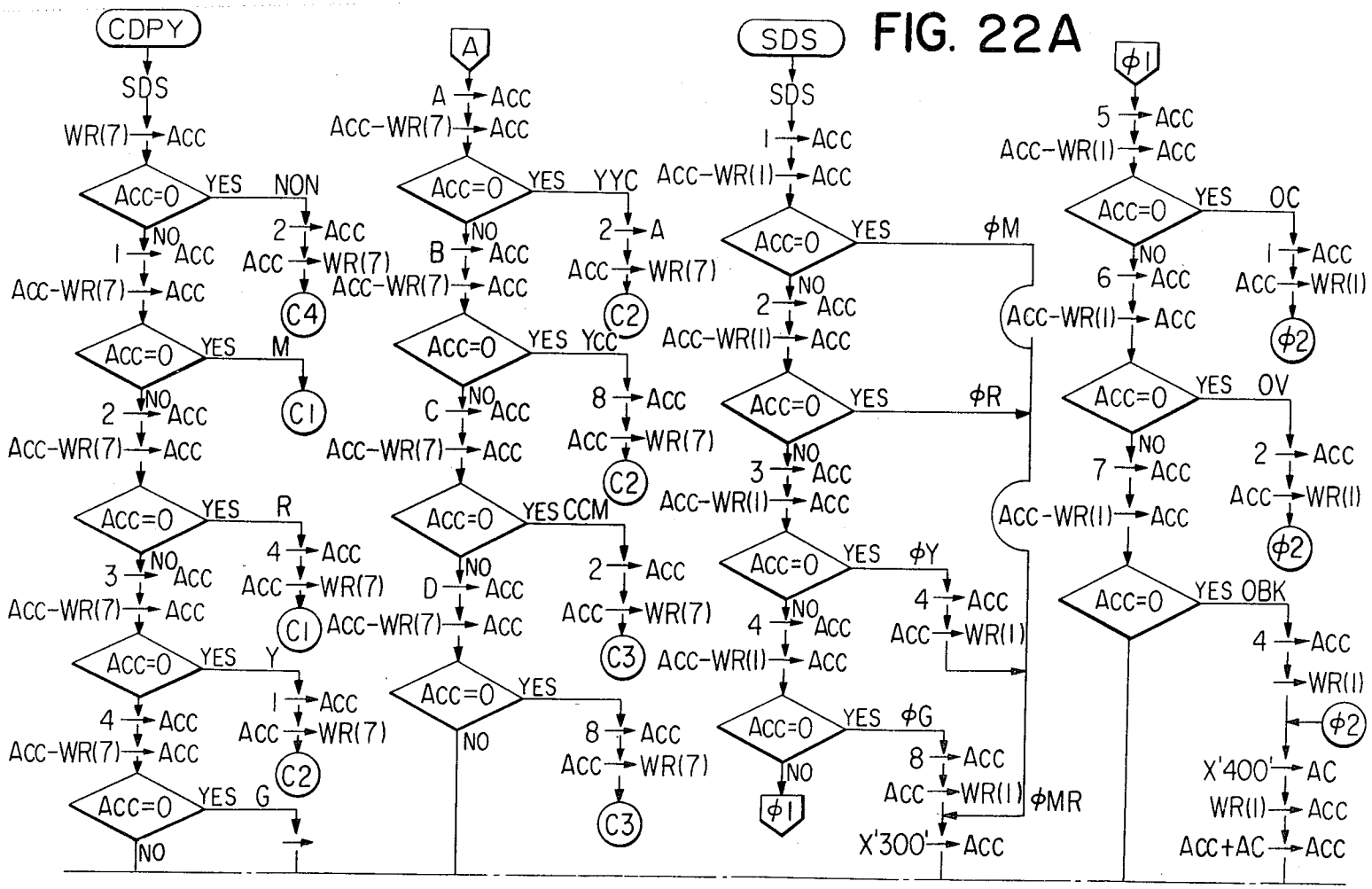

The data (stored in ROM-2) of the LIST ADDRESS (stored in WA(5)) determined at the Step 9 are read out. Since the data for the conversion color (the lower 4-bit in the LIST) are stored in WR(7), a determination is made as to whether they are coincided with the designated conversion colors in the seven areas of 'OGF', 'OAF', . . . , 'OFF', of RAM, or not. When they are not coincided, the address (WA(0)) of the LIST is counted up by seven. For example, when the number of key input times is single, the lower 4-bit (WR(7))of the data of LIST to be designated by WR(5) is checked for its coincidence with 4-bit of 'OGF'. When the key input times is two, the coincidence in the first time is checked, after which the sub-routine ORG and READ 5 in FIGS. 19 and 20 are performed to alter the abovementioned n to check the data of WR(7) and 'OAF' for their coincidence. Thereafter, the coincidence of all the key input times is checked in the same manner. When any one of them is not in coincidence, the address (WA(0)) of the LIST is counted up by seven. When all of them are in coincidence, the operation is proceeded to the Step 12.

STEP 12

The upper 4-bit (the third D/F) read out in the Step 7 is temporarily stored in the address '00B' of RAM. At the same time, the upper 4-bit (the first D/F) and the lower 4-bit (the second D/F) of the data in the address of CNT corresponding to the addresses of CNT in the Step 8 are respectively stored temporarily in the address '009'and '00A'of RAM(WA(2)).

STEP 13

The content of the area of WA(2) (the addresses '009'to '00B') in RAM is sequentially transferred from the addresses '020', '021', and '022' of RAM at the Step 12. The transfer area and the sequence are determined in the following manner.

The addresses '020' to '02E' of RAM are divided into five areas, and the middle place of the address is transferred to the area which has been changed to '2' to 'F'. This is an area, up to which the contents of WA(2) can be transferred upto 70 numbers. The 14 transfer sequences exist in the first area as shown in FIG. 11. The transfer starts from the addresses 020, 021, 022, and then to the addresses 030, 031, and 032. After completion of the transfer to 0F0, 0F1, and 0F2, the transfer operation shifts to the second area and start from the addresses 023, 024, and 025 and then to the addresses 033, 034, and 035 to complete the transfer to 0F3, 0F4, and 0F5, after which the operation shifts to the third area. In this way, 70 transfer places up to 0FC, 0FO, and 0FE of the fifth area are provided. The designation of this transfer place is done by changing WA(3) (the address 00D, 00E, and 00F) of RAM in FIG. 11 after one transfer operation, and then storing the subsequent transfer address.

STEP 14

The data in the LIST to be designated by WA(0) are read, and an indication signal is emitted to the designated conversion color to the designated original color. Also an output is produced for the conversion color to the original colors other than that designated. This output indicates all the conversion colors to the original colors other than that designated for a plurality of combinations between the filters and the developers which enable the color conversion to the designated original colors. This output reads and indicates all the conversion colors (lower 4-bit) for one scan including the LIST address determined at the Step 11 as coincided, and further indicates by OR such conversion colors for each coincidence. This is very convenient in that the operation of the reproduction apparatus can be informed of the subsequent conversion color which can be designated within a range as so far designated. That is, where no lamp is turned on, no color conversion can be made by the designation which has been made so far.

After the indication, WA(0) showing the LIST address is counted up by seven.

STEP 15

The flag which has been set or reset at the Step 8 is read.

STEP 16

Whether the content of WR(6) is "0" or not is checked. If WR(6)=0, the operation returns to the Step 7. If WR≠0, it proceeds to the Step 17. The relationship of WR(6)=0 indicates that not all of the scannings have yet been completed for one CNT, hence the operation returns to the Step 7.

STEPS 17 & 18

Whether the content of WR(6) is "1" or not is checked. WR(6)=1 indicates that the scanning has been completed for one CNT, hence the address of CNT is counted up by +1 at the Step 18, and the operation returns to the Step 7. If the relationships WR(6)≠0 and WR(6)≠1 are established, WR(6)=2. The relationship of WR(6)=2 indicates that all the contents of CNT and LIST in ROM-2 have been scanned, hence the operation returns to the Step 2 to read the key again.

The afore-described process steps 2 to 18 are carried out at every time the key is depressed. The key inputs up to the seven time at the maximum are permitted. The key inputs beyond the eight time are not stored, but indication of the result after the Step 19 is performed with respect to the key inputs up to the seventh. Also, by depression of DPY key, indication of the ultimate determination is carried out after the Step 19 based on the result designated by the key input which has so far been done.

The result may indicate any of the combinations of the first, second, and third D/F's stored in the area designated by WA(2) and WA(3) at the steps 12 and 13. In the present embodiment, the combination which became coincided at the end is stored in the area of WA(2) of RAM at the Step 12, so that this combination is selected for the purpose of explanation. The scanning sequence of CNT is in the order of the full color (three process steps), the two-color (two process steps), and mono-color (one process step), and the last coincidence indicates the least process steps which are able to practice the designated color conversion. By selecting the contents of WA(2), the color conversion with the least process steps is possible.

In the following, explanations will be made as to the method steps of indicating the conversion color with respect to the original seven colors when the combinations of the first, second, and third D/F's in WA(2) is selected, and of indicating such combinations.

STEP 19

Data in the area of WA(3) of RAM are read.

STEP 20

When not a single coincidence exists in the area of WA(3) of RAM, the initial data '020' set at the Step 1 is stored therein. When there exists one coincidence, there is stored in the area of WA(3) of RAM the data '030', and when there exist two coincidences, there is stored the data '040', and so forth. Here, a determination is made as to whether the stored data is '020', or not. If it is '020', the key input is returned to the Step 1 to resume the operation from the first, since there is nothing coincident with the designated color. On the other hand, if it is not '020', the operation proceeds to the Step 21, since there exists a coincidence.

STEP 21

(a) The initial values of the LIST address and the CNT address are set, and WR(4) is reset.

(b) Thereafter, the operations of the Steps 7 and 8 are repeated. That is, the data of LIST designated by WA(0) is read, then LSB is stored in WR(7), and MSB in MR(3), and subsequently, the data of CNT designated by WA(1) is read to set or reset the flag WR(6) in accordance with the content of CNT. This operation is exactly same as that in the Steps 7 and 8.

(c) Next, WA(2) is read, and then the combinations of the first, second and third D/F's to be determined by WA(1) are read to determine whether the contents of WA(2) coincide with the combinations of the first, second, and third D/F's, or not.

(d) If not coincidence exits, the operation proceeds to the Step 22. If coincided, it proceeds to the Step 23.

STEP 22

If no coincidence exists in the Step 21, the address of WA(0) is counted up by seven. Thereafter, WR(6) which has been set or reset at the Step 21 is read. Then, a determination is made as to whether the flag WR(6)=0, or not. If WR(6)=0, the operation returns to the Step 21(b), since the scanning of the LIST corresponding to one CNT has not yet been completed. If WR(6)≠0, a determination is made as to whether WR(6)=1, or not. If WR(6)=1, WA(1) is counted up by one to return to the Step 21(b), and the operation returns to the Step 21*b*, since the scanning of LIST corresponding to one CNT is completed, and the scanning of the entire CNT and LIST has not yet been completed. When WR(6)≠0 and WR(6)≠1, WR(6)=2 without exception. The relationship of WR(6)=2 indicates that the scanning to the entire CNT and LIST has been completed, i.e., no coincidence at all, hence the operation returns to the Step 1.

STEP 23

In case of coincidence at the Step 21, the ports 3ϕ and 4ϕ of the input-output circuits I/03 and I/04 are all opened, and the lower 4-bit values of the address data of LIST stored in WR(7) are taken out as the outputs into the input-output circuits I/05 to I/08, and the conversion color to one original image color is indicated. At every time this indiction is performed, the LIST address, i.e., WA(0) is counted up by one, and lower 4-bit values of the address data of LIST are taken out as the outputs into the input-output circuits I/05 to I/08 for indication. By repeating this operation for seven times, all the seven conversion colors to the seven original image colors are displayed.

Thereafter, the content of WA(2) is taken out as the output into the input-output circuits 7 to 9 to indicate the combinations of the developing devices and the filters. Then, the operation is returned to the step 1 to resume the initial state.

Incidentally, when this color converter is used in conjunction with the color reproduction apparatus shown in FIG. 1, a DISP signal can be obtained by the copy start button. Also, by introducing a selection signal for the combinations of the filters and the developing devices into the circuits for driving the filter motor and for driving the developing devices in the reproduction apparatus, a converted color copy can be automatically obtained.

In the foregoing, explanations on the color conversion process sequences have been made in reference to the general flow chart of FIG. 12. It should be noted that the general flow chart in FIG. 12 is based on the program main flows in FIGS. 13 to 16 and the subroutines in FIGS. 17 to 22.

The following Table 7 indicates selected program instruction codes in FIGS. 13 to 22 as stored in POM-1. Also, a part of the data codes of LIST and CNT in Table 5 stored in ROM-2 are shown in the following Table 8.

Table 7

POM - 1 PROGRAM INSTRUCTION CODES

| | Address X | 0 | 1 | 2 | 3 | 4 | 5 | 6 | 7 | 8 | 9 | A | B | C | D | E | F |
|---|---|---|---|---|---|---|---|---|---|---|---|---|---|---|---|---|---|
| Main Program | 0 | 70 | 82 | 40 | 20 | 23 | 00 | 00 | 00 | 70 | 85 | 40 | 2F | 24 | 88 | 8B | 8C |
| | 010 | 8D | 8E | 8F | 40 | 8F | 88 | 00 | 00 | 00 | 42 | 4B | E3 | 60 | 5C | 22 | 41 |
| | 020 | 69 | E3 | 71 | F1 | B5 | 54 | 57 | 40 | 3F | 24 | 72 | F1 | B5 | 54 | 57 | 40 |
| | 030 | 4F | 24 | 73 | F1 | B5 | 54 | 57 | 40 | 5F | 24 | 74 | F1 | B5 | 54 | 57 | 40 |
| | 240 | | | | | | | | | | 00 | F3 | 2E | 7F | 80 | 84 | 18 |
| KEY | 250 | 41 | 00 | 26 | 70 | 88 | 1D | 65 | 88 | 18 | 36 | 68 | F6 | 5A | 58 | 10 | F6 |
| | 260 | 52 | 66 | F6 | EB | 58 | 6A | 36 | 68 | 58 | 58 | EF | 52 | 9D | F6 | 52 | 7E |
| | 2B0 | 85 | 80 | 3F | 2F | 76 | 40 | D1 | 9C | 5C | BF | 30 | D6 | 87 | EF | 83 | 77 |
| READ | 2C0 | 40 | 01 | 9C | 5C | CA | 30 | D7 | 87 | EF | 83 | 78 | 40 | 01 | 9C | 5C | D5 |
| | 2D0 | 30 | D8 | 87 | EF | 83 | 79 | 40 | 01 | 9C | 5C | E0 | 30 | D9 | 87 | EF | 83 |
| | 320 | | | | | | | EF | 83 | 3F | 2F | 76 | 40 | 15 | 9C | 5C | 35 |
| READS | 330 | 35 | D6 | 87 | EF | 83 | 77 | 40 | 15 | 9C | 5C | 40 | 35 | D7 | 87 | EF | 83 |
| | 340 | 78 | 40 | 15 | 9C | 5C | 4B | 35 | D8 | 87 | EF | 83 | 79 | 40 | 15 | 9C | 5C |
| | 390 | | | | | | | | 83 | 3F | 2F | 35 | 71 | F1 | B8 | 54 | C0 |
| ORG | 3A0 | 72 | F1 | B8 | 54 | C4 | 73 | F1 | B8 | 54 | C8 | 74 | F1 | B8 | 54 | CD | 75 |
| | 3B0 | 76 | F1 | B8 | 54 | D3 | F1 | B8 | 54 | DA | 77 | F1 | B8 | 54 | E2 | 58 | E9 |
| SKIP | 3E0 | | | | | | | | | 2D | 3F | 2F | 33 | FD | F5 | 5C | FA |
| | 3F0 | FA | FA | FA | 33 | E9 | 33 | F5 | EB | 58 | FD | FA | 58 | F3 | 3F | 00 | 00 |
| RAM | 400 | 2F | 32 | EE | 33 | 88 | 2B | 32 | ED | 33 | 88 | 2B | 32 | EC | 33 | 88 | 62 |
| | 410 | 5C | 21 | 33 | 70 | E8 | ED | FA | E9 | 23 | F5 | 5C | 1E | 71 | 82 | 44 | 6B |
| | 460 | | | | | | | | | | | 82 | 3F | 2F | 71 | F1 | B1 |
| O - DPY | 470 | 54 | 98 | 72 | F1 | B1 | 54 | 98 | 73 | F1 | B1 | 54 | 92 | 74 | F1 | B1 | 54 |
| | 480 | 96 | 75 | F1 | B1 | 54 | A0 | 76 | F1 | B1 | 54 | A4 | 77 | F1 | B1 | 54 | A8 |
| | 4B0 | 3F | 12F | 42 | B3 | E3 | 63 | 32 | E8 | 22 | 31 | DF | 32 | E9 | EF | EA | 22 |
| MEMORY | 4C0 | 3F | 00 | 00 | 00 | 00 | 00 | 00 | 00 | 00 | 00 | 00 | 00 | 00 | 00 | 00 | 00 |
| | 4D0 | 00 | 00 | 00 | 00 | 00 | 00 | 00 | 00 | 00 | 00 | 00 | 00 | 00 | 00 | 00 | 00 |
| | 4E0 | 00 | 00 | 00 | 00 | 00 | 00 | 00 | 00 | 00 | 00 | 00 | 00 | 00 | 00 | 00 | 00 |
| | 4F0 | 00 | 00 | 00 | 00 | 00 | 00 | 00 | 00 | 00 | 00 | 00 | 00 | 00 | 00 | 00 | 00 |
| | 500 | 2F | 67 | 54 | 47 | 71 | F1 | B7 | 54 | 7B | 72 | F1 | B7 | 54 | 4B | 73 | F1 |
| C DPY | 510 | B7 | 54 | 4F | 74 | F1 | B7 | 54 | 53 | 75 | F1 | B7 | 54 | 57 | 76 | F1 | B7 |
| | 5F0 | | | | | B7 | E3 | | | | | | | | | | |

Table 8

ROM - 2

| | Address X | 0 | 1 | 2 | 3 | 4 | 5 | 6 | 7 | 8 | 9 | A | B | C | D | E | F |
|---|---|---|---|---|---|---|---|---|---|---|---|---|---|---|---|---|---|
| | 600 | 03 | 03 | 03 | 03 | 00 | 03 | 03 | 13 | 19 | 19 | 19 | 10 | 13 | 19 | 23 | 2A |
| | 610 | 2A | 2A | 20 | 23 | 2A | 43 | 43 | 43 | 43 | 40 | 43 | 43 | 52 | 52 | 53 | 53 |
| | 620 | 50 | 52 | 59 | 64 | 64 | 63 | 63 | 60 | 64 | 6A | 83 | 83 | 83 | 83 | 83 | 83 |
| | 630 | 83 | 93 | 93 | 93 | 93 | 91 | 92 | 99 | A3 | A3 | A3 | A3 | A5 | A4 | AA | C3 |
| | 640 | C3 | C3 | C3 | C3 | C3 | C3 | D2 | D9 | D9 | D9 | D1 | D2 | D9 | E4 | EA | EA |
| | 650 | EA | E5 | E4 | EA | 18 | 18 | 18 | 18 | 10 | 18 | 18 | 27 | 27 | 27 | 27 | 20 |
| LIST | F40 | 90 | 92 | 92 | 92 | 92 | A0 | A0 | A0 | A4 | A4 | A4 | A4 | 90 | 90 | 90 | 91 |
| | F50 | 91 | 91 | 91 | A0 | A0 | A0 | A6 | A6 | A6 | A6 | A0 | A0 | A0 | A5 | A5 | A5 |
| | F60 | A5 | 03 | 03 | 03 | 03 | 00 | 03 | 03 | 11 | 11 | 11 | 11 | 10 | 11 | 11 | 25 |
| | F70 | 25 | 25 | 25 | 20 | 25 | 25 | 43 | 43 | 40 | 40 | 40 | 43 | 43 | 51 | 51 | 50 |
| | F80 | 50 | 50 | 51 | 51 | 65 | 65 | 60 | 60 | 60 | 65 | 65 | 80 | 80 | 80 | 03 | 03 |
| | F90 | 83 | 83 | 90 | 90 | 90 | 91 | 91 | 91 | 91 | A0 | A0 | A0 | A5 | A5 | A5 | A5 |
| | FA0 | 00 | 00 | 00 | 00 | 00 | 00 | 00 | 00 | 00 | 00 | 00 | 00 | 00 | 00 | 00 | 00 |
| | FB0 | 00 | 00 | 00 | 00 | 00 | 00 | 00 | 00 | 00 | 00 | 00 | 00 | 00 | 00 | 00 | 00 |
| | FCO | 00 | 00 | 00 | 00 | 00 | 00 | 00 | 00 | 00 | 00 | 01 | 02 | 04 | 05 | 06 | 08 |
| | FD0 | 09 | OA | 11 | 12 | 22 | 14 | 15 | 16 | 18 | 19 | 1A | 24 | 25 | 26 | 28 | 29 |

Table 8-continued

| | Address X | 0 | 1 | 2 | 3 | 4 | 5 | 6 | 7 | 8 | 9 | A | B | C | D | E | F |
|---|---|---|---|---|---|---|---|---|---|---|---|---|---|---|---|---|---|
| | | ROM - 2 | | | | | | | | | | | | | | | |
| CNT | FE0 | 2A | 44 | 45 | 46 | 48 | 49 | 4A | 55 | 56 | 66 | 58 | 59 | 5A | 68 | 69 | 6A |
| | FF0 | 88 | 89 | 8A | 9A | 99 | AA | F0 | F1 | F2 | F4 | F5 | F6 | F8 | F9 | FA | FF |

Figure 7:
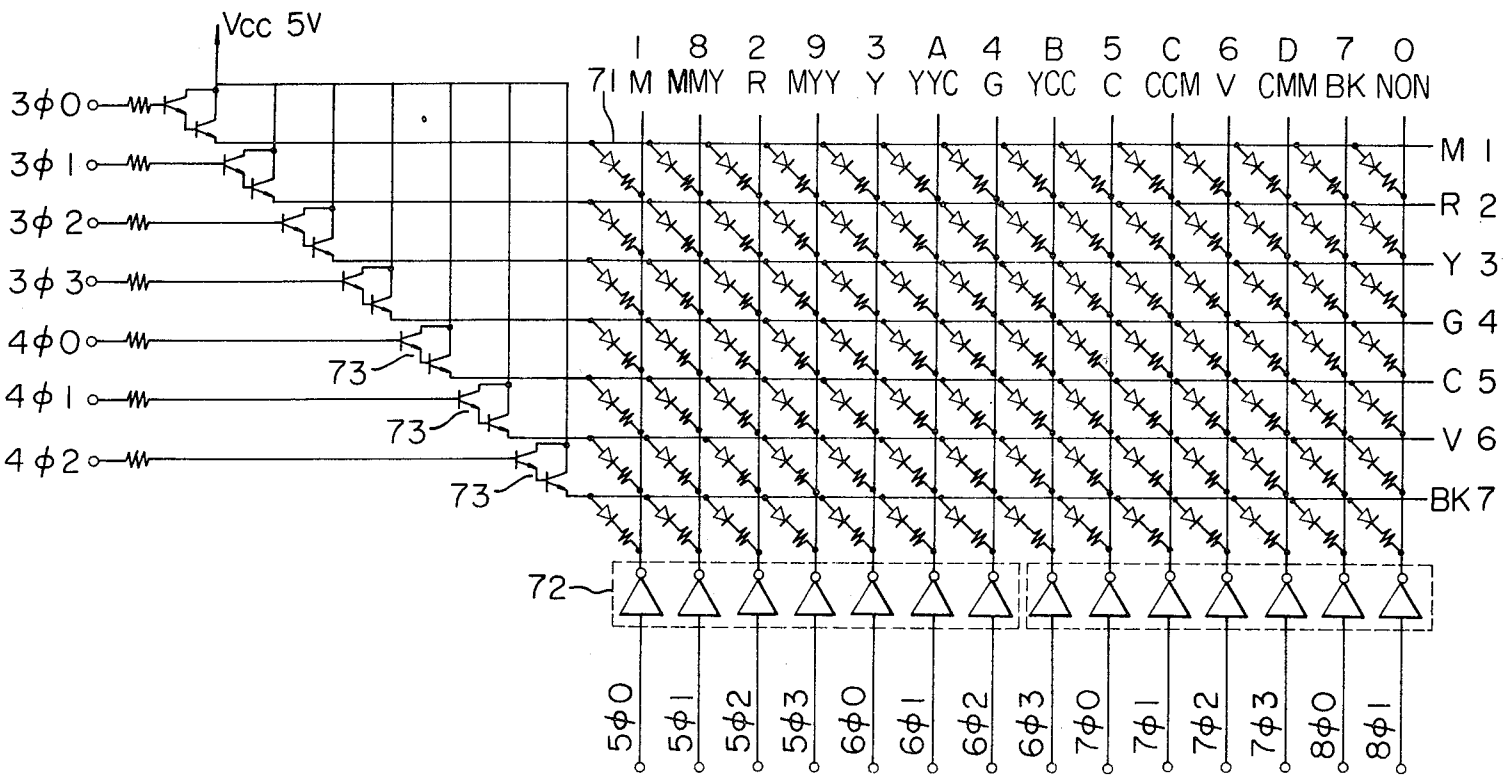
FIG. 7 shows one example of the indicating circuit for the color-conversion indicator in FIGS. 2 and 3.
Figure 8A:
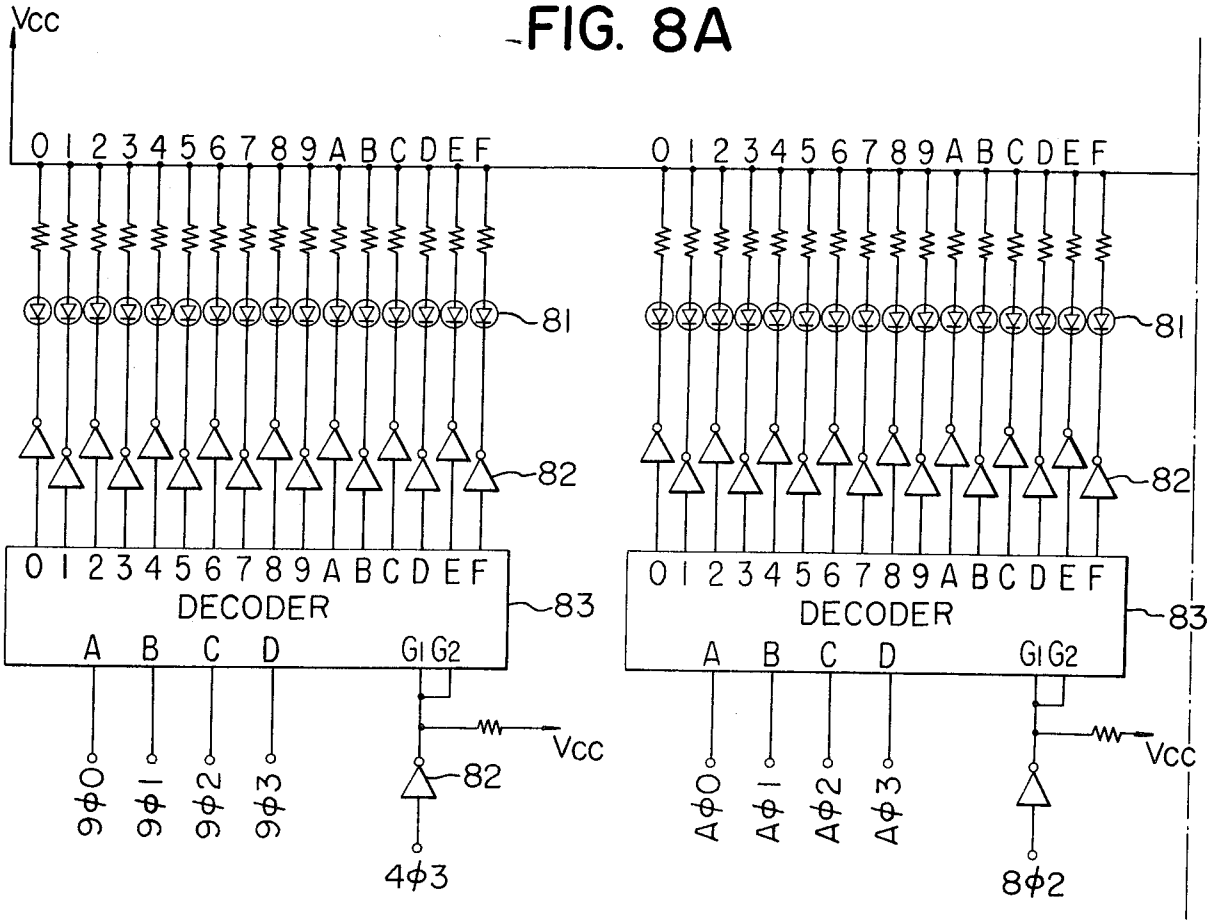
Figures 13, 13B:
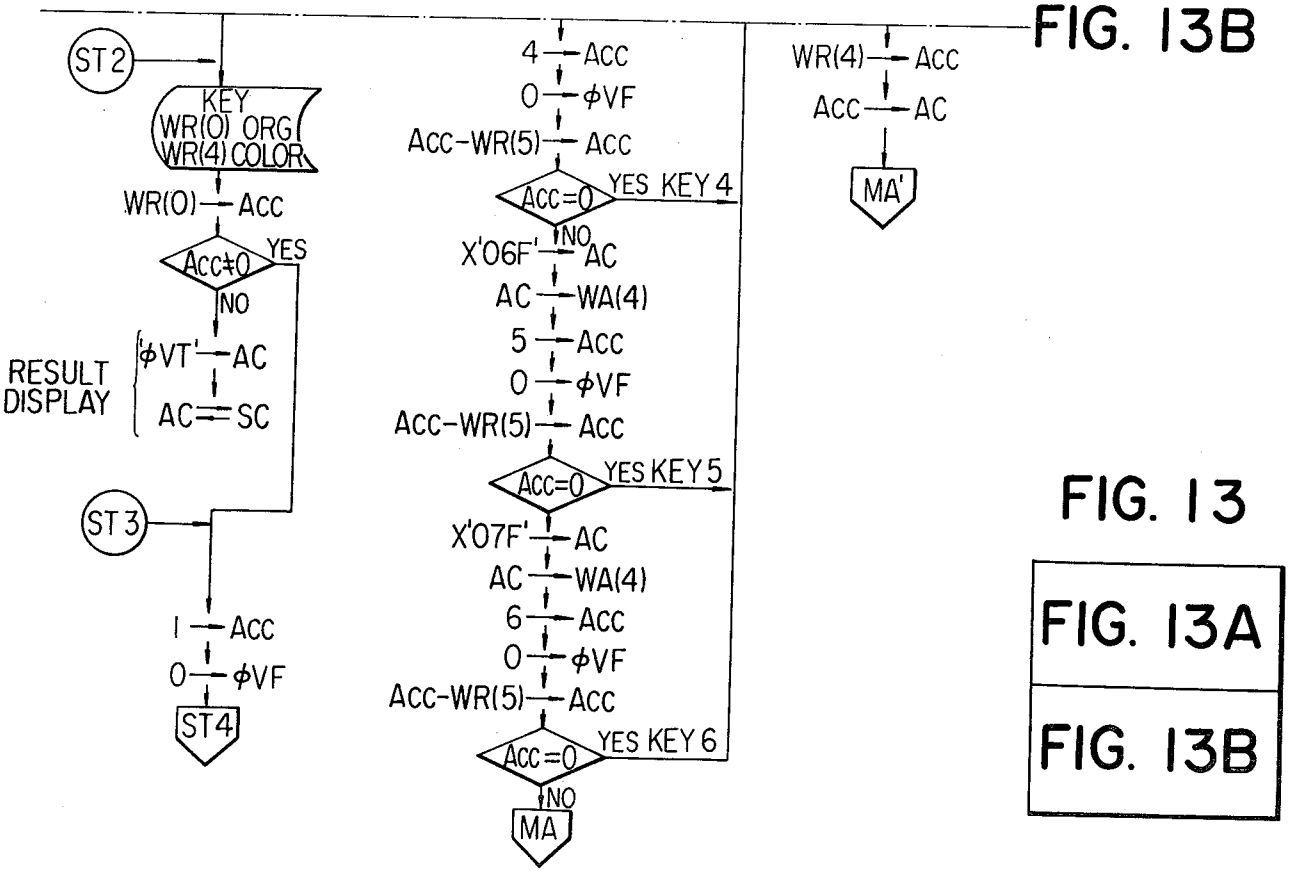
FIGS. 13 to 16 are respectively program main flow charts corresponding to the general flow chart shown in FIG. 12.
Figure 13A:
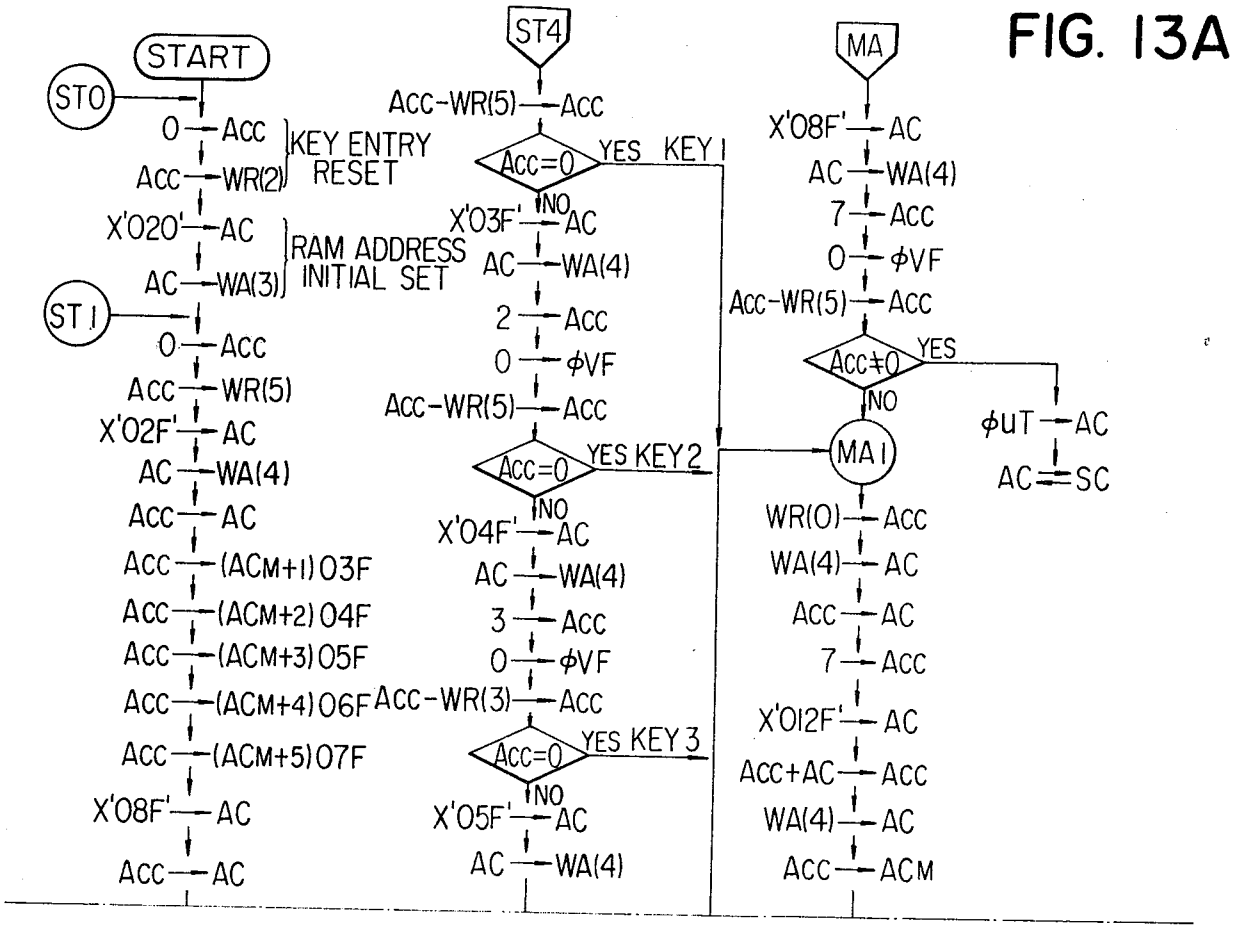
Figures 14, 14A, 14B:
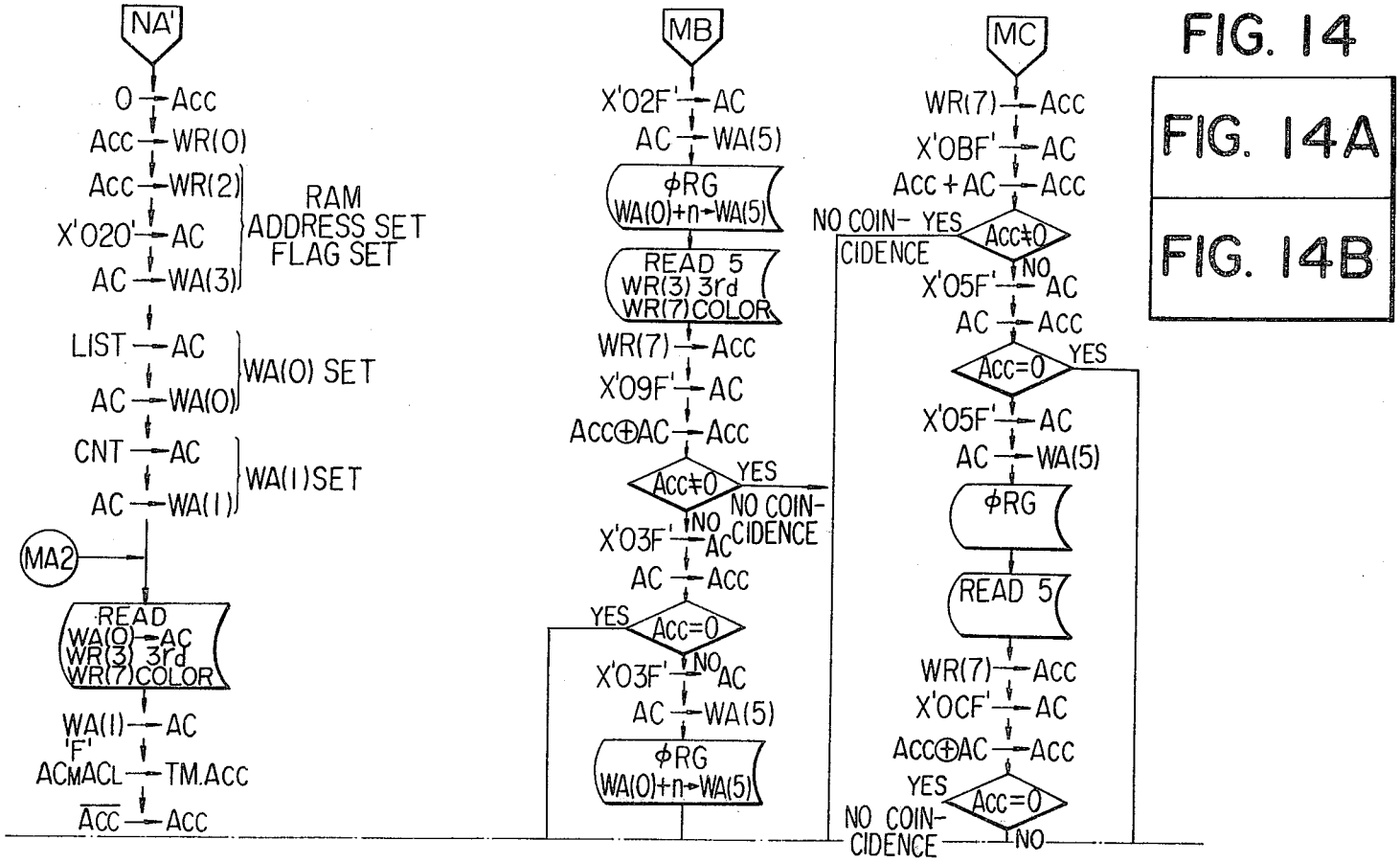
Figure 14B:
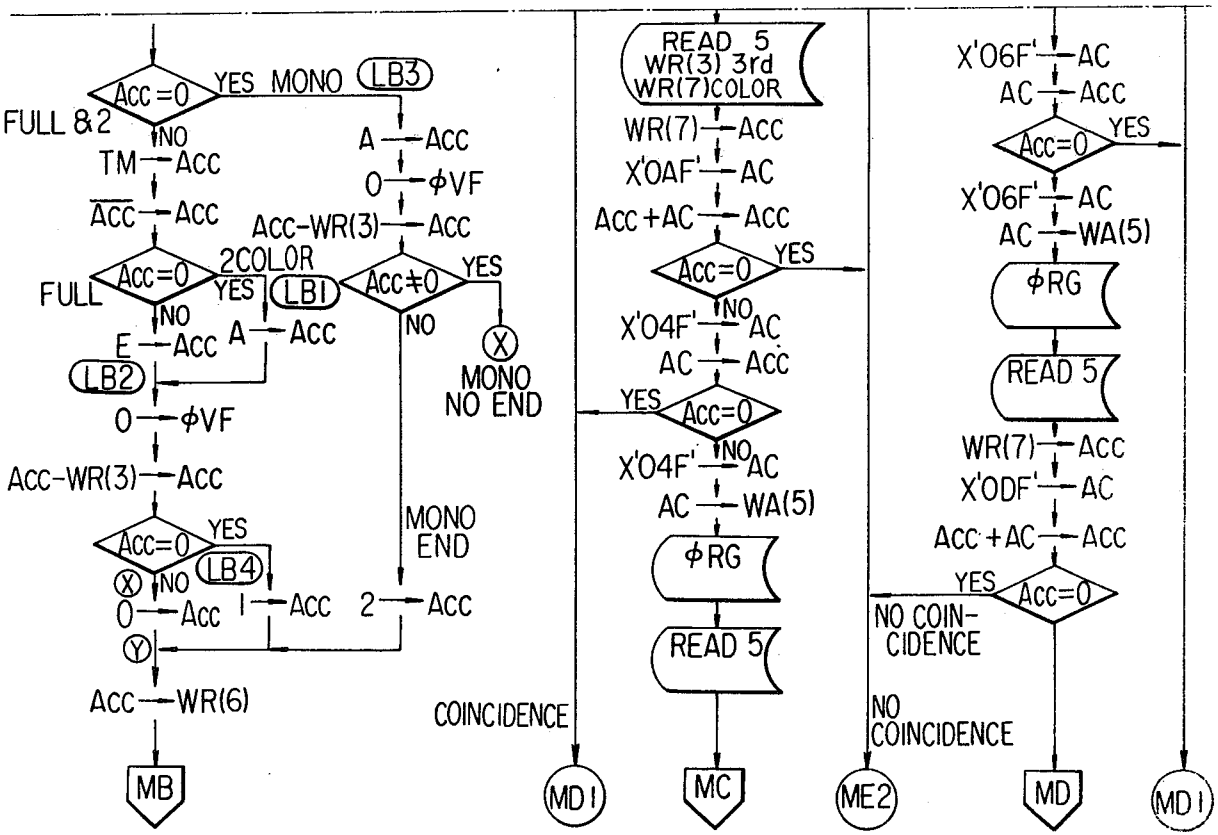
Figures 15, 15B:
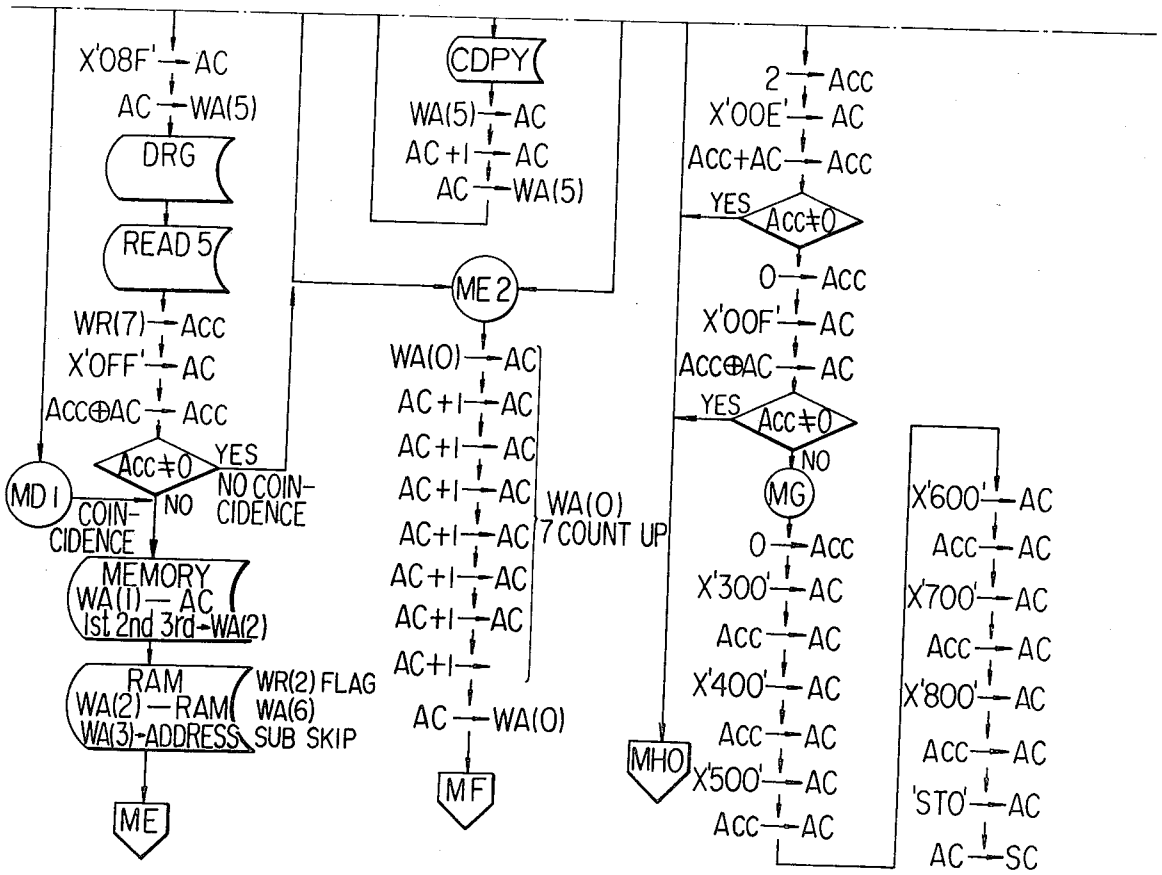
Figure 15A:
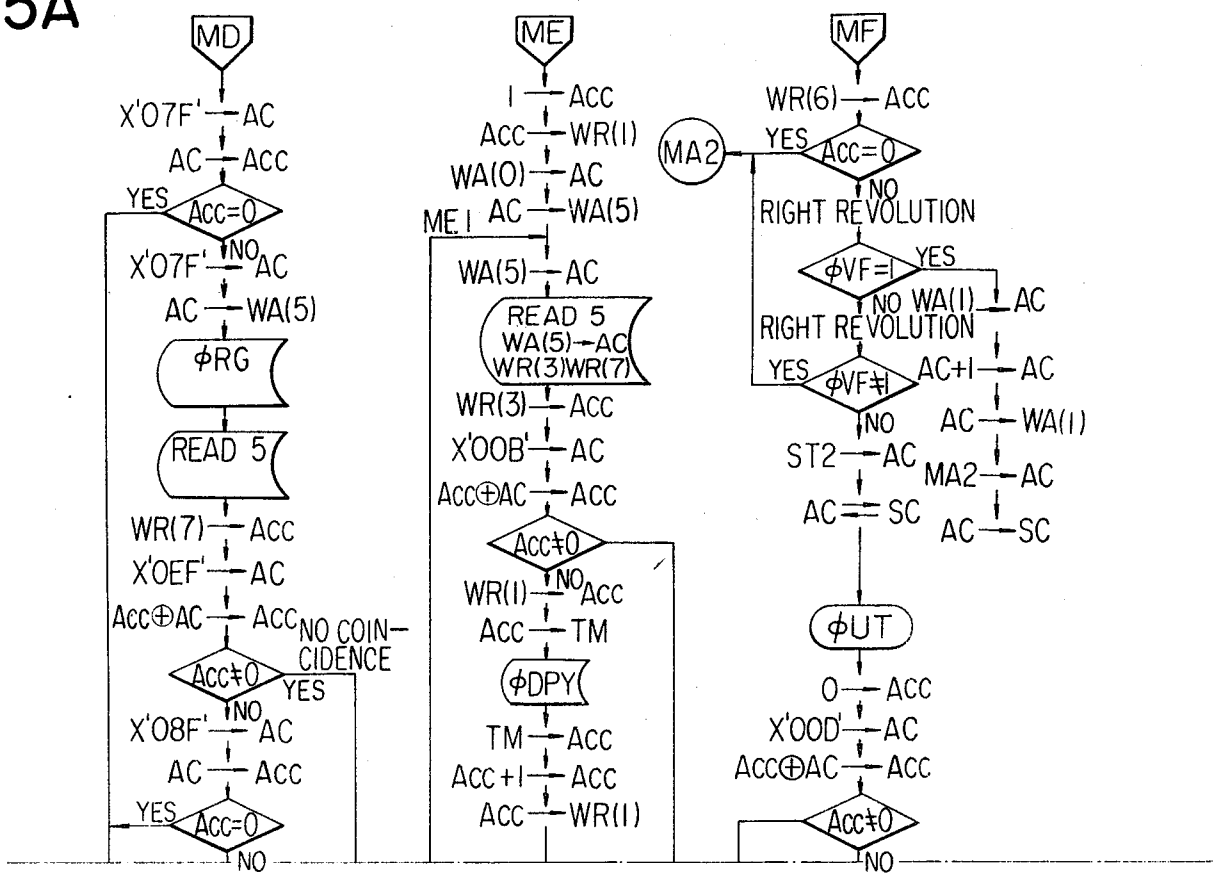
Figure 16:
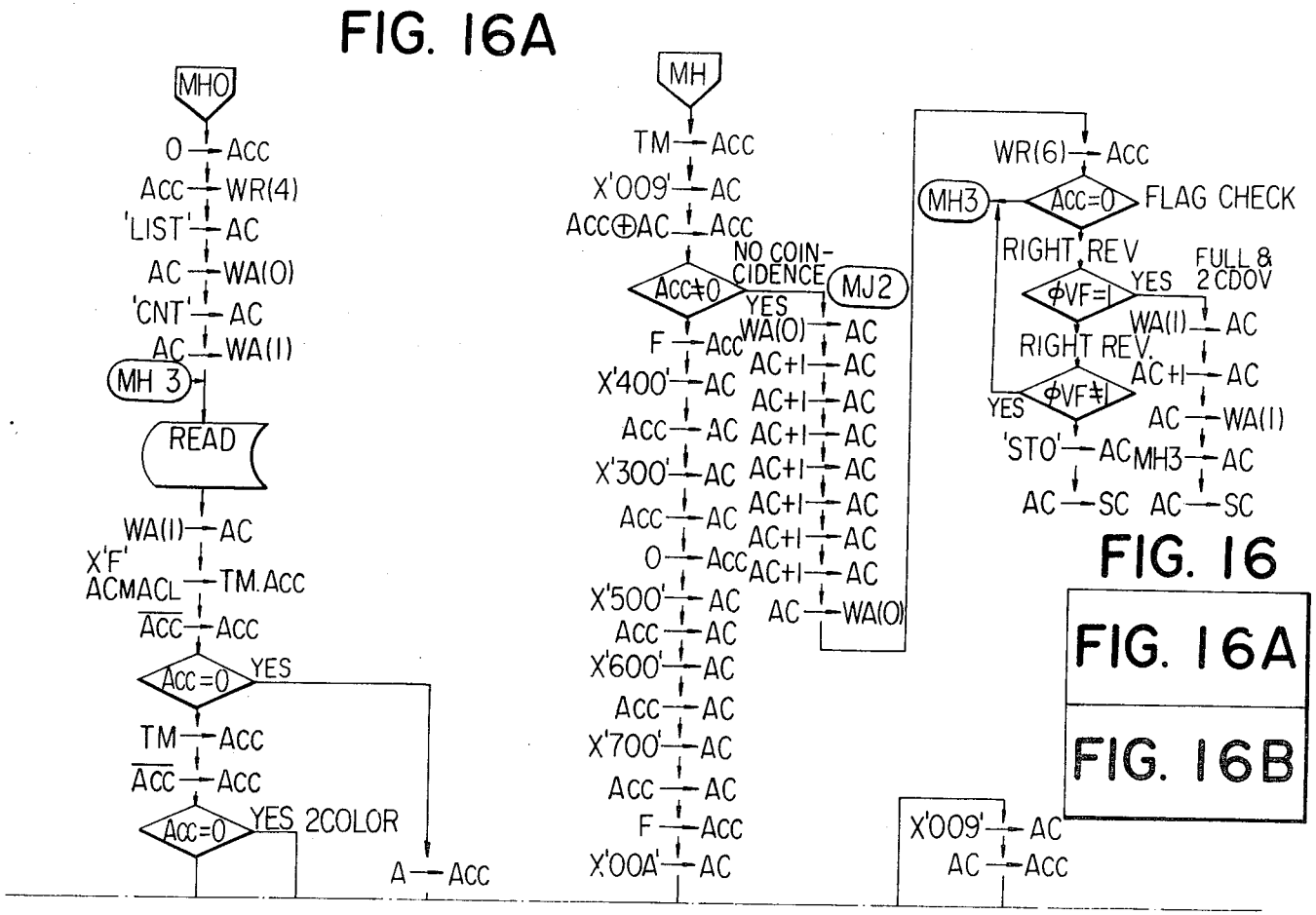
Figure 16B:
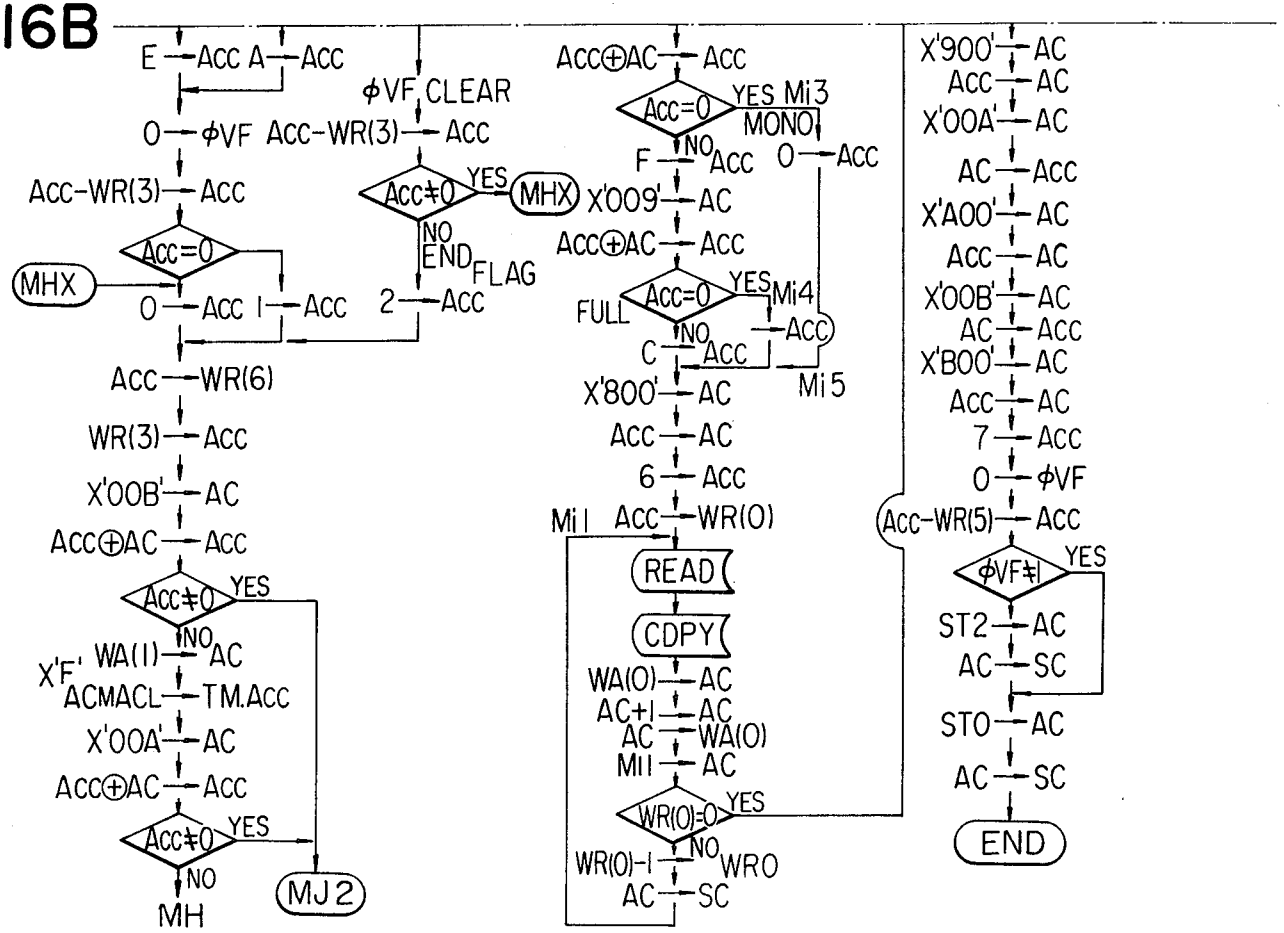
Figures 17, 17B:
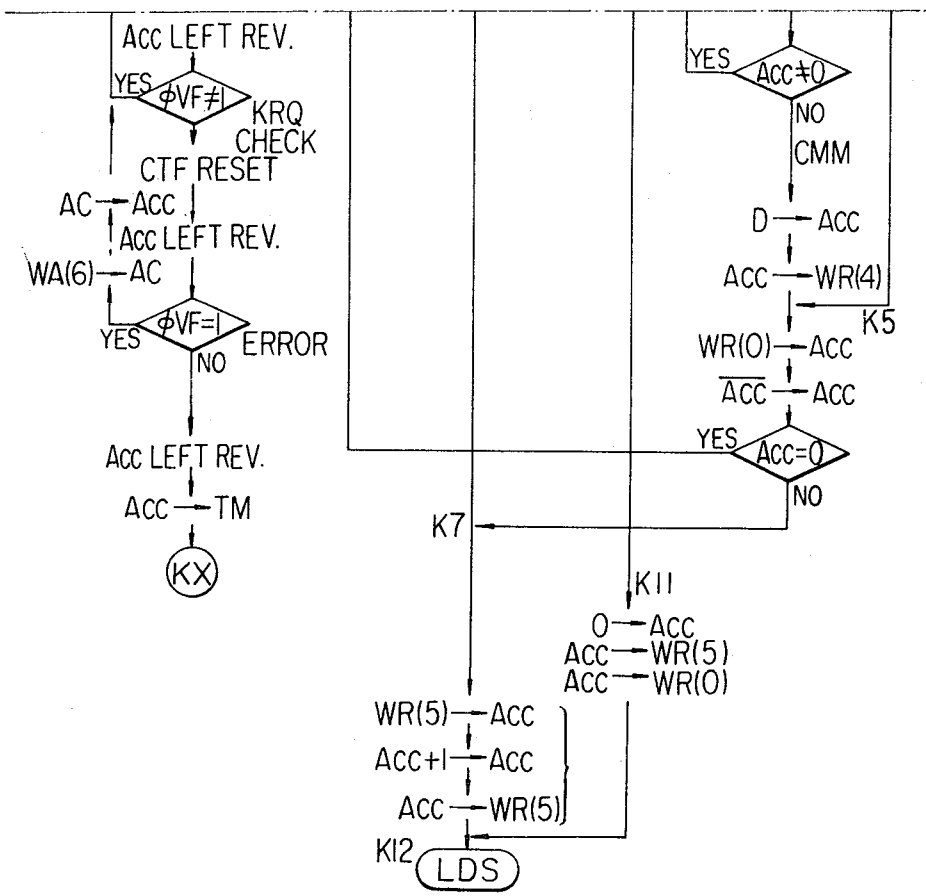
FIG. 17 is a flow chart for KEY READ sub-routine in the general flow chart of FIG. 12.
Figure 17A:
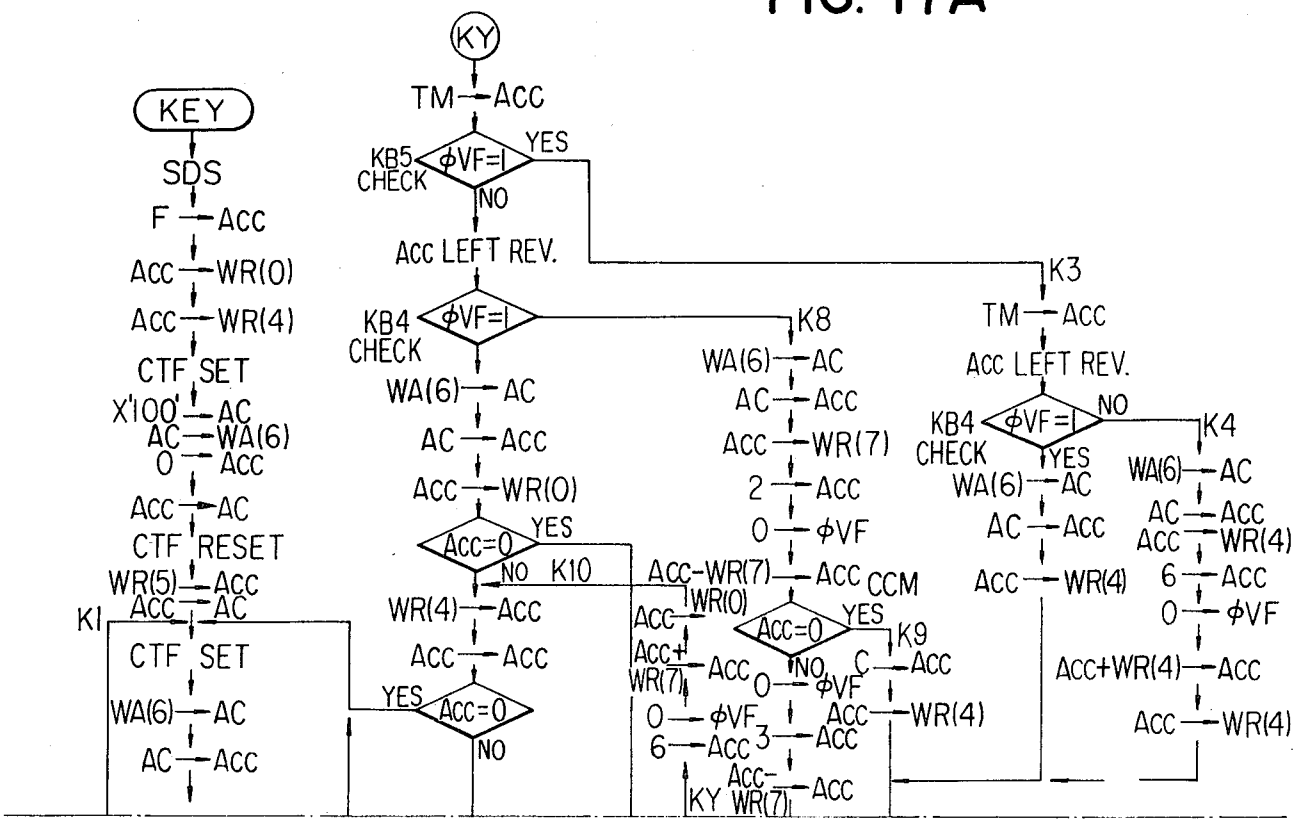
Figures 18, 18A:
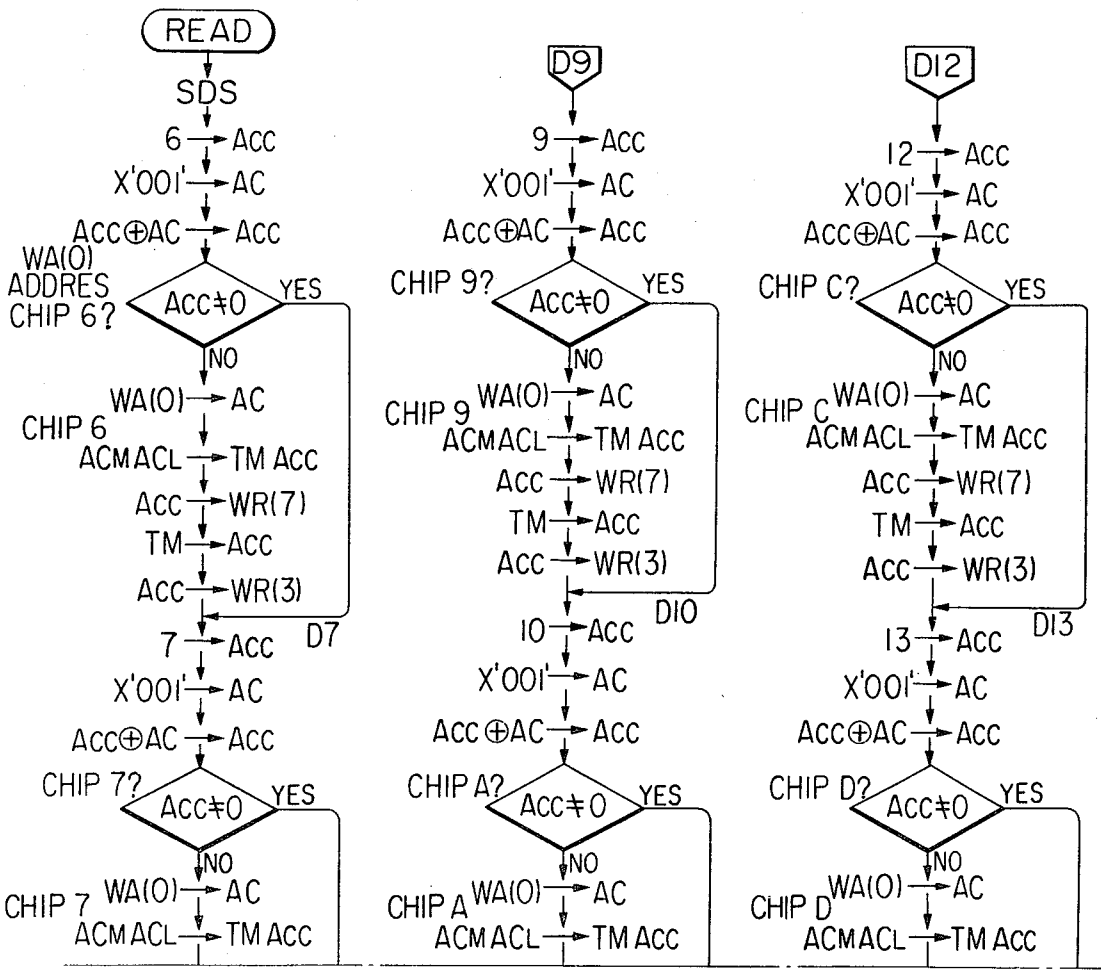
FIGS. 18 and 19 are flow charts for RAM READ sub-routine.
Figure 18B:
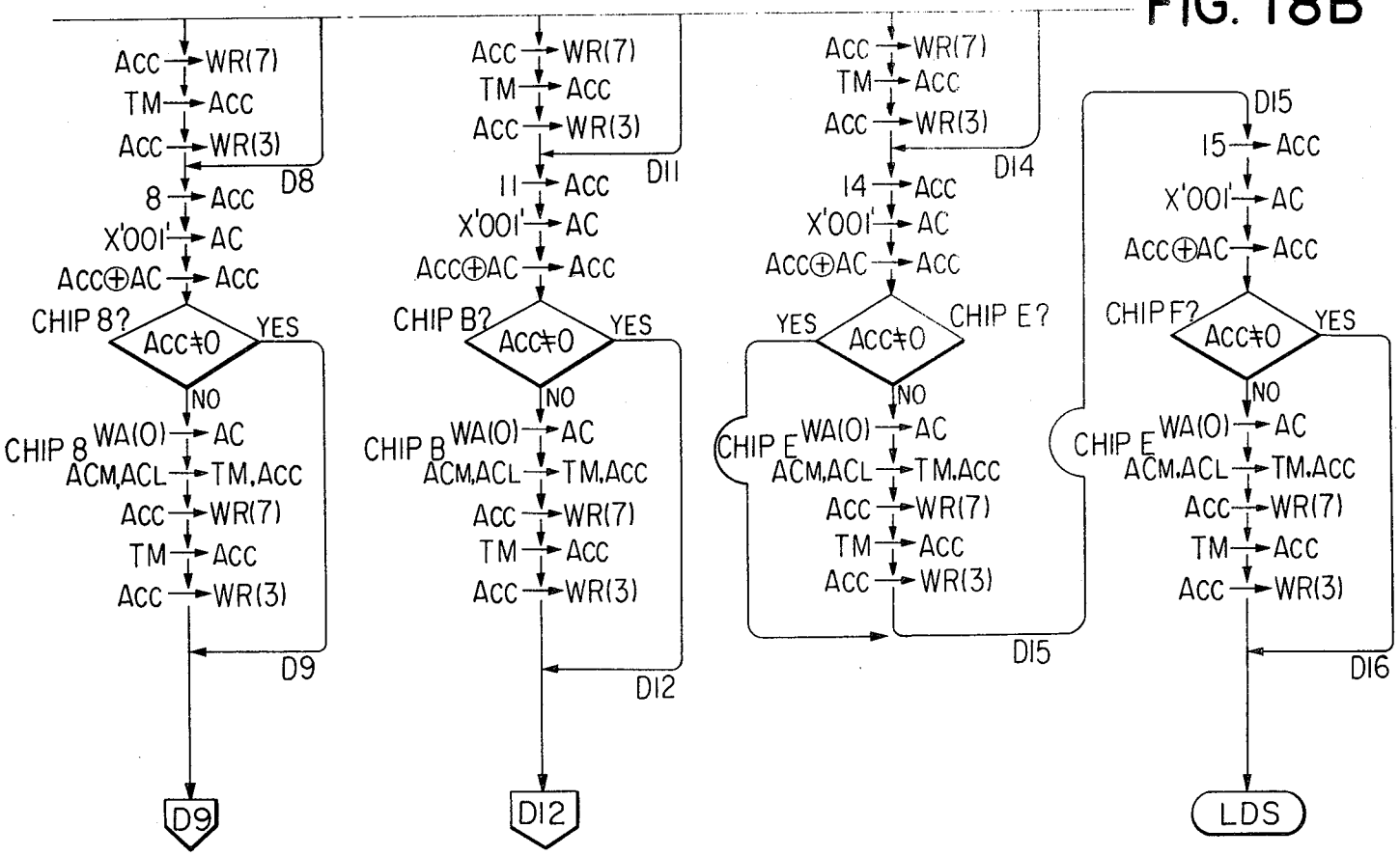

In Table 7, a symbol KEY denotes a codified program sub-routine for the key read-in shown in FIG. 7. A symbol READ denotes a codified program sub-routine in FIG. 18 for reading of WA(0) in RAM. A symbol READ 5 represents codified program sub-routine in FIG. 19 for reading of WA(5) in RAM. ORG represents a codified program sub-routine in FIG. 20 for determining the color of the original color to be designated by the LIST address in WA(5) of RAM. A symbol RAM signifies a codified program sub-routine in FIG. 21 for altering the data of WA(3) which designates a place where the data in WA(2) are transferred to other area in RAM. Both ODPY and CDPY represent codified program sub-routines in FIG. 22 for indicating the conversion color to the original image color. Explanations on the instruction codes can be found in the attached paper "NEC u COM-4 SYSTEM ABSTRACT". For the sake of ready reference, however, a part thereof as shown in FIG. 13 is tabulated in Table 9. In Table 9, a symbol PC denotes a program counter for step-forwarding ROM-1, which corresponds to the address.

TABLE 9-continued

| PC | Register CD instruction code | Content of AC | Register A | Remarks |
|---|---|---|---|---|
| 006 | 00 | X | X | " |
| 007 | 00 | X | X | " |
| 008 | 70 | X | ○ | " |
| 009 | 85 | 014 | ○ | Add 0 to address '014'of RAM |

In the above Table 9, the symbols PC X'000' to X'009' denote the operations for storing the data of '020' in WA(3) of RAM to set the key operation times to 0.

The following Table 10 indicates the process, in which the operations shift from the program main flow in FIG. 13 to the key read sub-routine KEY in FIG. 17, and again return to the program main flow.

The above Table 10 indicates that, in the main flow, the starting address for the key read sub-routine KEY is designated by X'019' and '01A' in PC, and that, after the key read, PC in the main flow again returns to X'01C' when PC is X'2B2.

TABLE 10

| | PC | AC | INSTRUCTIONS Register C | Register D | Register A | Remarks |
|---|---|---|---|---|---|---|
| KEY | 019 | X | 4 | 2 | X | Add '24B' to AC |
| | 01A | 24B | 4 | B | X | |
| AC ⇄ pc | 01B | 24B | E | 3 | X | Exchange contents of AC and PC |
| AC → WA(7) | 24B | 01C | 2 | F | X | Add content of AC to 01D, 01E, and 01F |
| 'F' → Acc | 24C | no change | 7 | F | F | Add F to register A |
| Acc → WR(0) | 24D | | 8 | 0 | F | |
| Acc → WR(4) | 24E | | 8 | 4 | F | |
| | ⋮ | | 7 | 0 | 0 | |
| Acc →WR(5) | 2B0 | 015 | 8 | 5 | 0 | Add 0 to address '015' of RAM |
| Acc →WR(0) | 2B1 | 000 | 8 | 0 | 0 | Add 0 to address '000' of RAM |
| WA(7) → AC<br>AC ⇄ SC | 2B2 | 01C | 3 | F | | |
| WR(0) → Acc | 01C | 000 | 6 | 0 | □ | Take out contents of address '000' into register A |

TABLE 9

| PC | Register CD instruction code | Content of AC | Register A | Remarks |
|---|---|---|---|---|
| X'000' | 70 | X (in-definite) | ○ | OTo register A |
| 001 | 82 | 008 | ○ | OTo address '008' |
| 002 | 40 | X | X | Add '020' to AC |
| 003 | 20 | 020 | X | in 2 steps |
| 004 | 23 | 00D → 00E → 00F | 0 → 2 → 0 | Add 0 to 00D; 2 to 00E, and 0 to 00F |
| 005 | 00 | X | X | Nothing done |

Figure 23:
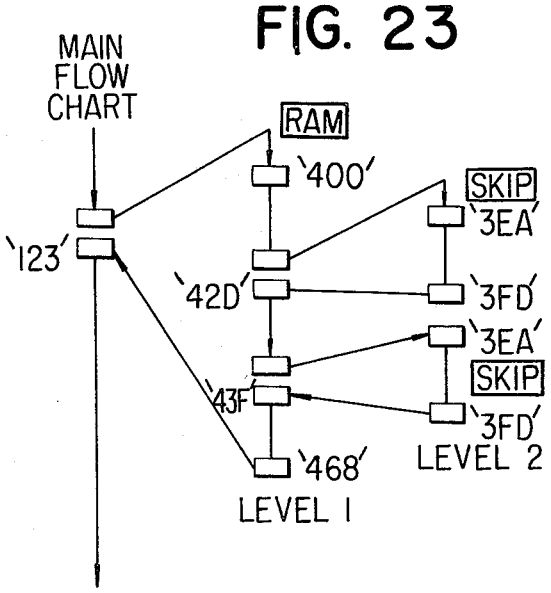
FIG. 23 is a diagram showing inter-relationship between the main flow chart and the sub-routine flow charts.

FIG. 23 shows an inter-relationship of the program wherein the shiftings from the main flow to the first sub-routine, from the first sub-routine to the second sub-routine, and back again to the main routine are indicated.

In the following, explanations will be given of a color reproduction apparatus, in which the afore-described color conversion device is incorporated.

Figure 24:
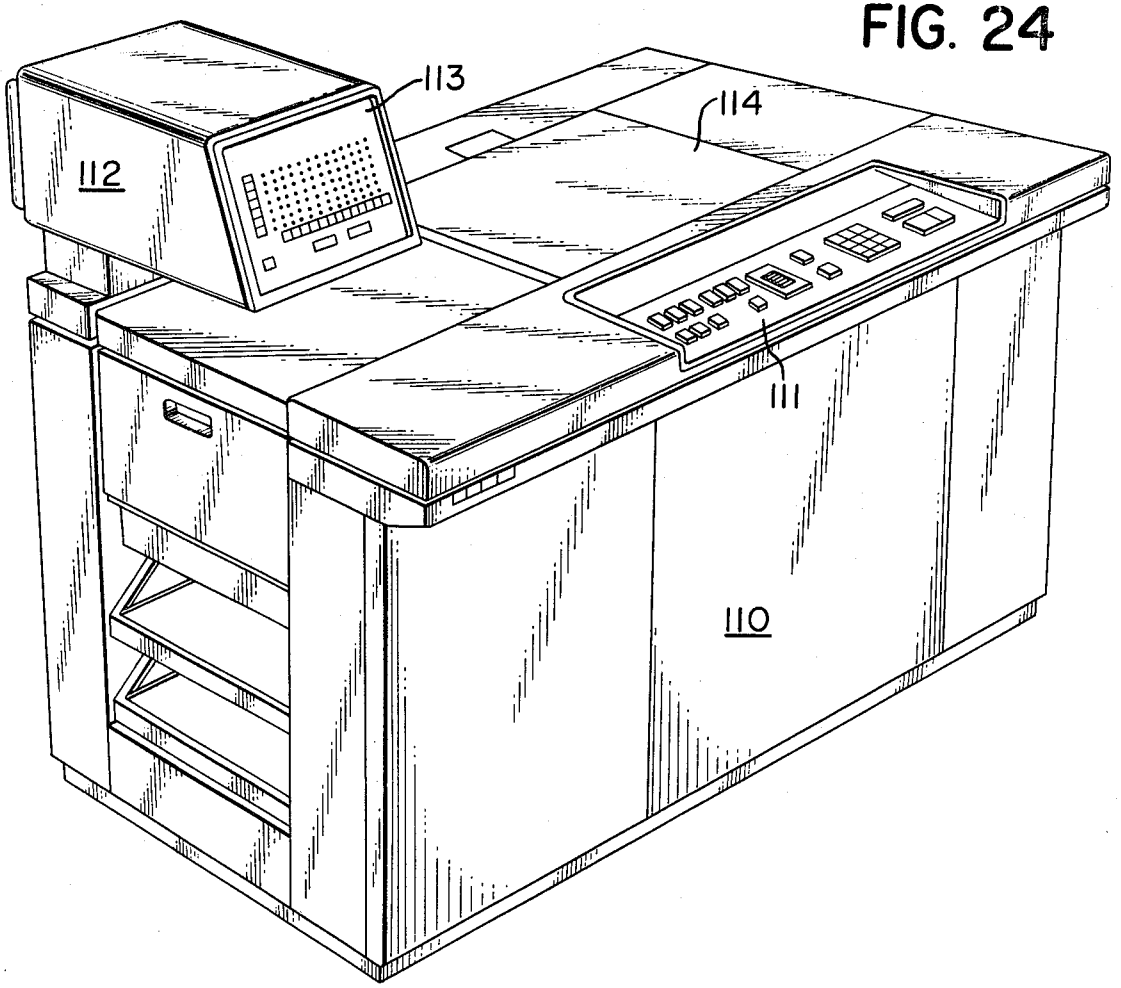
FIG. 24 is a general perspective view of the color reproduction apparatus according to the present invention.

Referring to FIG. 24 which shows a general perspective view of the color reproduction apparatus, a reference numeral 110 designates a main body of the reproduction apparatus, 111 refers to a display or indication section for the reproduction operation, 112 denotes a color converter for converting a particular original image color to a desired one, 113 a color conversion instruction panel, 114 an image original mounting table.

The display section is provided with keys for designating predetermined program modes such as full color mode, two-color mode, and mono-color mode; a copy start button; and a copy sheet number setting key.

Figure 25:
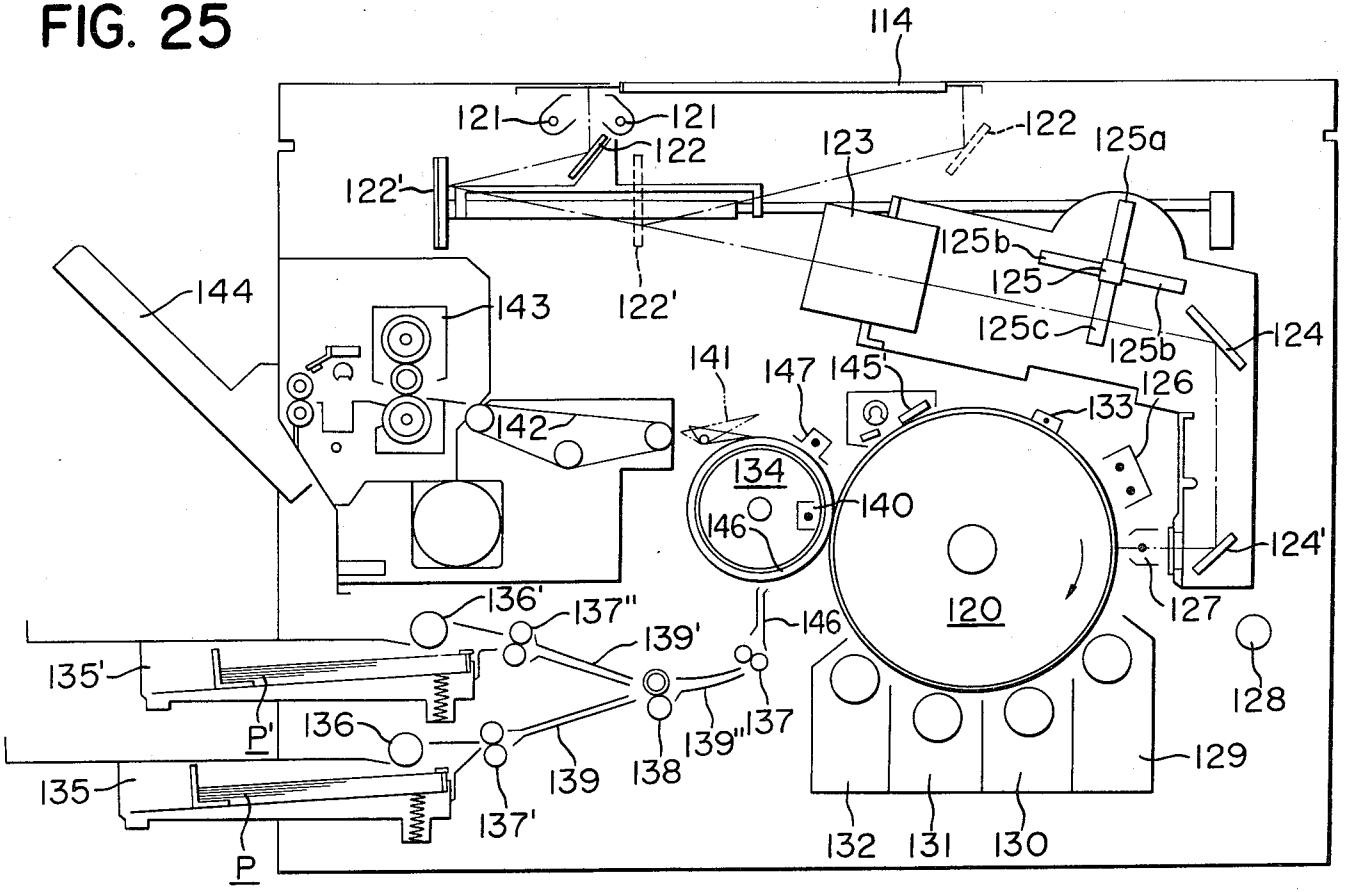
FIG. 25 is a cross-sectional view of the color-reproduction apparatus shown in FIG. 24.

FIG. 25 is a schematic cross-sectional view of the color reproduction apparatus shown in FIG. 24, in which a reference numeral 120 designates a photosensitive drum which rotates in an arrowed direction. 121 refers to an exposure lamp, 122, 122' denote movable mirrors, 123 a lens system, 124, 124' represent fixed mirrors, 125 refers to a filter assembly, in which four different filters **125*a*, 125*b*, 125*c*, and 125*d* are made interchangeable. A reference numeral 126 designates a primary electric charger, 127 a simultaneous charge remover, 128 an overall exposure lamp, 129 a Y developer, 130 an M developer, 131 a C developer, 132 a BK developer, 133 a precharge remover, 134 an image transfer drum, 135 a cassette, 136 a paper feeding roller, 137 a forwarding roller, 138 a timing roller, 139 a paper passage, 140 an image transfer charger, 141 a separating pawl, 142 a conveyor belt, 143 an image fixing roller, 144 a tray, and 145, 145'** cleaners.

First of all, the operations for the full color reproduction will be explained. When a copy button 150 (FIG. 26) is depressed, a main motor starts its operation, various electric chargers and exposure lamp 121 are turned on, and the photosensitive drum 120 and the image transfer drum 134 begin to rotate. The photosensitive drum 120 is positively charged by the primary electric charger. When the image transfer drum 134 performs idling rotation for two revolutions, reproduction paper P is fed out of the cassette 135 by the paper feeding roller 137.

On the other hand, the exposure lamp is turned on and, while it is being reciprocating between the mirror 122 and the lamp 121, it performs the first scanning of the image original. By this scanning operation, the image exposure and AC charge removal are carried out simultaneously through the color-separation filter 125a (in blue) to thereby form an electrostatic latent image in yellow on a photosensitive plate, the image contrast of which is increased by the overall exposure lamp 128. Then, this latent image is developed by the Y developer 129 to obtain a visible yellow image. In the meantime, the reproduction paper is forwarded in synchronism with the drum by means of the timing roller 138 so as to be wound around the image transfer drum 134 by means of a gripper 146. The yellow image is thus transferred onto the reproduction paper at the image transfer section. After the image transfer, the reproduction paper P is charge-removed by a paper charge remover 147, and the toner on the photosensitive drum 120 is removed by the cleaner 145. The mirrors 122, 122' and the exposure lamp 121 perform the reciprocating movement and return to their original positions.

Subsequently, when the second scanning operation is effected to the same original, the color-separation filter changes to green 125b, and an electrostatic latent image in M (magenta) is formed on the photosensitive plate. This latent image is developed by the developer 130 to obtain a visible magenta image. This magenta image is superposed on the abovementioned yellow image already transferred to the reproduction paper wound on the image transfer drum 134.

At the third scanning operation, the color-separation filter further changes to red 125c to form a latent image in cyan on the photosensitive drum. By developing this latent image in the developer 131, a visible cyan image is obtained, and the thus obtained visible image is again superposed on the reproduction paper on the image transfer drum 134.

After the three colors have been superposed, the separation pawl 141 arrives at a position shown in a solid line, and actuates to separate the reproduction paper on the image transfer drum 134. The reproduction paper P separated from the image transfer drum 134 is forwarded to the image fixing device 143 by means of the conveyor belt 142. After the image fixation, the reproduction paper is discharged into the tray 144 by the discharge roller. Incidentally, changing operation of the developers and the filters is described in detail in laid-open German patent application Pat. No. 2,459,108, to which reference may be had.

In the case of the two-color copying, the reproduction operations may be done for the selected two colors through the above-described process steps.

The start-to-end of the scanning operation is completed in one rotation of the photosensitive drum. Formation of the electrostatic latent image is performed in the half rotation of the photosensitive drum, one rotation of an insulating drum corresponding substantially to the half rotation.

In the case of mono-color, e.g., yellow copy, the copy start button 150 is depressed, whereupon the reproduction paper is immediately fed, while the exposure lamp and the electric charger are also simultaneously actuated to scan the image original. At this time, ND filter 125d is prepared for the colorseparation filter. In this consequence, there can be obtained on the photosensitive drum 120 an electrostatic latent image similar to that for black-and-white copying. However, since the developer 129 is in yellow, the resulting visible image is also in yellow. This visible yellow image is transferred onto the reproduction paper on the image transfer drum. The transfer paper bearing the image thereon is separated from the drum by the separating pawl 141. Then, the image is fixed by the image fixing device 142, and the image-fixed reproduction paper is finally discharged into the tray.

The color mode in the color reproduction apparatus according to the present invention includes a manual mode due to the color conversion designation, a two-color mode to form two particular two colors in the abovementioned full color mode on the image transfer paper, and a particular mode including mono-color mode, etc. which forms the image original on the reproduction paper in a particular color.

At first, when the G filter **125*b* is selected for the image exposure, and the M developer is selected for developing the latent image as well as for transfer of the toner image, then in the subsequent process, when R filter 125c** is selected and the Bk developer is selected for the image development to thereby transfer the first image on the image transfer drum, the black color in the image original can be reproduced in black, while the red color in the original can also be reproduced in red. In this consequence, in the case of the image original containing two colors of black and red such as in accounting ledgers, etc., the intended purpose can be sufficiently and quickly achieved in these two process steps. Also, when it is desired to print the image original in a single color (i.e., mono-color mode), e.g., black, the image exposure is performed through the ND filter (a filter for lowering light amount), after which the development is done in the Bk developer, whereby the original image can be sufficiently reproduced, and the copying cycle can be finished in a single process step. When it is desired to print a line, the image exposure is done by the ND filter, the development is done in the Y developer, thereafter the image exposure is done through the ND filer, and the development is carried out in the C developer, whereby the desired image in line can be obtained in two process steps. As stated in the foregoing, even in the case of the mono-color mode, there are two situations, wherein the process can be finished in a single step, and the process requires two steps. In other words, when the color of the developer and the color for the print are same, the single process step will suffice; on the other hand, when the color for the print can only be obtained by combination of the colors of the developer, more than one process step is required.

In the Step 8 in FIG. 12, for the three process steps, the scanning operation is performed until a relationship of WR(6)E is reached, and, for the two process steps, the scanning operation is performed until a relationship of WR(6)A is reached. The reason for this is that, when the printing is done in a particular color, a particular mode designation key is separately provided.

Figure 26:
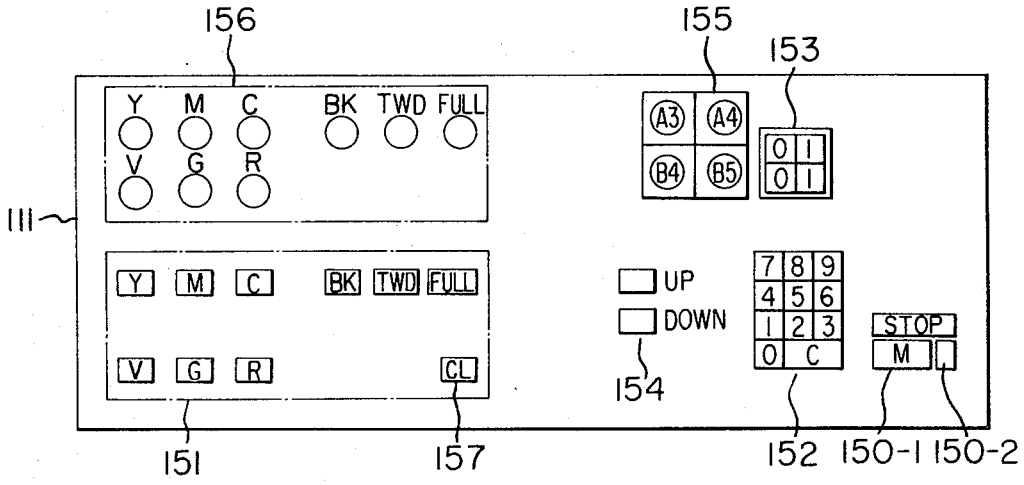
FIG. 26 is a plan view of the operating panel in the color-reproduction apparatus according to the present invention shown in FIG. 24.

In the present invention, these color modes are made to be selectable, in advance, with a single key designation. A section designated by a reference numeral 151 in FIG. 26 is for such operational purpose. In this operating panel, a symbol "FULL" refers to a full mode key, and symbol "TWO" refers to a two-color mode key. The rest of the keys are for reproduction of one specific color corresponding to the respective symbols indicated thereon. The following Table 11 indicates combination of the filter and the developer in these particular modes. In this Table 11, a letter "V" indicates a mono-color reproduction in purple.

TABLE 11

| | Copy mode | Developer to be used | Filter to be used | |
|---|---|---|---|---|
| | Full-color | Y | B | |
| | " | M | G | |
| | " | C | R | |
| | Two-color | M | G | |
| | " | BK | R | |
| | BK | BK | ND | |
| Single process step | Y | Y | ND | |
| | M | M | ND | |
| | C | C | ND | |
| | V | M | ND | Mono-color MODE |
| Two process step | V | C | ND | |
| | G | Y | ND | |
| | G | C | ND | |
| | R | Y | ND | |
| | R | M | ND | |

Incidentally, in FIG. 26, a reference numeral 150 designates a copy button, 150-1 a multiple copy button, 150-2 a single copy button, 152 a copy sheet number designation key, 153 an indicator thereof, 154 a cassette selection key, 155 selected cassette size indicators, and 156 selected color mode indicators.

Figure 27:
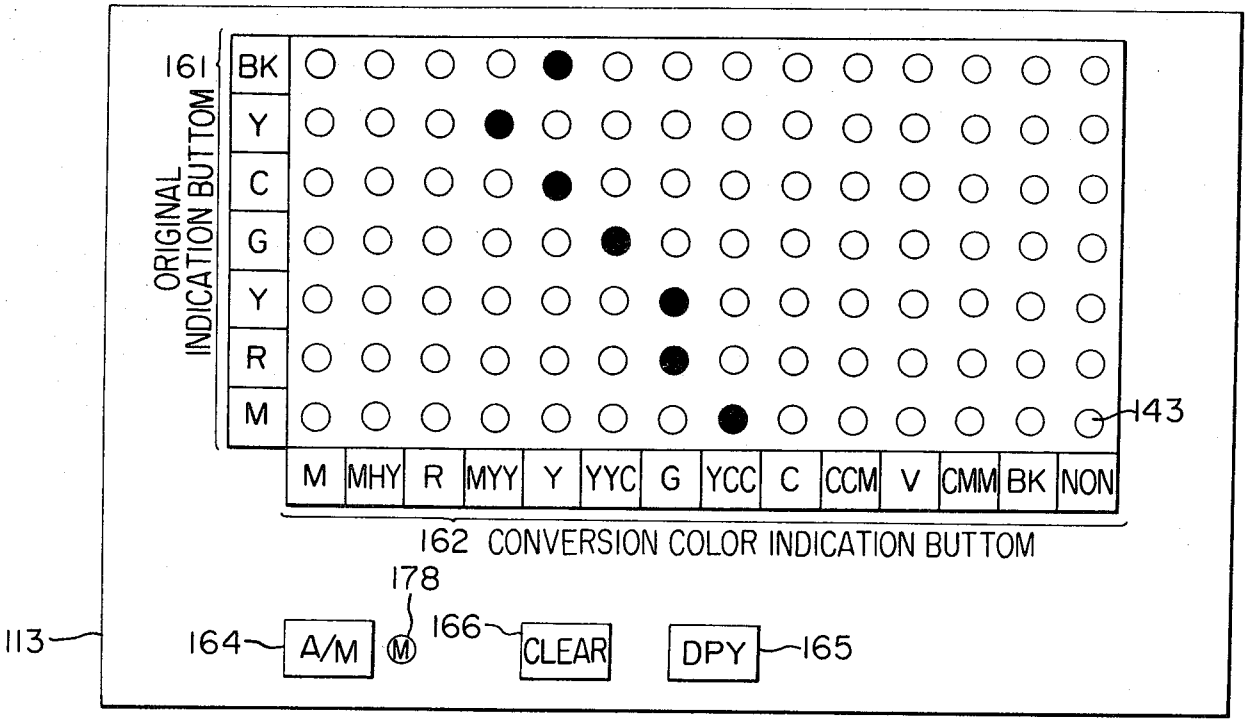
FIG. 27 is a plan view of the color-conversion instruction and indication section of the color-reproduction apparatus in FIG. 24.

FIG. 27 shows the color conversion designation section 113, in which a reference numeral 161 designates seven operating keys for designating the particular colors in the image original, 162 desired color conversion designation keys, 163 indicators for indicating convertibility of desired colors at the intersection of the respective keys 161 and 162, 164 a selection key for determining whether the color conversion is to be performed on the basis of the color indication or the color reproduction is to be done by the mono-color mode keys in FIG. 26, 165 a DPY key which inputs termination of the color conversion designation by the keys 161 and 162, 166 a key for clearing a designation input when the color conversion designation is mistakenly done. Solid black dots on the indicators 143 in FIG. 27 indicates the original image color and the conversion color corresponding to the original color.

Figures 28, 28A:
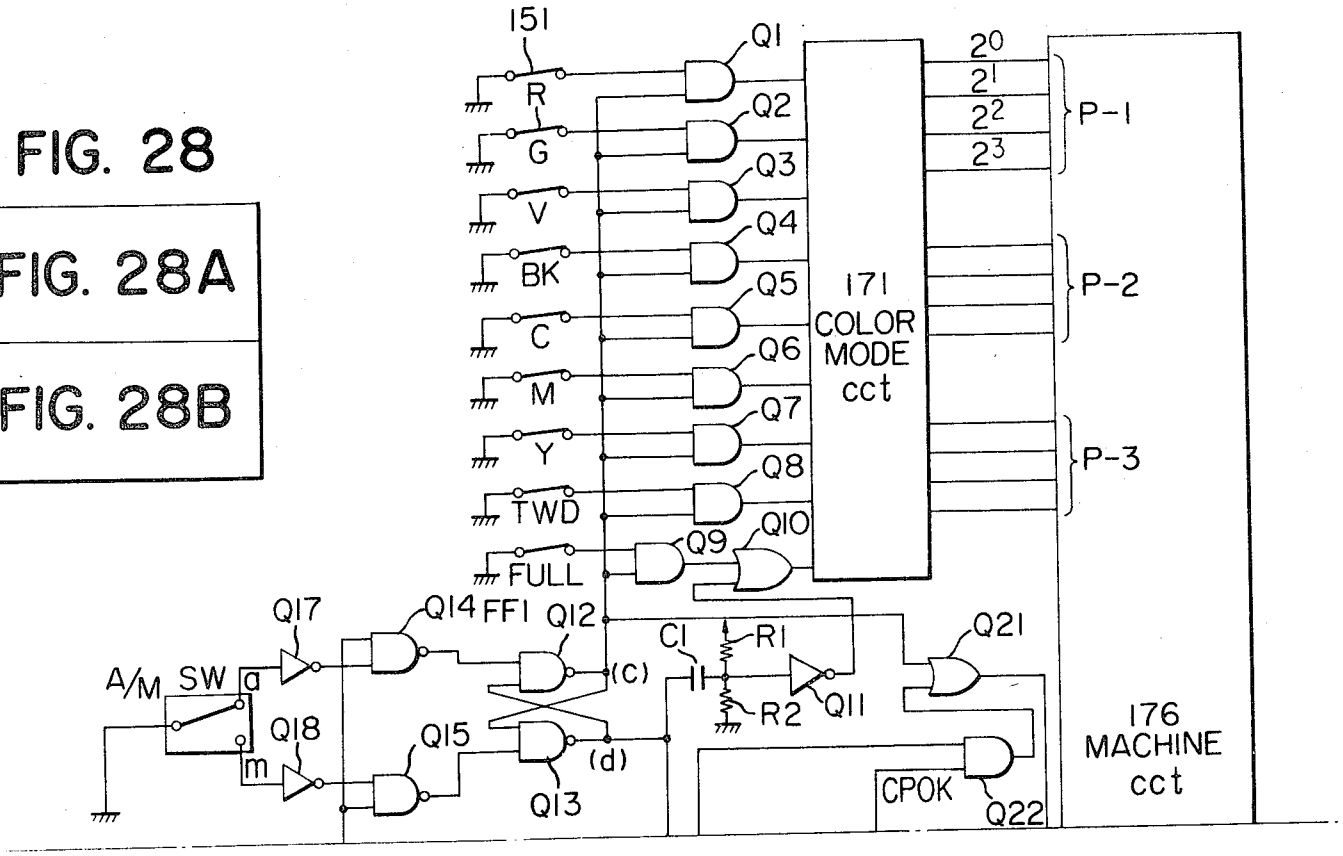
FIG. 28 is a first embodiment of a circuit for change-over of the color-mode designation and the color conversion designation.
Figure 28B:
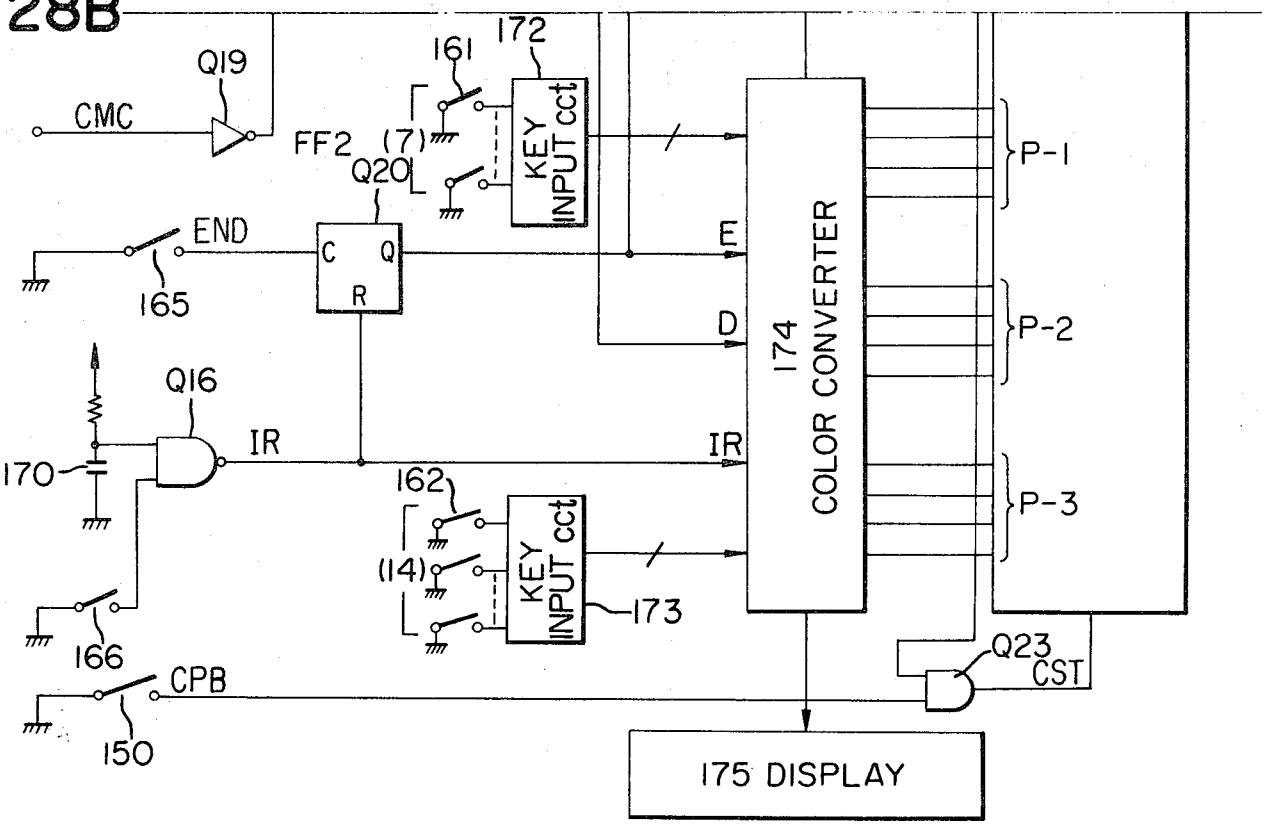
Figure 29:
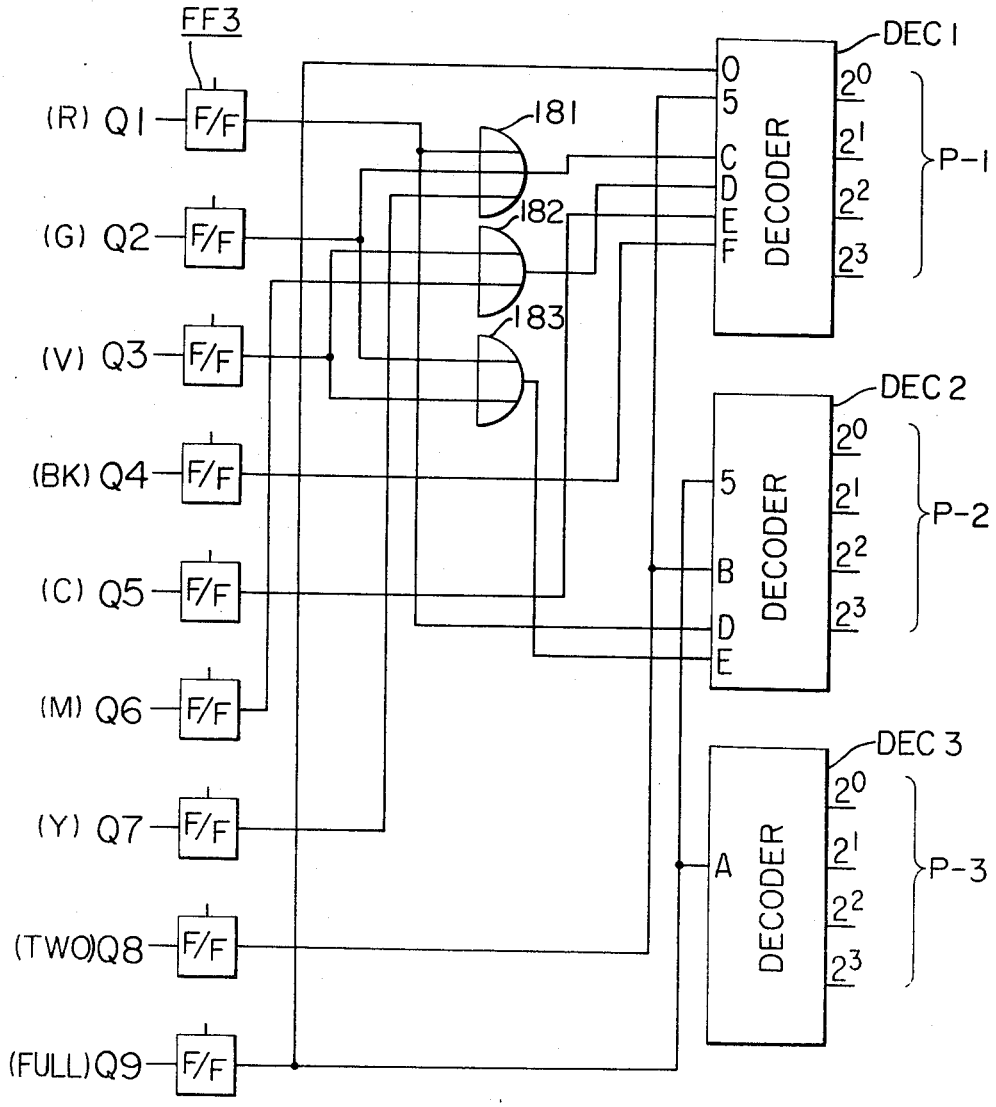
FIG. 29 is a wiring diagram for a circuit 171 shown in FIG. 28.

FIG. 28 illustrates one embodiment of the control circuit for the color mode selection and the color conversion according to the present invention. In the drawing, those parts designated by the same reference numerals as in FIGS. 26 and 27 are the same component parts. 151 refers to switches for the color mode designation key, which are opened by turn-on of the key. 161 designates seven switches corresponding to the original color designation keys for the color converter. 162 refers to a switch corresponding to the conversion color designation key, which is closed by turn-on of the key. CPB designates a signal due to turning-on of the copy button 150, and IR is a reset signal for the circuit, which can be obtained by a pulse at the time of closure of the power source by a capacitor 170 or turning-on of a clear key 166. A/M refers to a change-over switch for changing over between the color mode selection of the image original and the color conversion designation in the color converter, wherein, when the switch is on the contact a, it functions as the color mode selection, and when it is on the contact m, it works as the color conversion designation. CMC is a signal to indicate that the copying operation is being done, and can be obtained during execution of the reproduction process. END is a signal which is obtained by tuning-on of the DPY key 165 which performs display of the result of the color conversion, and indicates termination of the conversion. 171 refers to a color mode circuit which selects combinations of the filter and the developer corresponding to the mode by means of the color mode designation key 151, and produces outputs in the form of binary codes, the details of which are shown in FIG. 29. 172 and 173 designate key input circuits which produce 1, 0 output signals into the color conversion circuit 174 by the color conversion designation key 162 and the original color designation key 161. 175 refers to a display or indication circuit for indicating the convertible original colors on the indicator device 143 in FIG. 27. These key input circuits 172, 173 corresponds to the circuit in FIG. 9. The color conversion circuit 174 correspond to the circuits in FIGS. 5 and 6. The display circuit 175 corresponds to the circuit in FIG. 7.

Each of the circuits 171, 174 produces three kinds of 4-bit filter-developer combination signals. An output of P-1 is a combination signal which is necessary at the time of the first revolution of the photosensitive drum, wherein an output signal corresponds to a combination of Y-B for D/F, i.e., the output signal is produced wherein the terminal at the full color mode in the circuit 171 is all zero. Another output of P-2 is such signal that produces 0110, at the second revolution of the photosensitive drum. The other output of P-3 is such signal that produces an output of 1010 at the third revolution of the photosensitive drum. The same applies to the circuit 174 with regard to these outputs P-1, P-2, and P-3, wherein the original color R is instructed to be converted to G by means of the keys 161, 162, the original color Y to C, and the original color G to V, whereupon there are produced the filter-developer combination output signals of B-C for D/F as the output P-1, G-Y for D/F as the output P-2, and R-M for D/F as the output P-3. These outputs are the binary codes of 2, 4, and 9. The combination of the filter and the developer follow the numerical codes shown in FIG. 4.

The circuit 176 is a machine circuit having such functions that it sequentially takes thereinto the P-1, P-2 and P-3 code signals at every one rotation of the photosensitive drum to change over the developers and filters as designated by these output signals, and that it starts rotation of the photosensitive drum and exposure of the image original by a copy start signal CST.

The operation of this circuit will now be explained hereinbelow. The A/M switch is turned to the side a. If the copy operation signal CMC is at a low level, a flip-flop (consisting of gates Q12, Q13) is set by an output from a NAND gate Q14, whereby the terminal C is brought to a state H at a TTL level. Since the signal input has been introduced into one of the AND gates Q1-Q9, it receives any of the off state in the key 151. When the full-color mode is selected, the H signal input is introduced into the last input terminal of the circuit 171 through the AND gate Q9 and the OR gate Q10. The output from the circuit 171 determines the full-color mode, and produces an output code 0 to P-1, 5 to P-2, and A to P-3.

Also, since the C terminal output of the flip-flop is introduced as an input into an AND gate Q23 through an OR gate Q21, the H signal of CPB, when the copy button 150 is turned on, is introduced as an input into the machine circuit 176 as CST, thereby starting the process operations. When the first rotation for cleaning of the photosensitive body begins after the pre-rotation, the B filter is set by the output P-1 followed by setting of the developer Y, whereby the exposure scanning commences. The same timing applies to P-2 and P-3.

The AND gates Q1 to Q9 are connected to the color mode indicator 156 through the circuit 171 including the latch circuit, and are turned on by depression of the key 151. This latch circuit is set by the clear key 157 or a signal at the time of power source closure (an output of the capacitor 170).

Since the outputs from the AND gates Q1 to Q9 are latched by the circuit 171 when the copy button is again turned on after completion of reproduction of predetermined numbers of copy sheet by changing the image original and without turning on the key 151, the copying operation is done in accordance with the previously set full-color mode. After completion of the copying operation, when the clear key 157 is turned on to close the Bk key of the key 151, the output P-1 is produced by an output from the gate Q-4 to execute the copying operation in black and white mode. During this Bk mode, input of P-2 and P-3 is prohibited.

After completion of the copying operation, when the A/M switch is turned to the side of m, the flip-flop FF1 is reset through an inverter Q18 and a NAND gate Q15, whereby the outputs from the terminals C and d are codified into "O" and "1", respectively, and all the LED's in the indicators 143, which enables the operation of the color conversion circuit 174 to be operated, are turned on. Then, when the original color to be converted into red is designated to R by the key 161, and the conversion color is designated to G by the first key 162, there can be selected a number of combinations of the first, second, and third D/F's by the circuit 174. In the meantime, convertible colors of the image original other than R are indicated on the indicators 143 through the indication circuit 175. When the second key designation is done by this indication so as to change Y to C, at least the combination of B-C for D/F is established, whereby several combinations of the first, second, and third D/F's including the combination of B-C for D/F is again selected. By this second key designation, the convertible colors of the original other than R and Y are indicated on the indicator 163 through the indication circuit 175. When the third designation to change G to V is effected on the basis of the abovementioned indication, there is established the remaining R-Y and R-M for D/F, and the combinations of the first, second, and third D/F's are determined. By this third designation, the conversion colors of the image original other than R, Y, and G are indicated on the indicators 143 through the indication circuit 175. Thereafter, when the DPY key 165 is turned on the flip-flop FF2 is set, and its output is introduced as an input into the circuit 174, thereby producing an output combination signals from P-1 to P-3.

Where there is no erroneous key designation by the keys 161, 162, i.e., where there is no key operation corresponding to the portion of the indicator 143, in which no indication is given, the signal CPOK is "1", so that the output from the flip-flop FF2 is introduced as an input into Q23 through the gates Q22, Q21. Accordingly, when the copy button is turned on, the reproduction operation commences with an output of the signal CST. When it is desired to effect the color conversion again, the clear key 166 is depressed, whereupon a reset signal IR output is produced from the NAND gate Q16. By this output, the flip-flop FF2 is reset to reinstate the conversion circuit 174 to its original state, all of the indicators 143 are turned on by the indication circuit.

When the change-over switch A/M is changed over from m to a, the selection mode by the conversion circuit 174 is cleared, and the color mode of the main body is automatically set in the full-color mode through a differentiation circuit composed of a capacitor $C_1$ and resistors $R_1$, $R_2$, and an OR gate Q10. That is, by trailing of the output terminal d from "1" to "0", a pulse input is introduced into the circuit 171. As the consequence, when the copy button is turned on, CST is produced by Q23, and the copying operation in the full-color mode commences. Incidentally, those keys other than the A/M switch is of the self-return type, which returns to its original state when the operator removes his finger therefrom. The change-over of the A/M switch to the side of m by the signal D from the flip-flop FF1 is indicated on the indicator 178. FIG. 6 is the detailed circuit 171 in FIG. 5, in which FF3 designates a flip-flop to latch an input from the gate Q. This flip-flop is reset by the clear key 157 and power source closure. DEC1, DEC2, and DEC3 designate respective decoders to convert input terminals in FIG. 4 indicating the combinations of the first, second, and third D/F's into codified signals with emphasis of 1,2,4, and 8 being given to each of them respectively. 180 to 182 refer to OR gates.

The signal D due to the change-over to m of the A/M switch is equal to the power source closure for the circuit 174. The signal E due to the DPY key is equivalent to the keys for indicating combinations of the filters and the developers. CPOK is a signal which detects tht the indicators 143 are turned on for each line (original color).

As stated in the preceding, the embodiment according to the present invention has made it possible to designate the color mode by the change-over switch and to arbitrarily change the color conversion designation. Further, when the A/M switch is turned to the side of m during the copying operation so that the flip-flop FF1 may be reset (i.e., when the terminal m and the input terminal Q13 of the flip-flop FF1 are connected), the color conversion designation becomes possible even during the copying operation. In other words, the color conversion designation is effected during the copying operation, the combination of the developer and the filter as designated is stored, and then the designated combination is taken into the machine circuit 176 by means of the copy button, whereupon the copying operation due to the designated combination becomes feasible. Conversely, it is also possible to designate a particular mode with the color conversion mode during the copying operation. This can be realized by a circuit as shown in FIG. 30.

Figures 30, 30A:
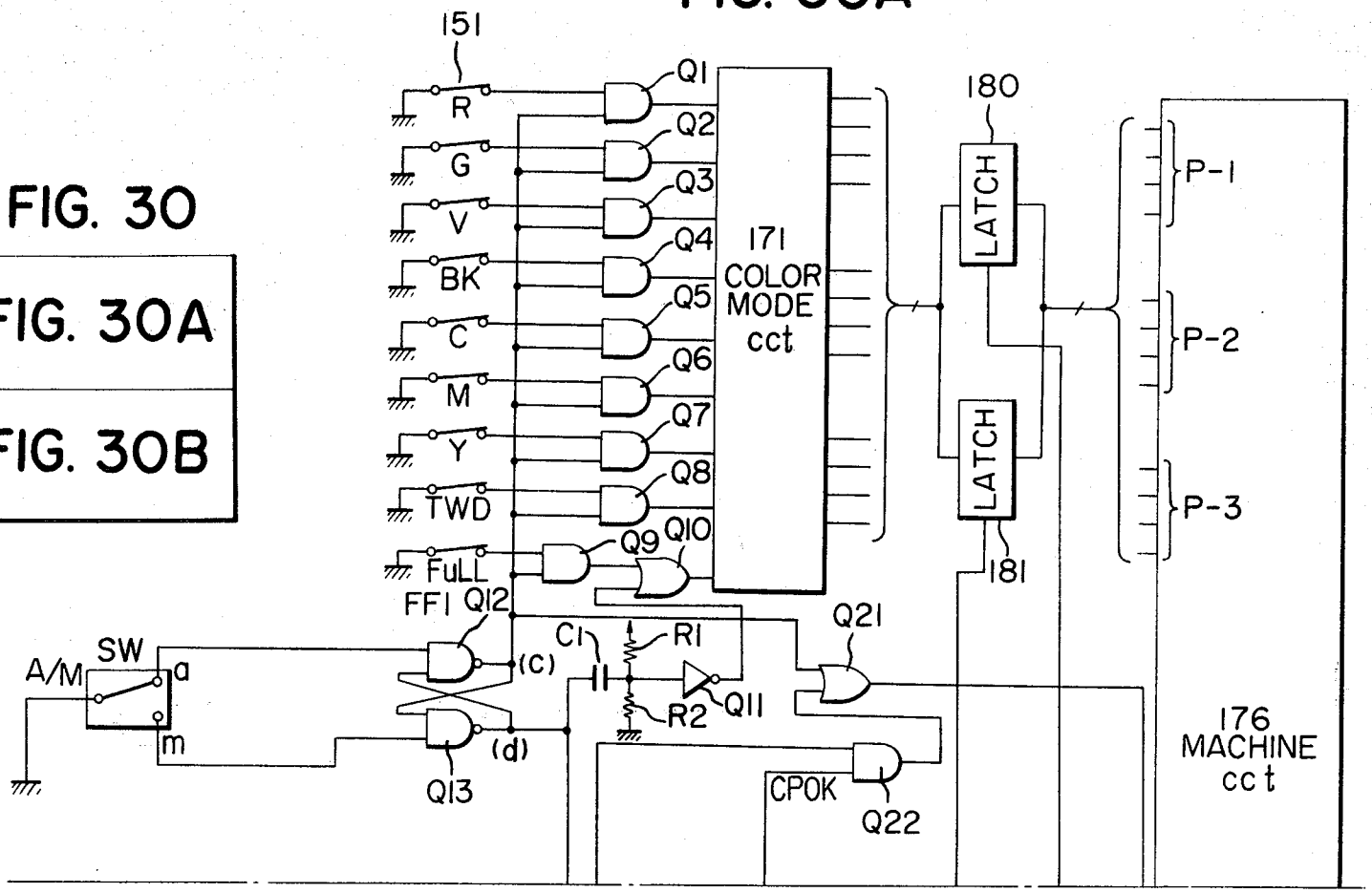
FIG. 30 is a second embodiment of the circuit for change-over of the color-mode designation and the color-conversion designation.
Figure 30B:
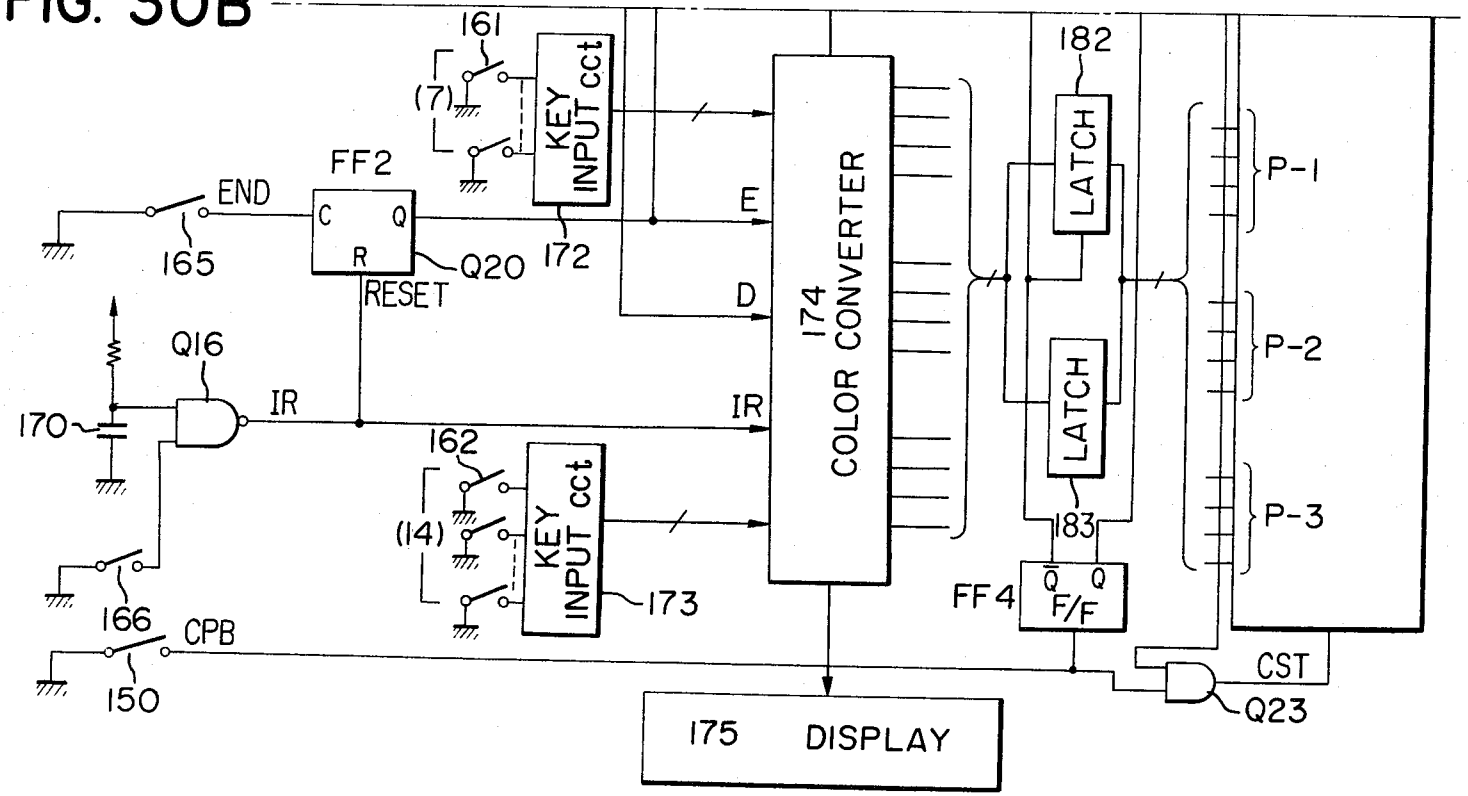

In FIG. 30, reference numerals 180, 181, 182, and 183 respectively designate latches to temporarily store therein 171 and 174. They are controlled by the flip-flop FF3. In other words, these latches forward output signals to the machine circuit 176 when the output terminals Q,Q of the flip-flop FF3 takes a level "H" to prohibit input from the circuits 171 and 174. When the level is "L", the latches permit inputs from the circuits 171 and 174 to prohibit outputs to the machine circuit 176.

The operations of the circuit will now be explained hereinbelow. First, when the change-over switch A/M is connected to the side of a, the terminal C of the flip-flop FF1 takes the level "H", whereby the particular mode designation button is selected and the designated content is introduced as an input into the latch 180, for example. Here, when the copy button is depressed, the output of the flip-flop FF3 is reversed, and the content of the latch 180 is forwarded as the output, to the machine circuit 176, whereby the copying operation is performed in such particular mode. During this copying operation, when the change-over switch A/M is connected to the side m, the color conversion mode designation becomes possible. After completion of the color conversion designation when the END signal output is produced, it is read in the latch 182. After completion of the abovementioned particular mode copying, when the copy button is again depressed, the flip-flop FF3 is reversed, and a signal from the latch 182 is introduced into the machine circuit as an input, whereby the copying operation in the color conversion designation (manual) mode is effected. Further, when the color conversion designation is effected during a particular mode copying by changing over of the switch A/M, and, after this particular mode copying, the change-over switch A/M is again connected to the side a, the color conversion designation circuit 174 is reset, because the output terminal d of the flip-flop FF1 takes the level "L", and, at the same time, the content of the latch 182 is extinguished. At this time, the terminal c of the flip-flop FF1 takes the level "H" to enable the particular mode designation to be effected. Furthermore, the latch 181 is in a readable condition, so that if any one of the designation buttons is depressed to turn on the copy button, the content of the latch 181 is introduced as an input into the machine circuit 176, whereby the copying operation in the particular mode becomes possible. It is further possible to designate the subsequent color conversion during the copying operation due to the color conversion. First of all, the initial color conversion designation is terminated, and code signals of the combinations of the first, second, and third D/F's are forwarded as the outputs to the latch 182 from the circuit 174. Next, when the copy button is depressed, the abovementioned combination code signals in the latch 182 are produced as the output, whereby the copying opertion commences. At this point, the clear button 166 is depressed to dissolve by a signal IR the combination of the color conversion which has been determined by the circuit 174 and is being under execution. In this occasion, since the initial combinations of the first, second and third D/F's have already been forwarded as the outputs into the machine circuit the copying operation is being effected as it is. Since the circuit 174 has been reset by the signal IR, the subsequent color conversion designation is possible. When the designation is terminated, the subsequent combination code signals of the first, second and third D/F's are forwarded as the outputs into the latch circuit 183. When the previous copying operation is completed, and the copy button 150 is again depressed, the code signals within the latch circuit 183 are forwarded as the outputs into the machine circuit 176, whereby the subsequent reproduction starts. The same is applicable when a particular mode designation is effected during the copying operation in the manual mode due to the color conversion, or a subsequent particular mode designation is effected during copying of the particular mode. Therefore, the detailed explanations for these instances are dispensed with.

As stated in the foregoing, the reproduction apparatus according to the present invention is capable of instructing the subsequent copying operation during the previous copying operation, and also capable of readily changing the designation after such subsequent copying operation has been designted, hence it is extremely effective in practical use.

Further, the present invention contributes to exand the function of the color reproduction apparatus to a remarkable extent, so that it can have increased utility in various fields such as graphic design arts, and so forth. The apparatus is furthermore applicable to a display using a CRT, etc.

It should be noted that the color reproduction apparatus according to the present invention as described in this specification is of such a type that the image is transferred onto image transfer paper. However, the invention is of course applicable to a reproduction apparatus of a type, in which a sheet containing therein color developer is directly exposed to form a desired color image. Furthermore, the color conversion device according to the present invention is also applicable to fields such as color printing industries and display techniques using image pick-up tubes, and so forth, where the color reduction method is utilized for color formation.

What we claim is:

1. A color conversion display apparatus, comprising in combination:

(a) color designation means for converting a particular color in a plurality of original image colors into another particular color;

(b) memory means which store therein combination information related to the operation of color forming means to convert the particular original image color to the other color; and (c) means for indicating possible conversions of the remaining colors in the image original due to combinations of the color forming means in the color conversion of the particular original image color designated by said designation means.

2. The apparatus as claimed in claim 1, further comprising means for disenabling the color conversion when the color conversion designation means exceeds a particular number of times.

3. A method for displaying a color conversion comprising steps of:

(a) selecting combinations of color-forming means from memory means having information stored therein as to possible combinations of the color-forming means for converting a particular original image color into another particular color by designation of the color conversion, wherein the particular color of a plurality of original image colors and a particular color to which the particular original color is to be converted, are designated; and (b) indicating, by said combinations of the color-forming means, to what colors the remaining original image colors other than that designated will be converted.

4. A method for color reproduction comprising steps of:

(a) selecting combinations of light separating filters and developing agents from memory means having stored therein information on the possible combinations of the filters and the developing agents for use converting a particular original image color into another particular color by designation of the color conversion, wherein the particular color of a plurality of original image colors and a particular color to which the particular original color is to be converted, are designated; and (b) after completion of selection of the combinations, selecting the optimum combination of the filter and the developing agent out of the said possible combinations to effect the color reproduction.

5. The method as claimed in claim 4, further comprising the step of indicating, by the said combinations, to what colors the remaining original image colors other than that designated will be converted.

6. The method as claimed in claim 4, further comprising steps of selecting the combinations of the predetermined developers and filters by selection of a particular color mode, and effecting the color reproduction by the selected combination of the filter and the developer.

7. A color reproduction apparatus comprising:

(a) color separation means for separating original image colors;

(b) color forming means to form colors based on a light image which has been color-separated by said color separation means; wherein said color forming means is for forming at least three colors and for forming other colors from combinations of said three colors;

(c) key input means for designating color conversion to any arbitrary original color, said key input means being capable of designating said other colors produced by said color forming means as original colors; and (d) control means for controlling the color separation means and the color forming means to effect color conversion of the original image color designated by said color conversion designation means into a designated conversion color.

8. A color reproduction apparatus comprising:

(a) color separation means for separating original image color;

(b) color forming means for forming colors based on a light image which has been color-separated by said color separation means;

(c) color conversion designation means for designating color conversion to any arbitrary original color;

(d) control means for controlling the color separation means and color forming means to effect color conversion of the original image color designated by said color conversion designation means into a designated conversion color; and (e) conversion color retrieving means for retrieving convertible colors in the original image colors other than that designated by said color conversion designation means.

9. The apparatus as claimed in claim 8, further including indication means for indicating colors into which the original colors, other than the designated colors may be converted, by a retrieved output of said retrieving means.

10. The apparatus as claimed in claims 8 or 9, wherein said color conversion designation means is capable of designating conversion colors of the original colors, other than that designated by said color conversion designation means, on the basis of a retrieved output of said retrieving means.

11. The apparatus as claimed in claim 7, wherein said color separation means comprises color separation filters, and said color forming means comprises color developers.

12. The apparatus as claimed in claim 8, further including combination retrieving means for retrieving several of said combinations of said color separation means and said color forming means from said possible combinations thereof.

13. The apparatus as claimed in claim 12, further including combination indication means for indicating combinations of said color separation means and said color forming means.

14. A color reproduction apparatus comprising:

(a) color separation means for separating original image colors;

(b) color forming means for forming colors based on a light image which has been color-separated by said color separation means;

(c) color conversion designation means for designating color conversion to any arbitrary original color; and (d) control means for controlling the color separation means and the color forming means to effect color conversion of the original image color designated by said color conversion designation means into a designated conversion color, said control means being capable of controlling in such a manner that any arbitrary original image color may not be reproduced.

15. The apparatus as claimed in claim 12, wherein said control means selects the least numbers of the combinations out of said various combinations capable of performing the color conversion designated by the color conversion designation means.

16. The apparatus as claimed in claim 8, wherein said color conversion designation means comprises an original color designation portion which designates the original image color and a conversion color designation portion which designates the conversion color.

17. The apparatus as claimed in claim 9, wherein said display means indicates the original image color and the conversion color in the form of a matrix.

18. A color reproduction apparatus comprising:

(a) processing means which executes reproduction processing, and forms a color image on an image transfer body;

(b) color separation means which separates original image colors;

(c) color developing means having at least three color developing agents which form colors with respect to a light image which has been color-separated by said color separation means;

(d) key input means which designate color conversion to any arbitrary original image color, said key input means being capable of designating colors other than said three colors produced by said color developing means as original colors; and (e) control means for controlling the color separation means and the color developing means to effect the color conversion of the original image color designated by said color conversion designation means into the conversion color.

19. A color reproduction apparatus comprising:

(a) processing means which executes reproduction processing, and forms a color image on an image transfer body;

(b) color separation means which separates original image colors;

(c) color developing means having at least three color developing agents which form colors with respect to a light image which has been color-separated by said color separation means;

(d) color conversion designations means for designating color conversion to any arbitrary original image color;

(e) control means for controlling the color separation means and the color developing means to effect the color conversion of the original image color designated by said color conversion designation means into the conversion color; and (f) plural particular color mode designation means for designating a predetermined color mode without requiring a color conversion designation.

20. The apparatus as claimed in claim 19, wherein one of the particular color modes is a full color mode which makes a copy of the original image color in substantially the same color.

21. The apparatus as claimed in claim 19, wherein one of the particular modes in a mono-color mode which makes a copy of the original image color in a single color.

22. The apparatus as claimed in claim 19, wherein one of the particular color modes is a two-color mode which makes a copy of the original image color in substantially the same colors, for which two particular colors are selected.

23. The apparatus as claimed in claim 21, wherein said one color is obtained by combination of the colors of the color developers.

24. The apparatus as claimed in claim 22, wherein said two colors are red and black.

25. The apparatus as claimed in claim 19, further including color mode indicating means which indicates the color mode as designated from said plurality of color modes.

26. The apparatus as claimed in claim 19, further including change-over means which changes over said color conversion designation and said color mode designation.

27. The apparatus as claimed in claim 19 or 26, wherein said control means prohibits designation by said color mode designation means during the color conversion designation by said color conversion designation means.

28. The apparatus as claimed in claim 19, wherein said control means prohibits starting of reproduction until said color conversion designation is terminated.

29. The apparatus as claimed in claim 19 or 28, further comprising cancelling means to cancel said color conversion designation.

30. The apparatus as claimed in claim 29, wherein, when the color conversion is cancelled by said cancelling means, one of said particular color modes is selected.

31. The apparatus as claimed in claim 19, wherein said control means prohibits said particular color mode designation during execution of the reproduction.

32. The apparatus as claimed in claim 19, wherein a subsequent color conversion designation is made possible by said color conversion means during execution of reproduction.

33. The apparatus as claimed in claim 19, wherein the subsequent particular color mode designation is made possible by said particular color mode designation means during execution of reproduction.

34. A reproduction apparatus comprising:

(a) processing means for forming an image on an image on a recording medium including exposing the recording medium to light from an image original, wherein said processing means is operable in a plurality of modes;

(b) input means for entering control information including the exposure mode information, said input means permitting the entry of an exposure mode during the copy operation of said processing means different from the exposure mode in which said processing means has been operated; and (c) control means for controlling said processing means so as to operate during a subsequent copy operation in the exposure mode which was entered by said input means during the previous copy operation.

35. The apparatus as claimed in claim 34, wherein said processing means has a plurality of color-separation filters, and said plurality of exposure modes are differentiated by selection of said color separation filters.

36. A color reproduction apparatus comprising:

(a) image original exposure means to irradiate light onto an image original;

(b) color separation means to color-separate the original image colors into at least three colors;

(c) color image forming means to form color images of at least three colors corresponding to the light image which has been color-separated by said color separation means on an image carrier;

(d) a plurality of color conversion designation means to designate conversion colors with respect to arbitrary original image colors out of a plurality of the original image colors;

(e) selection means which selects at least one set out of combinations of one color of three colors separated by said color separation means and one color of three colors formed by said color image forming means on the basis of designation by said color conversion designation means; and (f) control means which controls said color separation means and said color image forming means based on selection by said selection means.

37. The apparatus as claimed in claim 36, further including conversion color retrieving means which retrieves colors, to which the original image colors other than that designated by said color conversion designation means may be converted.

38. The apparatus as claimed in claim 37, further including indication means to indicate, by a retrieved output of said retrieving means, those colors, to which the original image colors other than that designated may be converted.

39. The apparatus as claimed in claim 37 or 38, wherein said color conversion designation means is capable of designating the conversion color to the original image colors other than that designated by said color conversion designation means.

40. The apparatus as claimed in claim 36, wherein said color separation means comprises color separation filters, and said color forming means comprises color developing agents.

41. The apparatus as claimed in claim 36 or 40, further including combination retrieving means which retrieves several combinations out of various combinations of said color separation means and said color forming means.

42. The apparatus as claimed in claim 41, further including combination indication means which indicates combinations of said color separation means and said color forming means.

43. The apparatus as claimed in claim 36, wherein said control means is capable of controlling in such a manner that an arbitrary original image color may not be reproduced.

44. The apparatus as claimed in claim 41, wherein said control means selects the least combinations, out of said various combinations, from which the color conversion designated by said color conversion designation means is possible.

45. The apparatus as claimed in claim 36, wherein said color conversion designation means comprises original image color designation means to designate the original image color, and conversion color designation means to designate the conversion color.

46. The apparatus as claimed in claim 38, wherein said indication means indicates the original image color and the conversion color in the form of matrix.

47. A reproduction apparatus comprising:

(a) image forming means having a plurality of processing means for performing a corresponding plurality of process functions to form an image in an image carrier;

(b) control means to control said process means; and (c) input means to introduce input control information into said control means, said control means including selection means which selects the least number of processes among combinations of said plurality of processes to satisfy the control information in said input means.

48. The apparatus as claimed in claim 47, wherein said image forming means forms an image in a plurality of colors, and said control information is color conversion information for designating conversion colors with respect to arbitrary original image colors.

* * * * *

UNITED STATES PATENT AND TRADEMARK OFFICE

CERTIFICATE OF CORRECTION

PATENT NO. : 4,204,728

DATED : May 27, 1980

INVENTOR(S) : YOSHITOMO GOSHIMA, ET AL.

It is certified that error appears in the above-identified patent and that said Letters Patent are hereby corrected as shown below:

Col. 1, line 16, after "of" delete --a--;

Col. 1, line 48, change "sequantially"to --sequentially--;

Col. 2, line 21, after "color" delete --,--;

Col. 2, line 21, after "colors" add a --,--;

Col. 2, line 22, change "wil" to --will--;

Col. 2, line 58, change "other" to --another--;

Col. 6, line 50, change "convent" to --convert--;

Col. 7, line 6, change "and no" to --or no--;

Col.12, line 55, after "single" insert --step--;

Col.13, line 11, change "upto" to --up to--;

Col.13, line 52, change "circuiit" to --circuit--;

Col.14, line 34, change "is that" to --so that--;

Col.16, line 33, change "up to" to --into--;

Col.16, line 43, change "OFO" to --OFD--;

Col.17, line 28, change "seven" to --seventh--;

Col.17, line 53, change "is" to --are--;

UNITED STATES PATENT AND TRADEMARK OFFICE

CERTIFICATE OF CORRECTION

PATENT NO. : 4,204,728

DATED : May 27, 1980

INVENTOR(S) : YOSHITOMO GOSHIMA, ET AL.

It is certified that error appears in the above-identified patent and that said Letters Patent are hereby corrected as shown below:

Col.18, line 20, change "If not coincidence exists" to --If not coincident--;

Col.18, line 21, change "If coincided" to --If coincidence exists--;

Col.18, line 34, change "21b to --21(b)--;

TABLE 7, in ORG "3BO 76 F1 B8 54 D3" should read--"3BO F1 B8 54 D3 76--;

TABLE 7, the program designation "SKIP" should be moved down in front of series starting with "3FO";

TABLE 10, immediately below "01B 24B" insert -- 24B 01B --;

Col.24, line 49, change "particular two colors" to --particular colors--;

Col.28, line 68, change "tht" to --that--;

Col.29, line 28, change "Q.Q" to --Q.$\overline{Q}$--;

Col.30, line 10, change "opertion" to --operation--;

Col.30, line 40, change "designted" to --designated--;

Col.30, line 42, change "exand" to --expand--;

UNITED STATES PATENT AND TRADEMARK OFFICE

CERTIFICATE OF CORRECTION

PATENT NO. : 4,204,728

DATED : May 27, 1980

INVENTOR(S) : YOSHITOMO GOSHIMA, ET AL.

It is certified that error appears in the above-identified patent and that said Letters Patent are hereby corrected as shown below:

Col.30, line 64, change "color designation" to --color conversion designation--;

Col.31, line 10, change "designation means" to --designation by said designation means--;

Col.33, line 54, change "in a" to --is a --;

Col.36, line 21, change "in an" to --on an--.

Signed and Sealed this

*Twenty-eighth* Day of *October 1980*

[SEAL]

*Attest:*

SIDNEY A. DIAMOND

*Attesting Officer*

*Commissioner of Patents and Trademarks*